US012577073B2

(12) United States Patent
Tomatsu et al.

(10) Patent No.: US 12,577,073 B2
(45) Date of Patent: Mar. 17, 2026

(54) CONVEYING APPARATUS AND PRINTING APPARATUS

(71) Applicant: BROTHER KOGYO KABUSHIKI KAISHA, Nagoya (JP)

(72) Inventors: Yoshiya Tomatsu, Kasugai (JP); Shigeki Kato, Toyoake (JP); Yasunari Tsuji, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 89 days.

(21) Appl. No.: 18/184,334

(22) Filed: Mar. 15, 2023

(65) Prior Publication Data

US 2023/0312294 A1 Oct. 5, 2023

(30) Foreign Application Priority Data

Mar. 31, 2022 (JP) ..... 2022-060883
Mar. 31, 2022 (JP) ..... 2022-060946
(Continued)

(51) Int. Cl.
*B65H 23/02* (2006.01)
*B65H 16/10* (2006.01)
(Continued)

(52) U.S. Cl.
CPC ..... *B65H 23/0322* (2013.01); *B65H 16/10* (2013.01); *B65H 20/005* (2013.01); *B65H 23/16* (2013.01); *B65H 2403/411* (2013.01)

(58) Field of Classification Search
CPC ..... B65H 16/10; B65H 20/005; B65H 23/16; B65H 23/02; B65H 23/0322;
(Continued)

(56) References Cited

U.S. PATENT DOCUMENTS 5,091,754 A * 2/1992 Abe ..... G03G 15/234 271/240
5,625,398 A 4/1997 Milkovits et al.
(Continued)

FOREIGN PATENT DOCUMENTS

JP H06-320815 A 11/1994
JP 2521028 Y2 12/1996
(Continued)

*Primary Examiner* — Leslie A Nicholson, III
(74) *Attorney, Agent, or Firm* — Kenealy Vaidya LLP

(57) ABSTRACT

A conveying apparatus includes: a conveying unit configured to convey a sheet in a conveyance direction along a conveyance path; a sheet holder arranged upstream in the conveyance direction from the conveying unit to rotate around an axis, the axis extending in a first direction intersecting with the conveyance direction; a tensioner arranged between the sheet holder and the conveying unit in the conveyance path and configured to apply tension to the sheet with the sheet being curved; and a first side guide attached to the tensioner and having a first guide surface, the first guide surface spreading along the conveyance direction and a second direction intersecting with the first direction. The tensioner includes an oblique roller configured to guide the sheet to the first guide surface.

36 Claims, 40 Drawing Sheets

(30) Foreign Application Priority Data

Jul. 29, 2022 (JP) ..... 2022-121700
Jul. 29, 2022 (JP) ..... 2022-121925
Oct. 20, 2022 (JP) ..... 2022-168044

(51) Int. Cl.
*B65H 20/00* (2006.01)
*B65H 23/032* (2006.01)
*B65H 23/16* (2006.01)

(58) Field of Classification Search
CPC ..... B65H 23/038; B65H 2403/411; B65H 2404/70; B65H 2301/36; B65H 2301/361; B65H 2301/3613
USPC ..... 270/58.12, 58.17, 58.27; 271/234, 240, 271/248, 250, 253
See application file for complete search history.

(56) References Cited

U.S. PATENT DOCUMENTS 5,646,667 A 7/1997 Broder et al.
6,206,367 B1 * 3/2001 Jo ..... B65H 3/0669 271/226
6,412,992 B2 * 7/2002 Mogi ..... B41J 11/0055 400/613
8,992,001 B2 * 3/2015 Wanibuchi ..... B41J 15/042 347/101
9,352,923 B2 * 5/2016 Cornell ..... B65H 23/24
9,561,921 B2 * 2/2017 Takai ..... B65H 1/266
9,962,970 B2 * 5/2018 Ohnishi ..... B41J 15/16
11,964,476 B2 * 4/2024 Tomatsu ..... B65H 23/16
2012/0044309 A1 2/2012 Wanibuchi et al.
2012/0080839 A1 4/2012 Akimatsu
2016/0318320 A1 11/2016 Kokuta et al.
2016/0325563 A1 11/2016 Kokuta
2017/0001457 A1 1/2017 Kokuta
2017/0129263 A1 5/2017 Ohnishi
2018/0001679 A1 1/2018 Matsunaga et al.
2018/0017901 A1 1/2018 Kanzawa

FOREIGN PATENT DOCUMENTS

JP 2001-173748 A 6/2001
JP 2009-73573 A 4/2009
JP 2010-37031 A 2/2010
JP 2011-16624 A 1/2011
JP 2012-40735 A 3/2012
JP 2012-76829 A 4/2012
JP 2013-60265 A 4/2013
JP 2014-5120 A 1/2014
JP 2014-79977 A 5/2014
JP 2016-8111 A 1/2016
JP 2018-8808 A 1/2018
JP 2020-1408 A 1/2020

* cited by examiner

CONVEYING APPARATUS AND PRINTING APPARATUS

REFERENCE TO RELATED APPLICATIONS

This application claims priority from Japanese Patent Application Nos. 2022-060883 and 2022-060946 which are filed on Mar. 31, 2022, Japanese Patent Application Nos. 2022-121925 and 2022-121700 which are filed on Jul. 29, 2022, and Japanese Patent Application No. 2022-168044 which is filed on Oct. 20, 2022. The entire contents of the priority applications are incorporated herein by reference.

BACKGROUND ART

As an example of an image recording apparatus, a printer having a tension guide is known. The tension guide has a convex arc-shaped guide surface. A recording paper conveyed upward from a rolled paper is conveyed by a paper feed roller toward a printing position while sliding on the guide surface of the tension guide. A removable guide is attached to the tension guide. The removable guide has paper width guide pieces to regulate a position of the recording paper in a width direction. The removable guide is also provided with a roller to reduce a sliding resistance of the recording paper, which has a high coefficient of friction.

As another example of the image recording apparatus, an inkjet recording apparatus having a conveying unit is known. The conveying unit conveys a recording medium. The conveying unit has an upper guide and side guides to guide the recording medium. The side guides are moved to match the width of the recording medium by a rack and pinion mechanism. The rack and pinion mechanism has two rack gears and one pinion gear to engage with these rack gears.

DESCRIPTION

In the above printer, a distance between the paper width guide pieces of the removable guide is constant and the paper width guide pieces are not adaptable to recording papers having different width sizes. Therefore, in a case that the width of the rolled paper is larger than the distance between the paper width guide pieces, the paper width guide pieces do not work due to buckling of the rolled paper when the rolled paper is placed between the paper width guide pieces. In a case that the width of the rolled paper is smaller than the distance between the paper width guide pieces, the rolled paper moves or rotates in the width direction within a gap between the rolled paper and the paper width guide pieces.

The roller of the removable guide protrudes outward from the convex arc-shaped guide surface of the tension guide. Therefore, in a case that the detachable guide guides the recording paper, the recording paper is less curved and more likely to flex in the width direction than a case that the tension guide guides the recording paper. As a result, the recording paper tends to buckle when the recording paper contacts the paper width guide pieces.

On the other hand, in the above inkjet recording apparatus, if a conveying speed of the recording medium increases, the recording medium may contact the side guides and the side guides may move. If the side guides move from a desired position, conveyance defects are likely to occur due to displacement of the recording medium. On the other hand, if the side guides are firmly positioned, the side guides are not user-friendly because greater force is required to release the positioning of the side guides.

In addition, the backlash between the rack gears and the pinion gear may cause the side guides to rattle. If the side guides rattle, it is difficult to position the recording medium accurately. On the other hand, if the backlash is too small, smooth movement of the rack gears will be prevented.

The present teaching has been made in view of the above, and an object of the present teaching is to provide a means for regulating movement of a seat in a width direction while reducing buckling of the seat.

Further, the present teaching aims to provide a means for stably conveying the sheet depending on a width of the sheet while reducing the buckling of the sheet.

Another object of the present teaching is to provide a means for firmly positioning side guides and easily releasing the positioning of the side guides.

Still another object of the present teaching is to provide a means for smoothly moving the side guides and accurately positioning the side guides.

According to a first aspect of the present teaching, there is provided a conveying apparatus, including: a conveying unit configured to convey a sheet in a conveyance direction along a conveyance path; a sheet holder arranged upstream in the conveyance direction from the conveying unit to rotate around an axis, the axis extending in a first direction intersecting with the conveyance direction; a tensioner arranged between the sheet holder and the conveying unit in the conveyance path and configured to apply tension to the sheet with the sheet being curved; and a first side guide attached to the tensioner and having a first guide surface, the first guide surface spreading along the conveyance direction and a second direction intersecting with the first direction, wherein the tensioner includes an oblique roller configured to guide the sheet to the first guide surface.

In the conveying apparatus, the sheet is conveyed in the conveyance direction while being guided to the first guide surface by the oblique roller and positioned with respect to the first direction by the first guide surface. Since the tensioner applies the tension to the sheet and makes the sheet curved, buckling of the sheet can be reduced at a position where the sheet contacts the first guide surface.

In the conveying apparatus, the oblique roller may be a first roller configured to contact the sheet while rotating around a rotation axis, and the rotation axis of the oblique roller may be inclined with respect to the conveyance direction such that a virtual plane orthogonal to the rotation axis approaches the first guide surface toward downstream of the conveyance direction.

In the conveying apparatus, the oblique roller may be a second roller configured to contact the sheet while rotating around a rotation axis, and the second roller may include: a body having a conical trapezoidal shape with reduced diameter toward the first guide surface; and a support member extending in a direction intersecting with the conveyance direction and configured to support the body.

In the second roller, there is no need to make the support member inclined with respect to a direction intersecting with the conveyance direction, and the sheet can be guided to the first guide surface by the conical trapezoidal shape of the body.

In the conveying apparatus, an area in the first direction occupied by the first roller may include a center of the sheet holder in the first direction.

Even in cases that the width sizes of the sheets are different, the first roller contacts central parts of the sheets in the width direction. Therefore, load on each of the sheets due to the contact with the first roller is not biased in the first direction, and each of the sheets can be conveyed stably.

The conveying apparatus according may further include: a sub guide attached to the tensioner and having a sub guide surface, the sub guide surface facing the first guide surface in the first direction; and an interlock mechanism configured to interlock movement of the first side guide in the first direction and movement of the sub guide in the first direction, wherein the interlock mechanism may include: a pair of rack gears, one of the rack gears being connected to the first side guide and extending from the first side guide toward the sub guide in the first direction, the other of the rack gears being connected to the sub guide and extending from the sub guide toward the first side guide in the first direction; and a pinion gear configured to mesh with the rack gears.

In the configuration described above, when the first side guide is moved in the first direction, the sub guide is moved in a reverse direction opposite to the moving direction of the first side guide by the interlock mechanism. Therefore, a plurality of width sizes of the sheets can be sandwiched between the first side guide and the sub guide. This prevents meandering and skew of the sheet.

In the conveying apparatus, a distance in the first direction between the first side guide and a center of the sheet holder in the first direction may be the same as a distance in the first direction between the sub guide and the center of the sheet holder in the first direction.

In the conveying apparatus, the tensioner may be configured to move in a direction intersecting with a surface of the sheet being curved, and the tensioner may be configured to be urged toward outside of a curve of the sheet.

The above configuration allows a constant tension to be applied to the sheet being conveyed between the sheet holder and the conveying unit.

In the conveying apparatus, a downstream end edge in the conveyance direction of the first guide surface may depart from the tensioner toward downstream in the conveyance direction, and the first side guide may include a guard surface continuous from the downstream end edge and spreading in the first direction.

In the above configuration, the sheet skewed form the downstream end edge of the first guide surface contacts the guard surface. Therefore, it is possible to prevent the sheet from moving in a direction away from the tensioner.

In the conveying apparatus, the first side guide may include an extending piece extending from the first guide surface in the first direction, the extending piece having a curved surface being curved along the conveyance direction, and a part of an outer circumferential surface of the first roller may project from the curved surface toward the second surface.

In the above configuration, the sheet to which the tension is applied by the tensioner is curved along the curved surface. It also reduces the entry of the sheet into a space between the first side guide and the tensioner.

The conveying apparatus may further include: a holder driving motor configured to apply driving force to the sheet holder to rotate the sheet holder; a conveyance motor configured to apply driving force to the conveying unit to rotate a roller of the conveying unit; and a controller configured to drive the holder driving motor and the conveyance motor, such that speed at which the sheet in the sheet holder is ejected in the conveyance direction and speed at which the sheet is conveyed by the conveying unit in the conveyance direction are different from each other.

The conveying apparatus may further include a pair of second side guides arranged downstream in the conveyance direction from the conveying unit, wherein the second side guides may have second guide surfaces facing each other in the first direction, each of the second guide surfaces spreading along the conveyance direction and the second direction.

In the above configuration, when the sheet is conveyed in a reverse direction opposite to the conveyance direction along the conveyance path, the sheet is guided by the second side guide and the skew of the sheet is prevented.

The conveying apparatus may further include: a holder driving motor configured to apply driving force to the sheet holder to rotate the sheet holder; a conveyance motor configured to apply driving force to the conveying unit to rotate a roller of the conveying unit; and a controller configured to drive the holder driving motor and the conveyance motor, such that speed at which the sheet is rewound in the sheet holder in a reverse direction opposite to the conveyance direction is smaller than speed at which the sheet is conveyed by the conveying unit in the reverse direction.

When the sheet is conveyed in a reverse direction opposite to the conveyance direction along the conveyance path, if the sheet is conveyed in the reverse direction in a state of being applied the tension by the tensioner, the sheet being conveyed in the reverse direction is apart from the first side guide by the first roller. The above configuration makes it possible to prevent the sheet from being apart from the first side guide by the first roller.

The conveying apparatus may further include: a holder driving motor configured to apply driving force to the sheet holder to rotate the sheet holder; a conveyance motor configured to apply driving force to the conveying unit to rotate a roller of the conveying unit; a movement mechanism configured to move the first roller between a contact position where the first roller contacts the sheet and a separate position where the first roller is apart from the sheet, and a controller configured to control the movement mechanism to move the first roller to the separate position while driving the holder driving motor and the conveyance motor such that the sheet is conveyed in a reverse direction opposite to the conveyance direction.

When the sheet is conveyed in a reverse direction opposite to the conveyance direction along the conveyance path, if the sheet is conveyed in the reverse direction in a state of the first roller contacting the sheet, the sheet being conveyed in the reverse direction is apart from the first side guide by the first roller. In the above configuration, the movement mechanism can prevent the sheet from being apart from the first side guide by the first roller.

In the conveying apparatus, the movement mechanism may be a solenoid configured to move a support member by movement of a plunger in a stroke direction, the support member being configured to support the first roller to be rotatable, and the controller may be configured to turn off a power to the solenoid to move the first roller to the separate position while driving the holder driving motor and the conveyance motor such that the sheet is conveyed in the reverse direction.

The conveying apparatus may further include: a holder driving motor configured to apply driving force to the sheet holder to rotate the sheet holder; a conveyance motor configured to apply driving force to the conveying unit to rotate a roller of the conveying unit; and a controller configured to drive the holder driving motor and the conveyance motor such that the sheet is conveyed by the conveying unit in the conveyance direction at least once, after driving the holder driving motor and the conveyance motor to convey the sheet in a reverse direction opposite to the conveying direction.

In the above configuration, even if the sheet is skewed at downstream in the conveyance direction from the conveying unit, it is possible to eliminate the skew of the sheet by conveying the sheet in a reverse direction opposite to the conveyance direction and then conveying the sheet in the conveyance direction again while contacting the sheet with the first side guide.

The conveying apparatus may further include: a housing; and a tension applying means configured to apply tension to the sheet in the tensioner, wherein the tensioner may be fixed to the housing.

The conveying apparatus may further include: a holder driving motor configured to apply driving force to the sheet holder to rotate the sheet holder; a conveyance motor configured to apply driving force to the conveying unit to rotate a roller of the conveying unit; and a controller configured to drive the holder driving motor and the conveyance motor, such that speed at which the sheet in the sheet holder is ejected in the conveyance direction and speed at which the sheet is conveyed by the conveying unit in the conveyance direction are different from each other.

According to a second aspect of the present teaching, there is provided a conveying apparatus, including: a conveying unit configured to convey a sheet in a conveyance direction along a conveyance path; a sheet holder arranged upstream in the conveyance direction from the conveying unit to rotate around an axis, the axis extending in a first direction intersecting with the conveyance direction; a tensioner arranged between the sheet holder and the conveying unit in the conveyance path and configured to apply tension to the sheet with the sheet being curved; a first side guide attached to the tensioner and having a first guide surface, the first guide surface spreading along the conveyance direction and a second direction intersecting with the first direction; and a sub guide attached to the tensioner and having a sub guide surface, the sub guide surface facing the first guide surface in the first direction, wherein the tensioner includes an urging means configured to urge the sheet to the first guide surface, and the urging means includes: a movable member being movable from the sub guide surface toward the first guide surface; and an urging member configured to urge the movable member toward the first guide surface.

In the above configuration, since the first roller and the movable member can make the sheet approach the first side guide, the meandering and the skew of the sheet can be reduced more reliably.

According to a third aspect of the present teaching, there is provided a conveying apparatus, including: a conveyance roller configured to convey a sheet in a conveyance direction along a conveyance path; a frame including: a guide member extending in a first direction intersecting with the conveyance direction; and support members arranged at both end sides in the first direction of the conveyance path and having first long holes respectively, each of the first long holes being extended in a second direction intersecting with the conveyance direction and the first direction; side guides arranged between the support members and having second long holes being extended in the second direction respectively, the side guides being movable in the first direction along the guide member; a shaft inserted into the first long holes and the second long holes; a lever fixed to the shaft; and an elastic member configured to urge the shaft toward the guide member, wherein each of the second long holes has a tapered portion, a dimension in the conveyance direction of the tapered portion decreases toward the guide member as compared with a dimension in the conveyance direction of the shaft, and the lever is configured to rotate between a first rotational position to apply urging force of the elastic member to the shaft and a second rotational position to retain the shaft at a position away from the tapered portion against the urging force of the elastic member.

The shaft is urged toward the tapered portion of the second long hole by the urging force of the elastic member, and an inclined surface of the tapered portion inclined to the second direction is urged by the shaft. Therefore, the shaft is urged to the tapered portion by force greater than the urging force in the second direction. This fixes positions of the side guides. Since the force for rotating the lever from the first rotational position to the second rotational position is large enough to resist the urging force of the elastic member, the lever can be rotated relatively easily.

In the conveying apparatus, the lever may have a cam surface, in a state that the lever is in the first rotational position, the cam surface may be separated away from the guide member, and in a state that the lever is in the second rotational position, the cam surface may contact the guide member.

In the conveying apparatus, the tapered portion may include: a first surface spreading along the first direction and the second direction; and a second surface facing the first surface in the conveyance direction and spreading along the first direction and a direction intersecting with the first surface.

In the conveying apparatus, the side guides may have support surfaces to support the sheet and guide surfaces being extended from the support surfaces along the second direction respectively, at positions in the second direction opposite to the shaft with respect to the guide member.

In the conveying apparatus, one of the support surfaces may have an inner end and an outer end farther in the first direction from the other of the support surfaces than the inner end, and a part of the inner end may bulge toward the outer end.

Light used in an optical sensor can pass through the part of the inner end bulged toward the outer end. Therefore, the optical sensor can function even if the support surfaces are moved in the first direction together with side guides.

The conveying apparatus may further include a roller arranged between the guide member and the support surfaces in the second direction.

The sheet can be conveyed smoothly in the conveyance direction by the roller.

The conveying apparatus may further include: a second frame; second side guides; a second shaft; a second lever; and a second elastic member, wherein the frame, the side guides, the shaft, the lever and the elastic member may be arranged downstream in the conveyance direction from the conveyance roller, and the second frame, the second side guides, the second shaft, the second lever and the second elastic member may be arranged upstream in the conveyance direction from the conveyance roller.

It is possible to position both ends in the first direction of the sheet at upstream and downstream from the conveying roller.

According to a fourth aspect of the present teaching, there is provided a conveying apparatus, including: a conveyance roller configured to convey a sheet in a conveyance direction along a conveyance path; a guide member extending in a first direction intersecting with the conveyance direction; side guides arranged to be apart from each other in the first direction, the side guides being movable in the first direction along the guide member; and an interlock mechanism configured to interlock movement of the side guides in the first direction, wherein the interlock mechanism includes: first rack gears connected to the side guides respectively and extending from the side guides inwardly in the first direction; second rack gears overlapped with the first rack gears respectively in a second direction intersecting with the conveyance direction and the first direction, the second rack gears being movable in the first direction between a first position and a second position, the second rack gears being in phase with the first rack gears in the first position, the second rack gears being out of phase with the first rack gears in the second position; a pinion gear configured to mesh with the first rack gears and the second rack gears; and an elastic member configured to urge the second rack gears toward the second position with respect to the first rack gears.

The movements in the first direction of the first rack gears, which are connected to the side guides respectively, are interlocked with each other via the mesh with the pinion gear. In a state of the first rack gears being stationary, the second rack gears are urged toward the second position. Therefore, in teeth grooves of the pinion gear, the first rack gears and the second rack gears contact opposing teeth surfaces of the pinion gear, respectively. This prevents the first rack gears from rattling due to backlash between the first rack gears and the pinion gear.

In the conveying apparatus, the first rack gears may have inward teeth surfaces facing inwardly in the first direction and the second rack gears may have inward teeth surfaces facing inwardly in the first direction, in a state of the second rack gears being in the first position, the inward teeth surfaces of the second rack gears may overlap with the inward teeth surfaces of the first rack gears respectively in the second direction, in a state of the second rack gears being in the second position, the inward teeth surfaces of the first rack gears may be shifted inwardly in the first direction with respect to the inward teeth surfaces of the second rack gears, and the elastic member may be configured to urge the second rack gears outwardly in the first direction with respect to the first rack gears.

When the side guides are moved to approach each other, the first rack gears contact the pinion gear. When the side guides are moved to apart from each other, the second rack gears contact the pinion gear. Therefore, after the side guides are moved to approach each other, the side guides are prevented from moving by the urging force applied to the second rack gears.

In the conveying apparatus, the first rack gears may be guided in the first direction while being fitted in the guide member.

In the conveying apparatus, a dimension in the second direction of each of the first rack gears may be greater than a dimension in the second direction of each of the second rack gears.

The conveying apparatus may further include a flange configured to support the pinion gear, wherein the second rack gears may be positioned between the first rack gears and the flange in the second direction.

In the conveying apparatus, the second rack gears may be supported by the first rack gears to be movable.

The conveying apparatus may further include: a sheet holder arranged upstream in the conveyance direction from the conveyance roller to rotate around an axis extending in the first direction; and a tensioner arranged between the sheet holder and the conveyance roller in the conveyance path and configured to apply tension to the sheet with the sheet being curved, wherein the side guides may include: a first side guide attached to the tensioner and having a first guide surface, the first guide surface spreading along the conveyance direction and the second direction; and a second side guide attached to the tensioner and having a second guide surface, the second guide surface facing the first guide surface in the first direction, one of the first rack gears may be connected to the first side guide and may extend from the first side guide toward the second side guide in the first direction, and the other of the first rack gears may be connected to the second side guide and may extend from the second side guide toward the first side guide in the first direction.

In the above configuration, the sheet is sandwiched in the first direction between the first side guide capable of accurate and smooth positioning and the second side guide interlocking the first side guide. Therefore, it is possible to prevent the sheet from meandering and skewing due to rattle of the first side guide and the second side guide while adapting to multiple types of widths of the sheets. Moreover, since the tensioner applies tension to the sheet and makes the sheet curved, stiffness of the sheet can be increased and buckling of the sheet can be reduced between the first guide surface and the second guide surface.

In the conveying apparatus, the interlock mechanism may include a lock mechanism configured to prevent the first side guide and the second side guide from moving in the first direction, the tensioner may include a first roller configured to contact the sheet while rotating around a rotation axis, and the rotation axis may be inclined with respect to the conveyance direction such that a virtual plane orthogonal to the rotation axis approaches one of the first guide surface and the second guide surface toward downstream of the conveyance direction.

In the above configuration, when the sheet contacts the first guide surface or the second guide surface by the first roller, the sheet can be prevented from skewing reliably by fixing the first side guide and the second side guide without rattling.

In the conveying apparatus, the lock mechanism may include: a disk configured to rotate around a shaft of the pinion gear in synchronization with rotation of the pinion gear; and a lock member having a contact part configured to contact an outer circumferential surface of the disk, the lock member may be configured to move between a contact position where the contact part contacts the outer circumferential surface and a separate position where the contact part is apart from the outer circumferential surface.

In the above configuration, the movements of the first side guide and the second side guide can be regulated by stopping the rotation of the pinion gear.

In the conveying apparatus, the lock mechanism may include a lock member having a contact piece configured to move in a third direction intersecting with the first direction and the second direction, and the lock member may be configured to move between a contact position where the contact piece contacts any one of the first rack gears and a separate position where the contact piece is apart from the first rack gears.

In the above configuration, the movements of the first side guide and the second side guide can be regulated by stopping the movement of the first rack gears.

The conveying apparatus may further include a third side guide and a fourth side guide arranged downstream in the conveyance direction from the conveyance roller, wherein the third side guide may have a third guide surface spreading along the conveyance direction and the second direction, and the fourth side guide may have a fourth guide surface spreading along the conveyance direction and the second direction and facing the third guide surface in the first direction.

In the above configuration, since the third side guide and the fourth side guide are arranged downstream in the conveyance direction from the conveyance roller, the sheet can be conveyed stably also at the downstream from the conveyance roller.

According to a fifth aspect of the present teaching, there is provided a printing apparatus, including: the conveying apparatus according to the fourth aspect; and a recording head configured to record an image on the sheet conveyed by the conveyance roller.

According to the present teaching, it is possible to regulate movement of the sheet in the width direction while preventing the buckling of the sheet.

According to the present teaching, it is possible to position the side guides accurately while moving the side guides smoothly. Moreover, the sheet can be conveyed stably according to the sheet width, while preventing the buckling of the sheet.

According to the present teaching, the side guides can be positioned firmly and the positioning of the side guides can be released easily.

The following is a detailed description of an image recording apparatus 1 for an embodiment of the present teaching. The following embodiment is merely one example of the present teaching, and it goes without saying that the embodiment can be changed as appropriate without departing from the gist of the present teaching.

Definition

In the following explanation, advancement or movement (progress) directed from a starting point to an end point of an arrow is expressed as an "orientation", and going forth and back on a line connecting the starting point and the end point of the arrow is expressed as a "direction". In other words, an orientation is a component of the direction.

Figure 1:
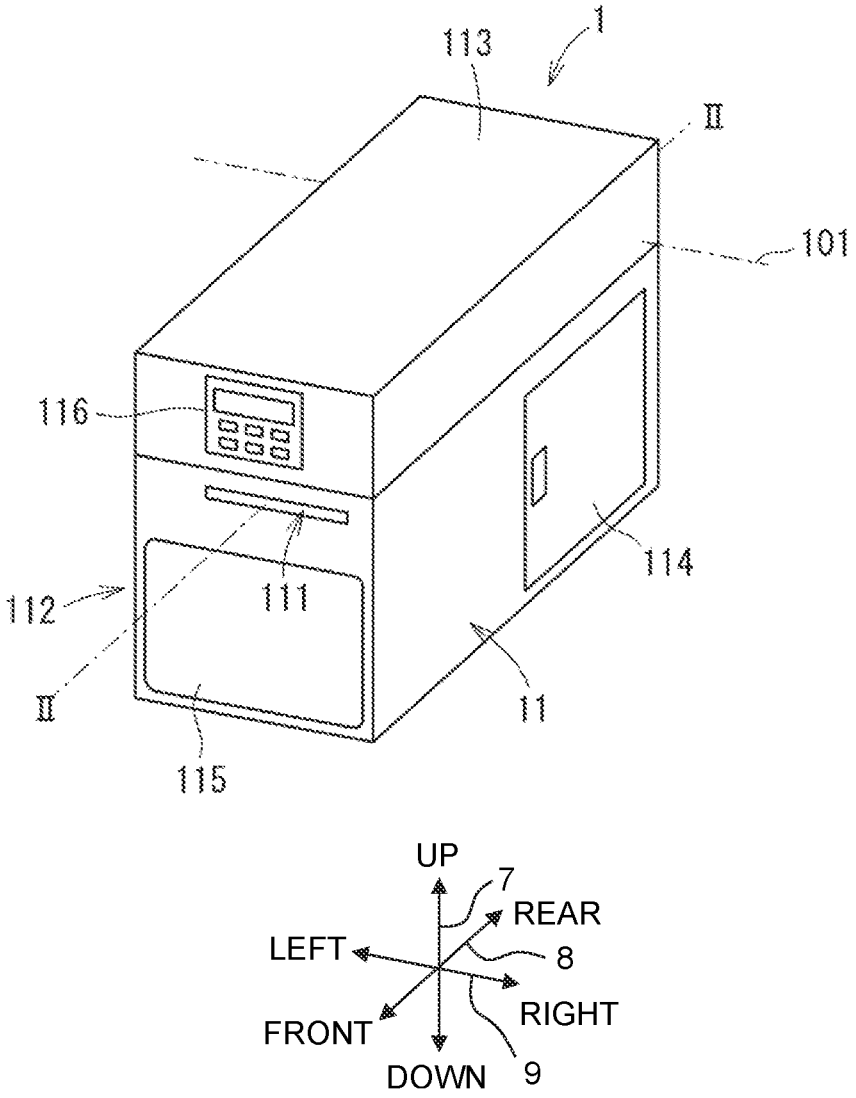
FIG. 1 is a perspective view depicting an appearance of an image recording apparatus in accordance with an embodiment of the present teaching.

An up-down direction 7 is defined with respect to the state in which the image recording apparatus 1 is installed ready for use (the state depicted in FIG. 1). A front-rear direction 8 is defined with the side where a discharge port 111 is provided in the image recording apparatus 1 as the front. A left-right direction 9 (an example of the first direction) is defined with the image recording apparatus 1 viewed from the front.

[Image Recording Apparatus 1]

Image recording apparatus 1 (an example of the conveying apparatus) records an image on a sheet S by using an inkjet recording method. The sheet S is, for example, a rolled paper. The image recording apparatus 1 is adaptable to multiple types of sheets of different sheet widths.

As depicted in FIG. 1, the image recording apparatus 1 has a housing 11. The housing 11 has a box shape which is long in the front-rear direction 8. The housing 11 has a size to be installed on a tabletop, a floor, or a rack. A discharge port 111 is located on a front wall of housing 11. The discharge port 111 is a through hole extended in the left-right direction 9. From the discharge port 111, the sheet S with recorded images is discharged. A control panel 116 operated by a user is located on the front wall of housing 11. A front cover 115 is located at the bottom of the front wall of the housing 11. Opening and closing the front cover 115 exposes or shields a tank 12 (see FIG. 2). The right cover 114 is located at the rear of a right wall of housing 11. Opening and closing the right cover 114 exposes or shields a seat holder 13 (see FIG. 2).

Housing 11 has a main body 112 as a lower portion, and a top cover 113 as an upper portion. The main body 112 is a box shape with an opening upward. The top cover 113 is connected to the main body 112 to be rotatable around an axis 101, that is located at the rear of the main body 112 and extends along the left-right direction 9. As depicted in FIG. 1, when the top cover 113 is in a closed position, the opening of the main body 112 is closed. The image recording apparatus 1 performs image recording in this state. When the top cover 113 is rotated around the axis 101 so that the front wall is lifted upward, the opening of the main body 112 is exposed. When a user performs maintenance work, such as replacing a sheet S, the top cover 113 is lifted to allow the user access to an interior space of the housing 11.

Figure 2:
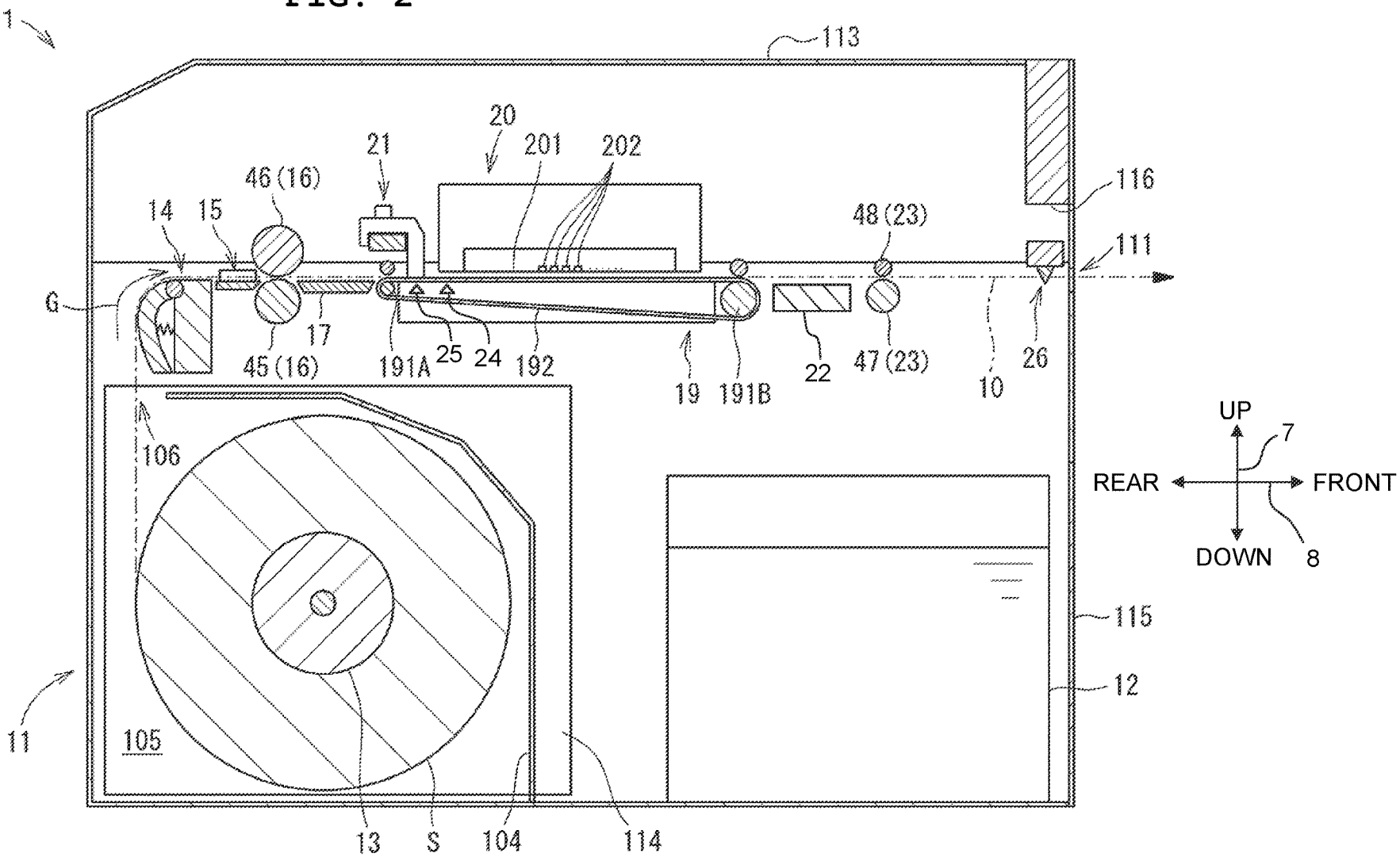
FIG. 2 is a schematic diagram depicting a longitudinal section of the image recording apparatus along a line II-II in FIG. 1.
Figure 24:
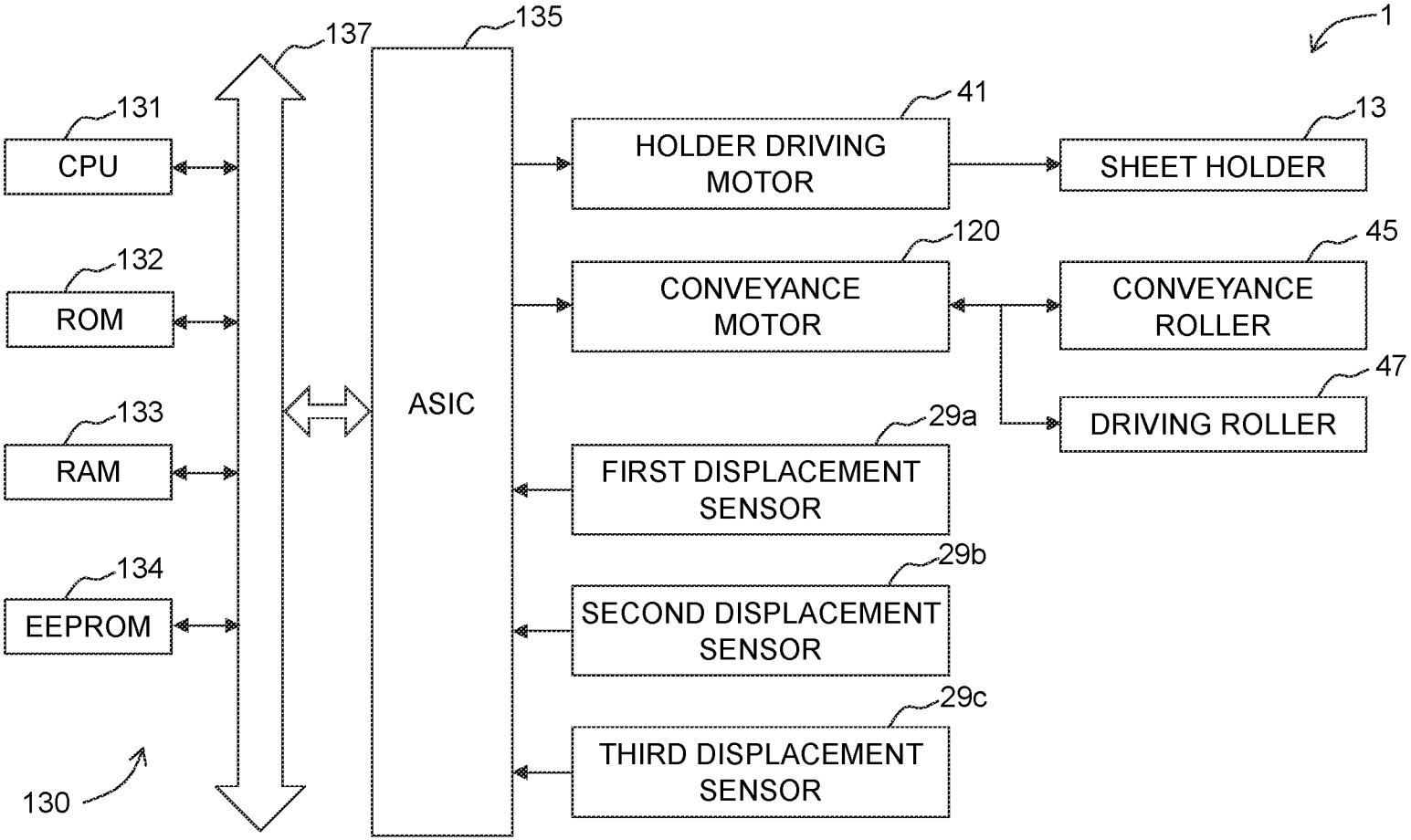
FIG. 24 is a functional block diagram of the image recording apparatus.

As depicted in FIG. 2, the interior space of housing 11 contains a tank 12, a sheet holder 13, a tensioner 14, rear side guides 15, a conveyance roller pair 16, a lower guide 17, a belt conveyance mechanism 19, a recording head 20, a front side guide (an example of second side guides) 21, a heater 22, a discharge roller pair 23, optical sensors 24, 25, a cutter 26, a first sensor 29*a*, a second sensor 29*b*, a third sensor 29*c*, and a controller 130 (see FIG. 24). It goes without saying that other components such as a reading sensor that reads the recorded image of the sheet S, a power supply, a control board, and a cooling apparatus may be provided in the interior space of the housing 11.

As depicted in FIG. 2, the tank 12 is located just behind the front cover 115 and stores ink inside. The ink in the tank 12 is supplied to the recording head 20 through an ink tube (not depicted).

At the rear of the interior space of the housing 11, a roll accommodating space 105 is demarcated by a partition wall 104 and an outer wall of the housing 11. Between a rear end of the partition wall 104 and a rear wall of the housing 11, a space 106 is formed. The sheet S passes through the space 106. The sheet holder 13 is located in the roll accommodating space 105. The sheet S, which forms a rolled body, is supported by the sheet holder 13, which is rotatable around an axis extending in the left-right direction 9. The sheet holder 13 is powered and rotated by a holder driving motor 41 (see FIG. 24). The holder driving motor 41 is capable of forward or reverse rotation.

The tensioner 14 is located above the space 106. The seat S drawn upward from the seat holder 13 is hung on the tensioner 14. The sheet S curves along the tensioner 14 and extends forward. A top surface of the tensioner 14 and the discharge port 111 are almost at the same position in the up-down direction 7. Between the tensioner 14 and the discharge port 111 in the front-rear direction 8, a conveyance path 10 through which the sheet S passes is demarcated by components located in the up-down direction 7. The conveyance path 10 is depicted by a one dot chain line in FIG. 2. The sheet S is conveyed between the sheet holder 13 and the tensioner 14 upward (an example of the conveying direction), and after being curved along the tensioner 14, the sheet S is conveyed forward (an example of the conveying direction) along the conveyance path 10 from the top surface of the tensioner 14 toward the discharge port 111.

[Tensioner 14]

Figure 3:
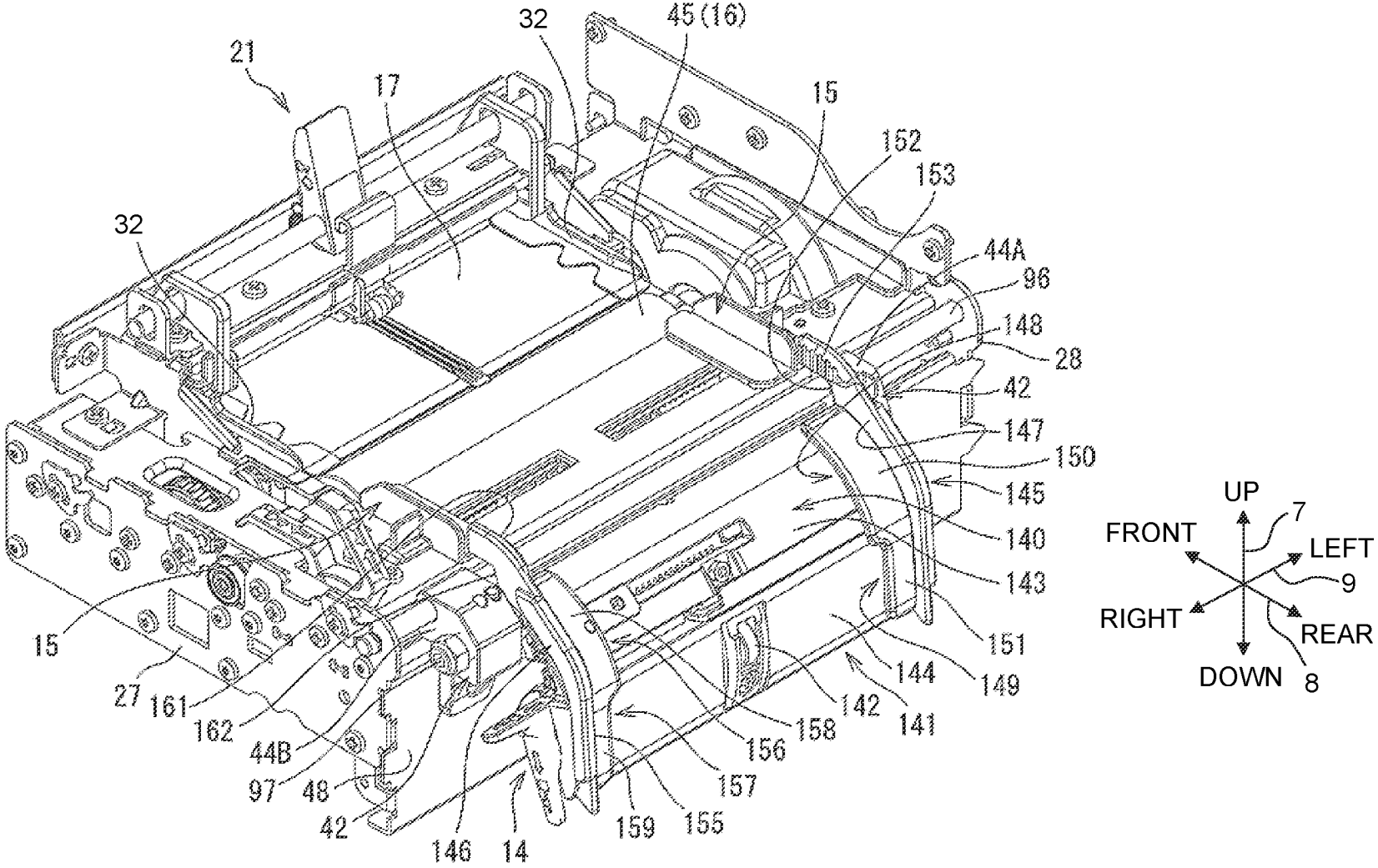
FIG. 3 is a perspective view of a first side guide viewed obliquely from behind.

As depicted in FIG. 3, the tensioner 14 is connected to a pair of frames 27 and 28 fixed to the housing 11. The tensioner 14 has a shaft 42, a supporting plate 43 located below the shaft 42, an urging member 18 (an example of the tension applying means, see FIG. 4), a circular arc member 140, a flat member 141, a first roller 142 (an example of the oblique roller), an interlock mechanism 50, and a lock mechanism 70.

The shaft 42 has a support shaft 96, a rotation shaft 97, and a pair of connecting members 44A, 44B. The shaft 42 is located in front of an upper part of the arc member 140. The tensioner 14 is supported by the frames 27, 28 via the shaft 42.

The support shaft 96 has a cylindrical shape with its axis extending in the left-right direction 9. The support shaft 96 is supported by the pair of frames 27, 28. The support shaft 96 rotatably supports the pair of connecting members 44A, 44B. The connecting member 44A is located to the left of a first side guide 145. The connecting member 44B is located to the right of a sub guide 146. The rotation shaft 97 is inserted into the pair of connecting members 44A, 44B. The rotation shaft 97 supports the arc member 140 to be rotatable with respect to the pair of connecting members 44A, 44B.

The support plate 43 is a flat plate connected to the pair of frames 27, 28, and its main surface spreads in the up-down direction 7 and the left-right direction 9. The urging member 18 is a coil spring extendible in the front-rear direction 8, with one end fixed to the support plate 43 and the other end fixed to the flat member 141 (see FIG. 4).

The arc member 140 is supported to be rotatable around a central axis of the rotation shaft 97. The arc member 140 is movable in a direction intersecting with the surface of the curved sheet S, namely, in an outward direction Q and in an inward direction R of the curve. The arc member 140 faces the sheet S being conveyed in the conveyance path 10. The arc member 140 has a first curved surface 143 bulged in the outward direction Q. The first curved surface 143 is a curved surface spreading along the left-right direction 9 and has an arc shape when viewed from the left and the right.

The flat member 141 extends downward from a lower end of the arc member 140. The flat member 141 is rotated around the central axis of the rotation shaft 97 together with the arc member 140. The flat member 141 is urged backward by the urging member 18. The flat member 141 has a first flat surface 144. The first flat surface 144 is a plane facing rearward. An upper end of the first flat surface 144 is continuous with a lower end of the first curved surface 143.

A first side guide 145 and a sub guide 146 is attached to the tensioner 14. The first side guide 145 is located across the first flat surface 144 and the first curved surface 143. The first side guide 145 has a first guide surface 147, a first extending piece (an example of the extending piece) 148, and a second extending piece 149.

The first guide surface 147 of the first side guide 145 is a surface facing rightward. The first guide surface 147 spreads in the up-down direction 7 and the front-rear direction 8 (an example of the second direction) and further spreads along the conveyance orientation G (see FIG. 2).

The first extending piece 148 extends to the right from near an edge in the inward orientation R of the first guide surface 147. A dimension of the first extending piece 148 along the left-right direction 9 is smaller than half the width along the left-right direction 9 of the narrowest sheet among the multiple types of the sheets. The first extending piece 148 has a second curved surface 150 (an example of the curved surface) bulged in the outward orientation Q. The second curved surface 150 is curved along the first curved surface 143 of the arc member 140. Specifically, the second curved surface 150 has an arc shape when viewed from the left and the right, and spreads along the left-right direction 9. Since the sheet S is conveyed along the second curved surface 150 in the conveyance orientation G in a curved state, stiffness (flexural rigidity) of the sheet S is increased, and buckling of the sheet S is prevented even when an edge of the sheet S contacts the first guide surface 147.

The second extending piece 149 extends downward from a lower end of the first extending piece 148. The second extending piece 149 extends to the right from near the edge in the inward orientation R of the first guide surface 147. The first extending piece 148 and the second extending piece 149 are integrated as a single member. A dimension of the second extending piece 149 along the left-right direction 9 is smaller than a dimension of the first extending piece 148 along the left-right direction 9. The second extending piece 149 has a second flat surface 151. The second flat surface 151 is a flat surface facing backward and spreading along the up-down direction 7 and the left-right direction 9.

Figure 4:
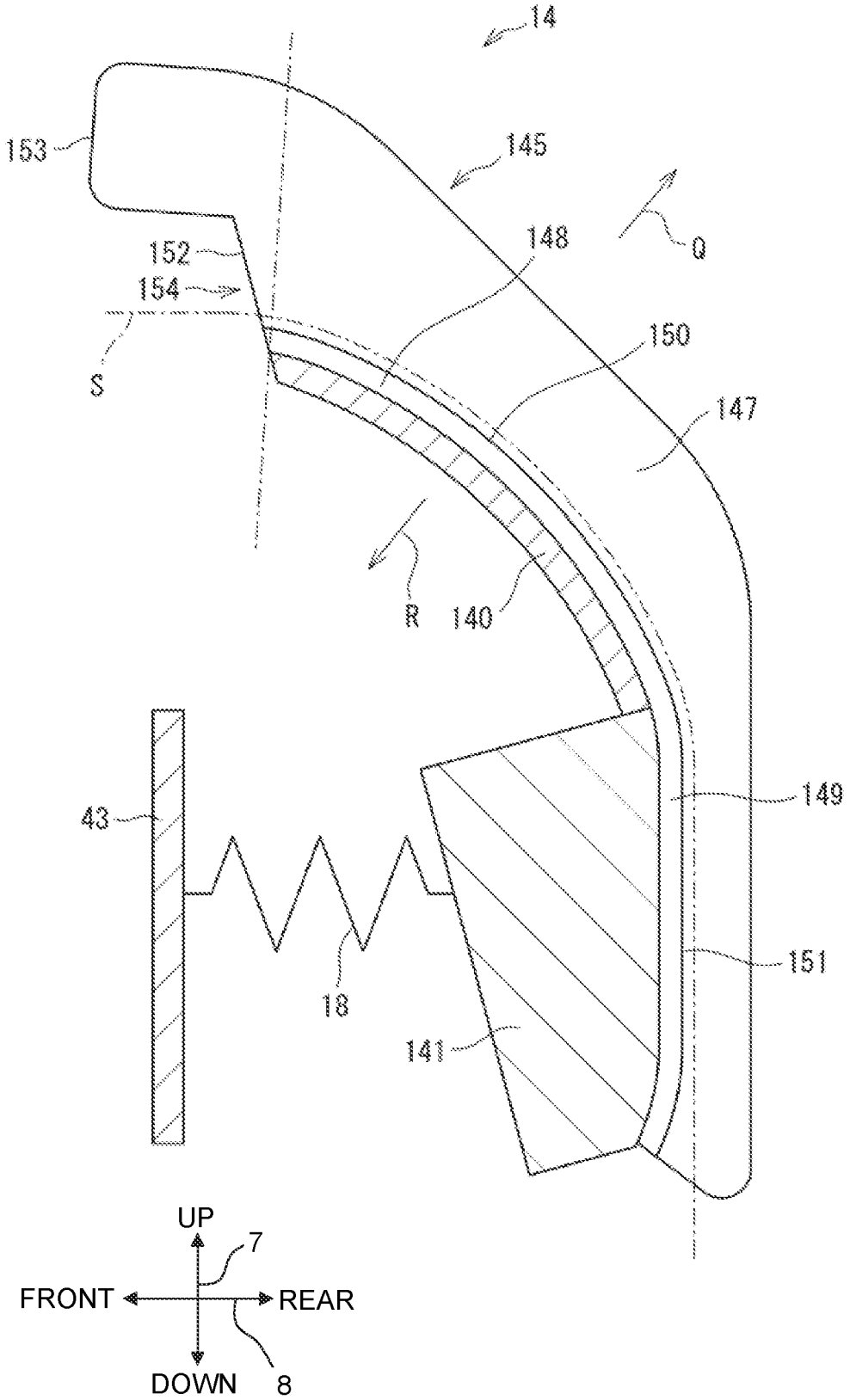
FIG. 4 is a schematic diagram of the first side guide viewed from right.

As depicted in FIGS. 3 and 4, a downstream edge of the first guide surface 147 in the conveyance orientation G is a first downstream edge 152 (an example of the downstream edge). A first knob 153 is located at an upper end of the first guide surface 147. The first knob 153 is held by the user when sliding the first side guide 145 in the left-right direction 9. The first downstream edge 152 is located between the first knob 153 and an upper end of the second curved surface 150. The first downstream edge 152 extends forward as it goes upward. A first guard surface (an example of the guard surface) 154 continuous with the first downstream edge 152 is located to the left of the first downstream edge 152 of the first guide surface 147 (see FIG. 5). The first guard surface 154 is a surface extending from the first downstream edge 152 to the right. If the sheet S being conveyed in the conveyance orientation G is skewed to the left, a left edge of the sheet S may protrude to the left beyond the first guide surface 147 at downstream of the first guide surface 147 in the conveyance orientation G. In this case, the first guard surface 154 is positioned above the left edge of the sheet S.

Figure 5:
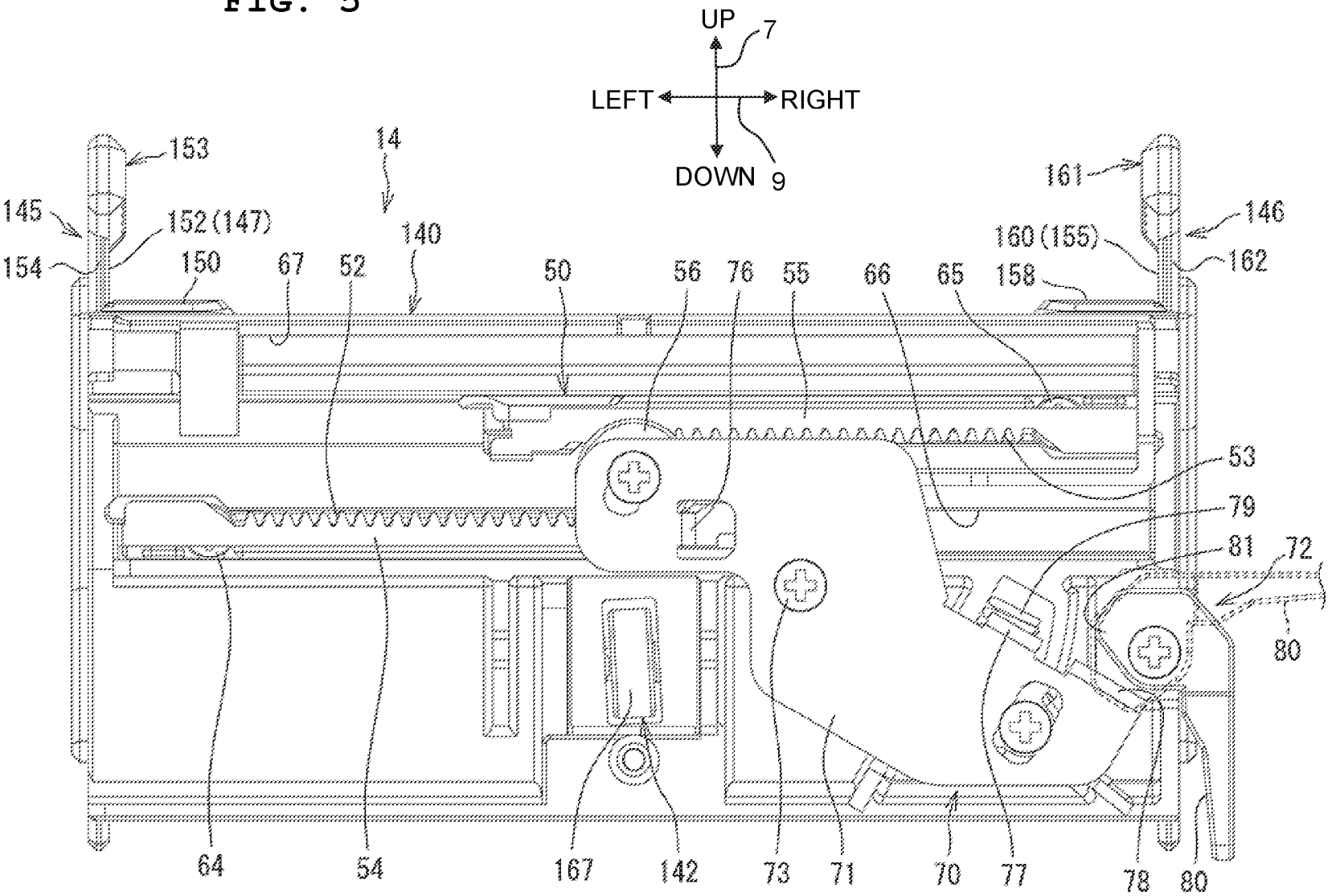
FIG. 5 is a front view of an interlock mechanism.

As depicted in FIGS. 3 and 5, the sub guide 146 is symmetrical with the first side guide 145 with respect to the center of the tensioner 14 in the left-right direction 9. The sub guide 146 is located across the first flat surface 144 and the first curved surface 143. The sub guide 146 has a sub guide surface 155 (FIG. 12), a third extending piece 156, and a fourth extending piece 157.

The sub guide surface 155 of the sub guide 146 is a surface facing leftward. The sub guide surface 155 faces the first guide surface 147 in the left-right direction 9. The sub guide surface 155 spreads in the up-down direction 7 and the front-rear direction 8 and also spreads along the conveyance orientation G. The sub guide surface 155 faces the first side guide 145 in the left-right direction 9.

The third extending piece 156 extends to the left from near an edge in the inward orientation R of the sub guide surface 155. A dimension of the third extending piece 156 along the left-right direction 9 is smaller than half the width along the left-right direction 9 of the narrowest sheet among the multiple types of the sheets, and is the same as the first extending piece 148. The third extending piece 156 has a third curved surface 158 bulged in the outward orientation Q. The third curved surface 158 is curved along the first curved surface 143 of the arc member 140. Specifically, the third curved surface 158 has an arc shape when viewed from the left and the right. The third curved surface 158 spreads along the left-right direction 9.

The fourth extending piece 157 extends downward from a lower end of the third extending piece 156. The fourth extending piece 157 extends leftward from near the edge in the inward orientation R of the sub guide surface 155. The third extending piece 156 and the fourth extending piece 157 are integrated as a single member. A dimension of the fourth extending piece 157 along the left-right direction 9 is smaller than a dimension of the third extending piece 156 along the left-right direction 9. The fourth extending piece 157 has a third flat surface 159. The third flat surface 159 is a flat surface facing backward and spreading along the up-down direction 7 and the left-right direction 9.

Similar to the first side guide 145, a downstream edge of the sub guide surface 155 in the conveyance orientation G is the second downstream edge 160. A second knob 161 is located at an upper end of the sub guide surface 155. The second downstream edge 160 is held by the user when sliding the sub guide 146 in the left-right direction 9. The second downstream edge 160 is located between the second knob 161 and an upper end of the third curved surface 158. The second downstream edge 160, similar to the first downstream edge 152, extends forward as it goes upward. A second guard surface 162 continuous with the second downstream edge 160 is located to the right of the second downstream edge 160 of the sub guide surface 155. The second guard surface 162 is a surface extending leftward from the second downstream edge 160. If the sheet S being conveyed in the conveyance orientation G is skewed to the right, a right edge of the sheet S may protrude to the right beyond the sub guide surface 155 at downstream from the sub guide surface 155 in the conveyance orientation G. In this case, the second guard surface 162 is positioned above the right edge of the sheet S.

[Interlock Mechanism 50]

Figure 6:
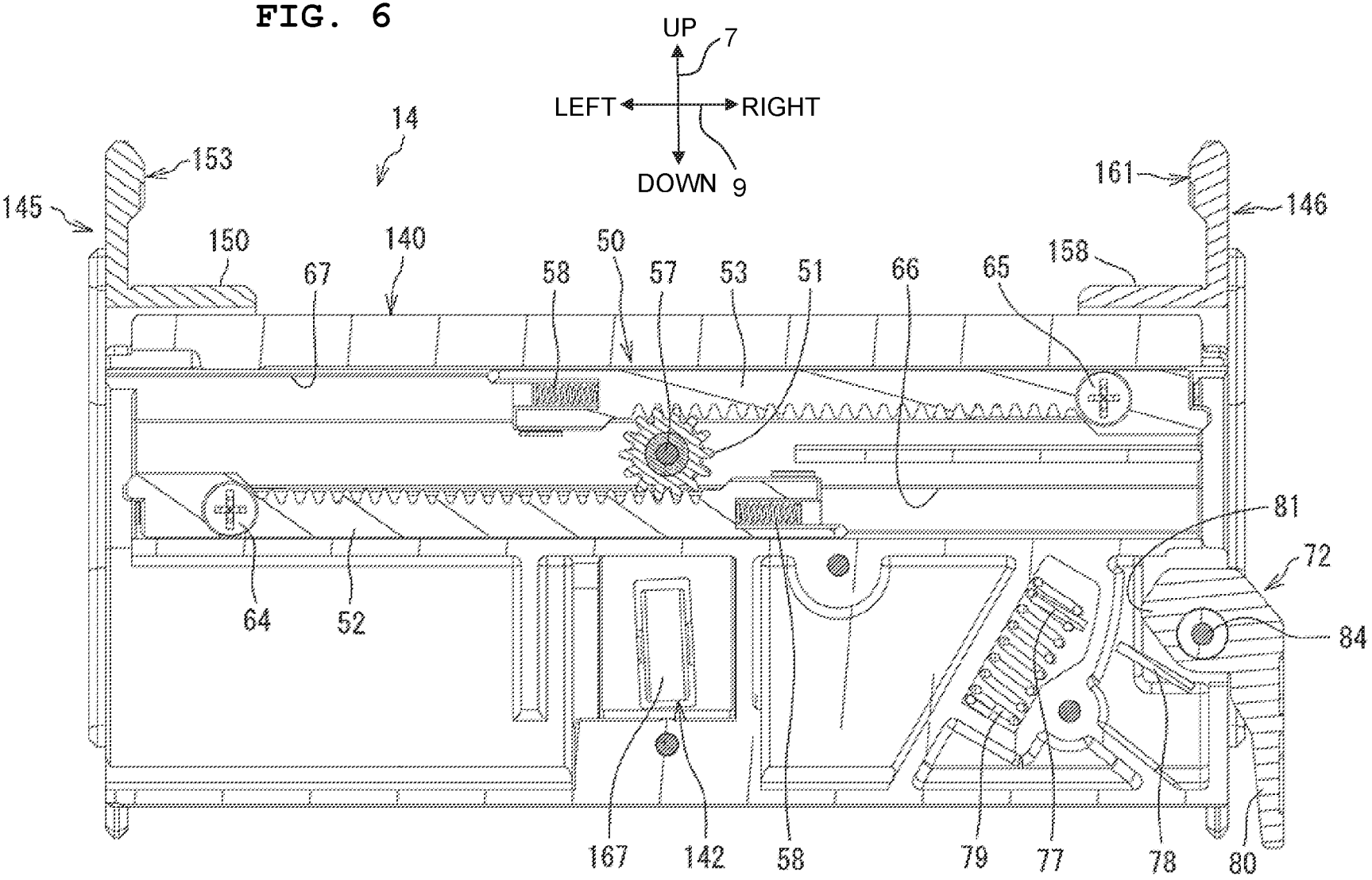
FIG. 6 is a cross-sectional view of the interlock mechanism together with a tensioner, cut at a position of a first left rack gear and a first right rack gear in a front-rear direction.

As depicted in FIGS. 5 and 6, the interlock mechanism 50 is located more forward in the front-rear direction 8 than the arc member 140. The interlock mechanism 50 interlocks movement of the first side guide 145 and movement of the sub guide 146 along the left-right direction 9. The interlock mechanism 50 is a rack and pinion mechanism and has a pinion gear 51 (see FIG. 6), a first left rack gear 52, a first right rack gear 53, a second left rack gear 54, a second right rack gear 55, and a flange 56.

As depicted in FIGS. 5 and 6, the pinion gear 51 is rotatably fitted to a spindle 57 along the front-rear direction 8 at a center in the left-right direction 9 of the arc member 140. A flange 56 is connected to the support shaft 57 in front of the pinion gear 51 and supports the pinion gear 51 from the front. The flange 56 is fitted to a front end of the support shaft 57. The flange 56 has an outer circumferential surface 68 (see FIG. 11) with an axis extending in the front-rear direction 8 as a center.

The first left rack gear (an example of the rack gear) 52 has a row of upward-facing teeth along the left-right direction 9. A left end of the first left rack gear 52 is secured to the first side guide 145 by a screw 64. The first left rack gear 52 is meshed with the pinion gear 51. The first left rack gear 52 is fitted to a guide rail 66 extending along the left-right direction 9. The first left rack gear 52 is movable in the left-right direction 9 along the guide rail 66. When the first left rack gear 52 moves in the left-right direction 9, the pinion gear 51 rotates around the spindle 57.

The first right rack gear (an example of the rack gear) 53 has a row of downward-facing teeth along the left-right direction 9. A right end of the first right rack gear 53 is secured to the sub guide 146 by a screw 65. The first right rack gear 53 is meshed with the pinion gear 51. Similar to the first left rack gear 52 and the guide rail 66, the first right rack gear 53 is fitted to a guide rail 67 extending in the left-right direction 9. The first right rack gear 53 is movable in the left-right direction 9 along the guide rail 67. When the first right rack gear 53 moves in the left-right direction 9, the pinion gear 51 rotates around the spindle 57.

Figure 7:
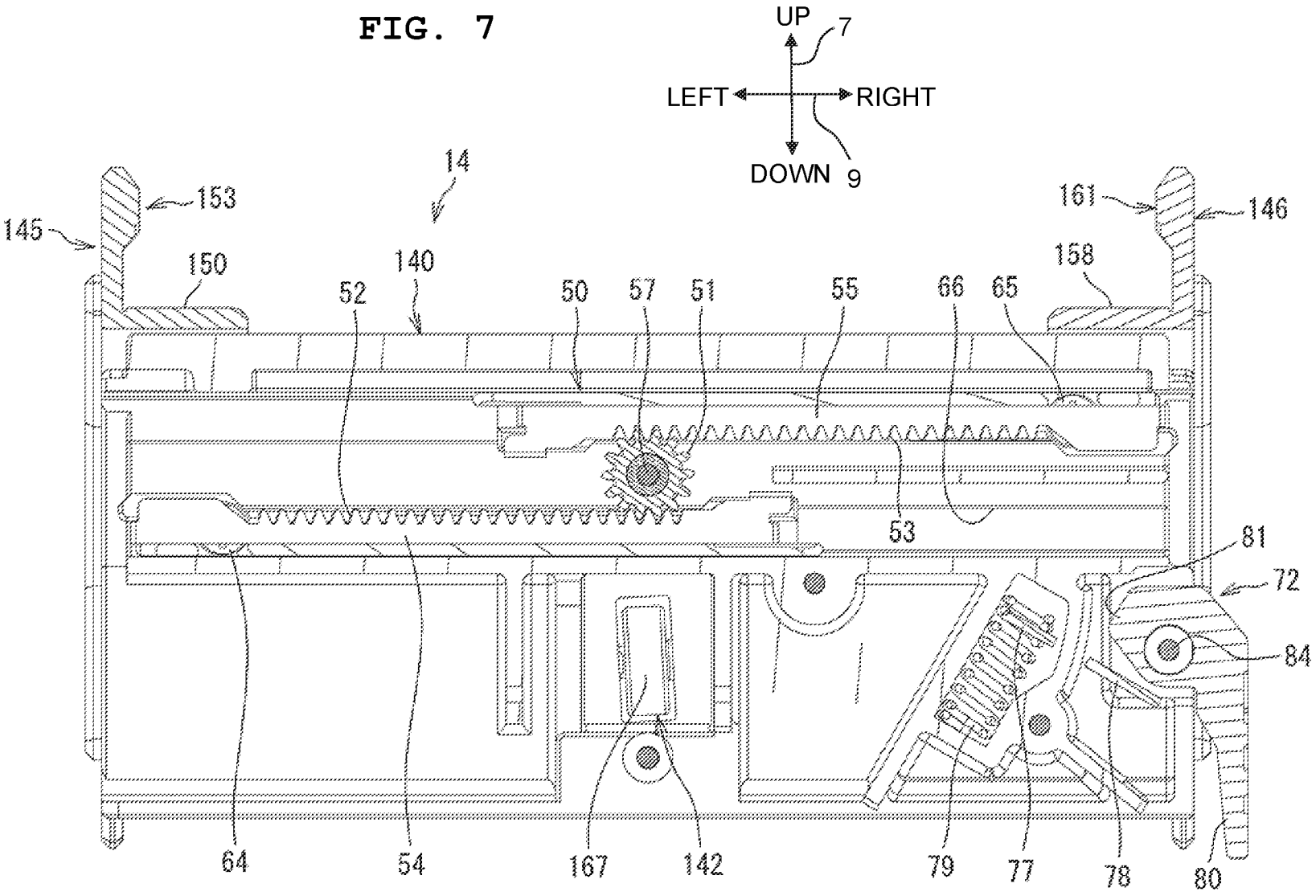
FIG. 7 is a cross-sectional view of the interlock mechanism together with the tensioner, cut at a position between a second left rack gear and a flange in the front-rear direction.

As depicted in FIG. 7, the second left rack gear 54 is engaged to the first left rack gear 52 in front of the first left rack gear 52. The second left rack gear 54 is located between the first left rack gear 52 and the flange 56 in the front-rear direction 8. The second left rack gear 54 is supported by the flange 56 from the front. A dimension of the second left rack gear 54 along the front-rear direction 8 is smaller than a dimension of the first left rack gear 52 along the front-rear direction 8. The second left rack gear 54 has a row of upward facing teeth along the left-right direction 9. The first left rack gear 52 and the second left rack gear 54 are the same in the size of each of the teeth (i.e., the module) and the number of the teeth.

The left and right ends of the second left rack gear 54 are engaged to the first left rack gear 52 and supported by the first left rack gear 52 to be movable in the left-right direction 9. As depicted in FIGS. 6 and 7, at the right end of the second left rack gear 54, a coil spring 58 is compressed between the second left rack gear 54 and the first left rack gear 52. The coil spring 58 urges the second left rack gear 54 to the right (inward) with respect to the first left rack gear 52. As depicted in FIG. 7, the urging force of the coil spring 58 causes the teeth of the first left rack gear 52 and the teeth of the second left rack gear 54 to be slightly out of phase in the left-right direction 9. A position of the second left rack gear 54 where the teeth of the second left rack gear 54 are out of phase with the teeth of the first left rack gear 52 is an example of the second position. A position of the second left rack gear 54 where the teeth of the second left rack gear 54 are in phase with the teeth of the first left rack gear 52 is an example of the first position (not depicted).

The second right rack gear 55 is engaged to the first right rack gear 53 in front of the first right rack gear 53. The second right rack gear 55 is located between the first right rack gear 53 and the flange 56 in the front-rear direction 8 and is supported by the flange 56 from the front. A dimension of the second right rack gear 55 along the front-rear direction 8 is smaller than a dimension of the first right rack gear 53 along the front-rear direction 8. The second right rack gear 55 has a row of teeth facing downward along the left-right direction 9. The first right rack gear 53 and the second right rack gear 55 are the same in the size of each of the teeth (i.e., the module) and the number of the teeth.

The left and right ends of the second right rack gear 55 are engaged to the first right rack gear 53 and supported by the first right rack gear 53 to be movable in the left-right direction 9. At the left end of the second right rack gear 55, a coil spring 58 is compressed between the second right rack gear 55 and the first right rack gear 53. The coil spring 58 urges the second right rack gear 55 to the left (inward) with respect to the first right rack gear 53. As depicted in FIG. 7, the urging force of the coil spring 58 causes the teeth of the first right rack gear 53 and the teeth of the second right rack gear 55 to be slightly out of phase in the left-right direction 9. A position of the second right rack gear 55 where the teeth of the second right rack gear 55 are out of phase with the teeth of the first right rack gear 53 is an example of the second position. A position of the second right rack gear 55 where the teeth of the second right rack gear 55 are in phase with the teeth of the first right rack gear 53 is an example of the first position (not depicted).

Figure 8:
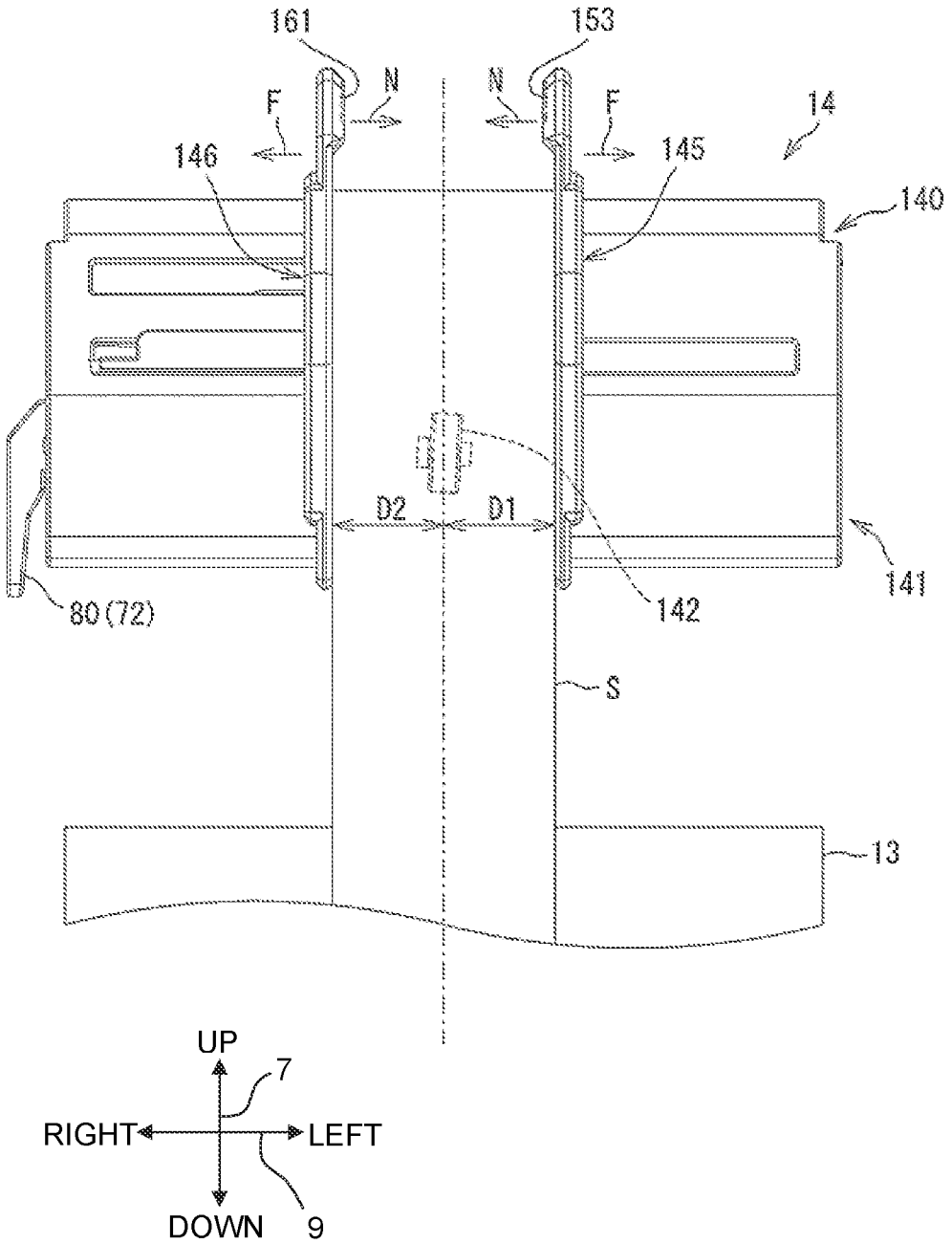
FIG. 8 is a rear view of the first side guide and a sub guide, together with a sheet holder.

As depicted in FIG. 8, when one of the first side guide 145 and the sub guide 146 is moved to one orientation along the left-right direction 9, the other of the first side guide 145 and the sub guide 146 is also moved to an opposite orientation along the left-right direction 9 by the interlock mechanism 50. Movements of the first side guide 145 and the sub guide 146 in approaching (inward) orientations N are interlocked by the interlock mechanism 50. Movements of the first side guide 145 and the sub guide 146 in separating (outward) orientations F are also interlocked by the interlock mechanism 50. When viewed from the rear, a distance D1 along the left-right direction 9 from the center of the seat holder 13 in the left-right direction 9 to the first guide surface 147 is the same as a distance D2 along the left-right direction 9 from the center of the seat holder 13 in the left-right direction 9 to the sub guide surface 155.

Figure 9:
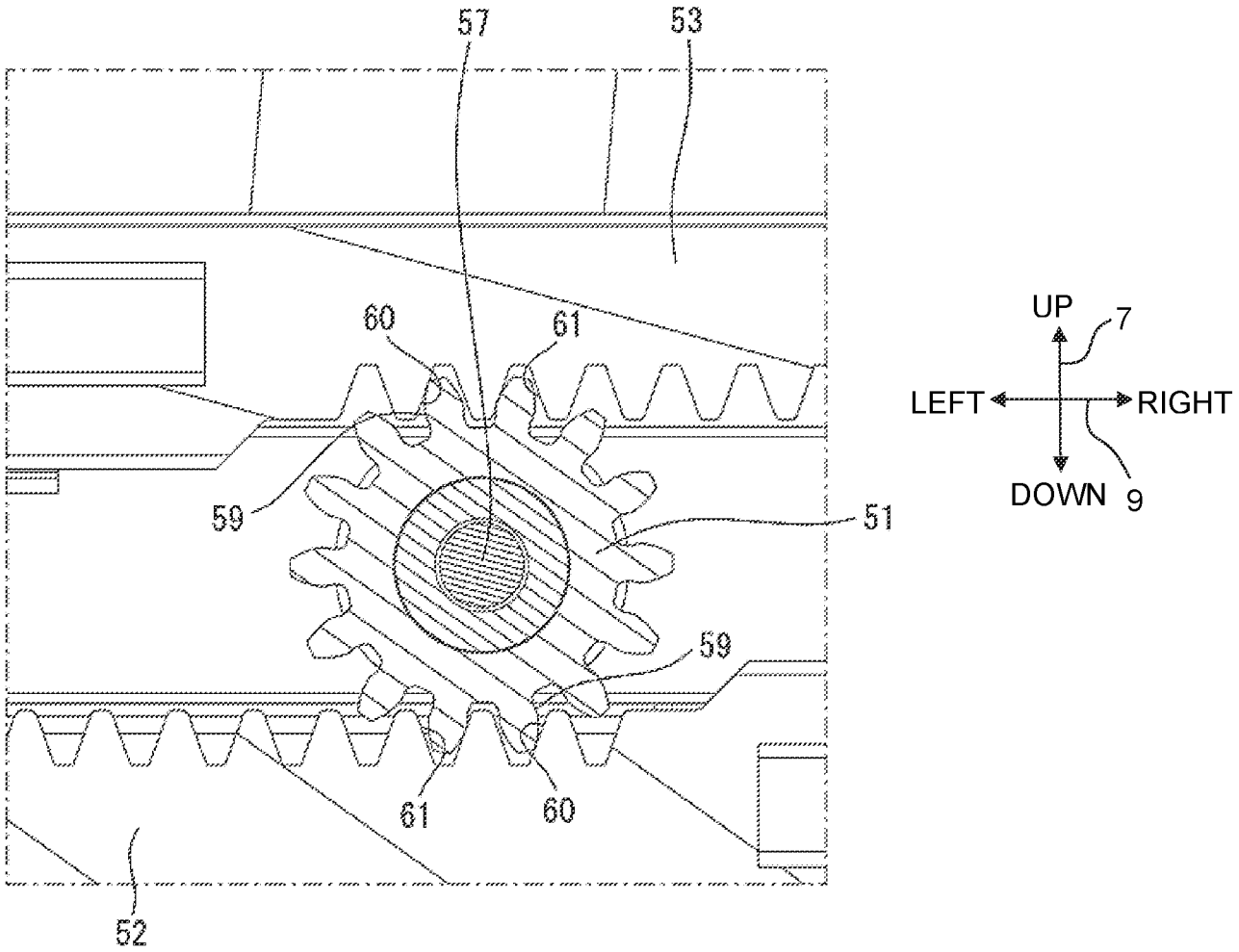
FIG. 9 is an enlarged view of an area around a pinion gear of FIG. 6.

As depicted in FIG. 9, when the first side guide 145 and the sub guide 146 are moved in the separating orientations (i.e., outward in the left-right direction 9), with respect to teeth of the first left rack gear 52 and teeth of the pinion gear 51 meshing with each other, outward teeth surfaces 60 of the first left rack gear 52 contact teeth surfaces 59 of the pinion gear 51, and inward teeth surfaces 61 of the first left rack gear 52 do not contact the teeth surfaces 59 of the pinion gear 51. The gaps between the teeth surfaces 59 and the teeth surfaces 61 are so-called backlash. When the pinion gear 51 is not rotated, the first left rack gear 52 can move to the right (inward) by the backlash. In other words, the first left rack gear 52 rattles. Similarly, in the first right rack gear 53, outward teeth surfaces 60 of the first right rack gear 53 contact the teeth surfaces 59 of the pinion gear 51, and inward teeth surfaces 61 of the first right rack gear 53 do not contact the teeth surfaces 59 of the pinion gear 51.

Figure 10:
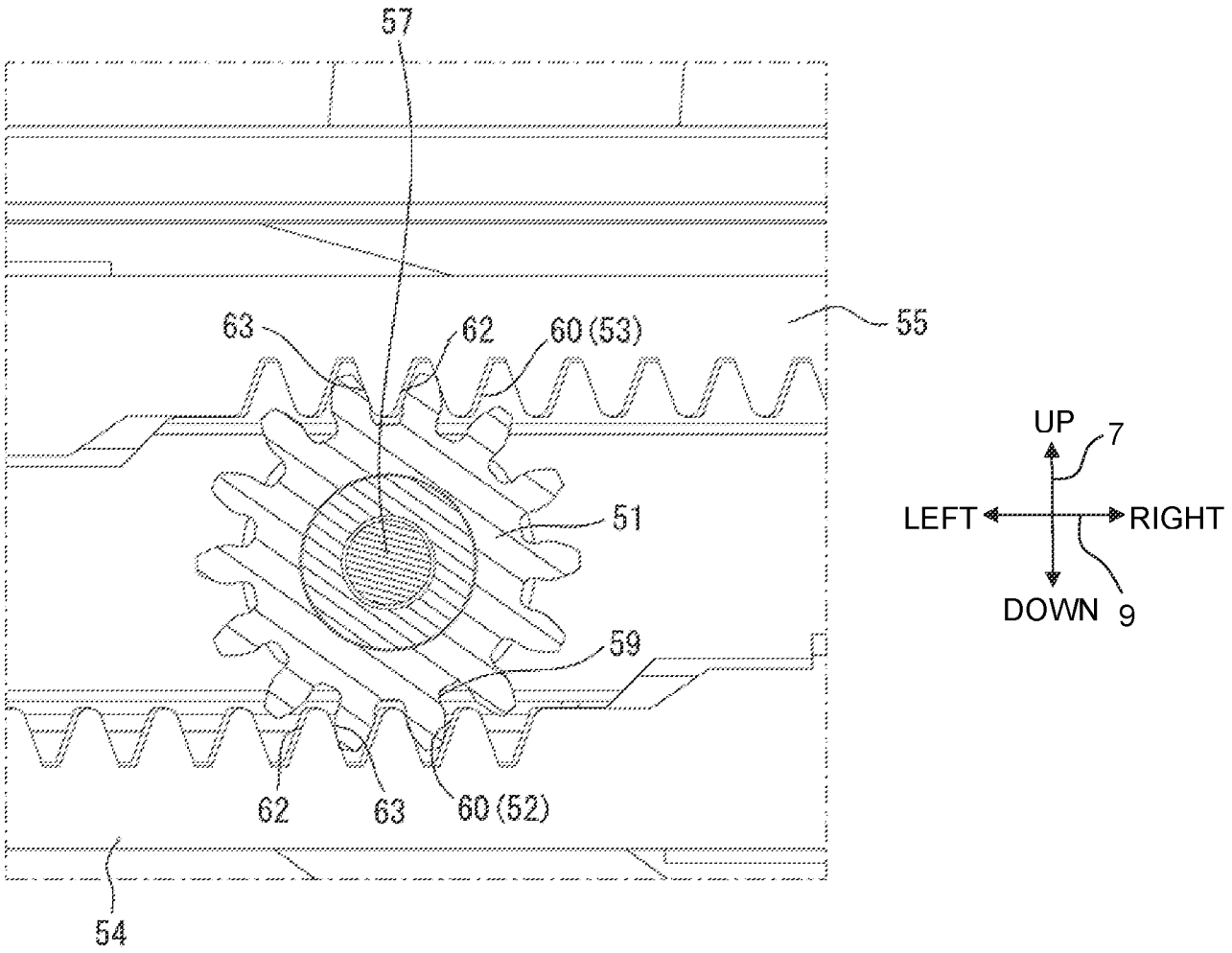
FIG. 10 is an enlarged view of an area around the pinion gear of FIG. 7.

As depicted in FIG. 10, with respect to the teeth of the first left rack gear 52 and the teeth of the second left rack gear 54 which are in phase in the first position, leftward (outward) teeth surfaces 60 of the first left rack gear 52 are shifted to the left (outward) of leftward (outward) teeth surfaces 62 of the second left rack gear 54 in the second position. Similarly, with respect to the teeth of the first right rack gear 53 and the teeth of the second right rack gear 55 which are in phase in the first position, rightward (outward) teeth surfaces 60 of the first right rack gear 53 are shifted to the right (outward) of rightward (outward) teeth surfaces 62 of the second right rack gear 55 in the second position.

With respect to the teeth of the pinion gear 51 and teeth of the second left rack gear 54 which mesh with each other, outward teeth surfaces 62 of the second left rack gear 54 do not contact the teeth surfaces 59 of the pinion gear 51, and inward teeth surfaces 63 of the second left rack gear 54 contact the teeth surfaces 59 of the pinion gear 51. Similarly, in the second right rack gear 55, outward teeth surfaces 62 of the second right rack gear 55 do not contact the teeth surfaces 59 of the pinion gear 51, and inward teeth surfaces 63 of the second right rack gear 55 contact the teeth surfaces 59 of the pinion gear 55.

When the first side guide 145 and the sub guide 146 are moved from the state depicted in FIG. 7 to approach each other (i.e., inward in the left-right direction 9), the coil springs 58 are compressed to move the second left rack gear 54 and the second right rack gear 55 in the second positions to the first positions respectively. As a result, the teeth of the first left rack gear 52 are in phase with the teeth of the second left rack gear 54, and the teeth of the first right rack gear 53 are in phase with the teeth of the second right rack gear 55. The inward teeth surfaces 61 of the first left rack gear 52 and the inward teeth surface 63 of the second left rack gear 54 simultaneously contact the teeth surfaces 59 of the pinion gear 51. Similarly, the inward teeth surfaces 61 of the first right rack gear 53 and the inward teeth surfaces 63 of the second right rack gear 55 simultaneously contact the teeth surfaces 59 of the pinion gear 51. This causes the first side guide 145 and the sub guide 146 to move inward in the left-right direction 9 in conjunction with each other.

When the first side guide 145 and the sub guide 146 are moved to separate from each other (i.e., outwardly in the left-right direction 9), the coil spring 58 is not compressed, and the second left rack gear 54 and the second right rack gear 55 in the second positions are moved while remaining in the second positions. As a result, the first side guide 145 and the sub guide 146 move outward in the left-right direction 9 in conjunction with each other, while the outward teeth surfaces 60 of the first left rack gear 52 and the outward teeth surfaces 60 of the first right rack gear 53 being in contact with the teeth surfaces 59 of the pinion gear 51.

[Lock Mechanism 70]

The lock mechanism 70 can lock or unlock the movement of the interlock mechanism 50. As depicted in FIG. 5, the lock mechanism 70 has a rotating member 71 and a lever 72. The user of the image recording apparatus 1 can move the rotating member 71 between a contact position and a separate position by rotating the lever 72. When the rotating member 71 is in the contact position, the movement of the interlock mechanism 50 is locked, and when the rotating member 71 is in the separate position, the movement of the interlock mechanism 50 is unlocked.

The rotating member 71 is a flat plate shape spreading in the up-down direction 7 and the left-right direction 9, and is located in front of the flange 56. The rotating member 71 is connected to the flat member 141 by a screw 73 at a central portion of the rotating member 71. The flat member 141 supports the rotating member 71 to be rotatable around the screw 73. The rotating member 71 has a contact piece 76, a first bending piece 77, and a second bending piece 78.

The contact piece 76 is a piece located to the left of the center of the rotating member 71 in the left-right direction 9, and extending rearward (see FIG. 5). The contact piece 76 contacts the first left rack gear 52 when the rotating member 71 is rotated counterclockwise in FIG. 5, and the first left rack gear 52 is sandwiched between the arc member 140 and the contact piece 76.

The first bending piece 77 is a piece located to the right of the center of the rotating member 71 in the left-right direction 9, and extending rearward. The first bending piece 77 is urged counterclockwise in FIG. 5 by a spring member 79. The second bending piece 78 is a piece located to the right of the first bending piece 77, and extending rearward at the right end of the rotating member 71.

The lever 72 is located above the second bending piece 78 and is supported by a support shaft 84 to be rotatable around the support shaft 84 (see FIG. 6). The support shaft 84 extends in the front-rear direction 8. The lever 72 is located at the right end of the flat member 141 and is movable between a lock position (see FIG. 5) to lock the movement of the first left rack gear 52 and an unlock position (see FIG. 11) to unlock the first left rack gear 52. The lever 72 has a handle 80 for rotating the lever 72 and a convex portion 81 that contacts the second bending piece 78 to rotate the rotating member 71.

Figure 11:
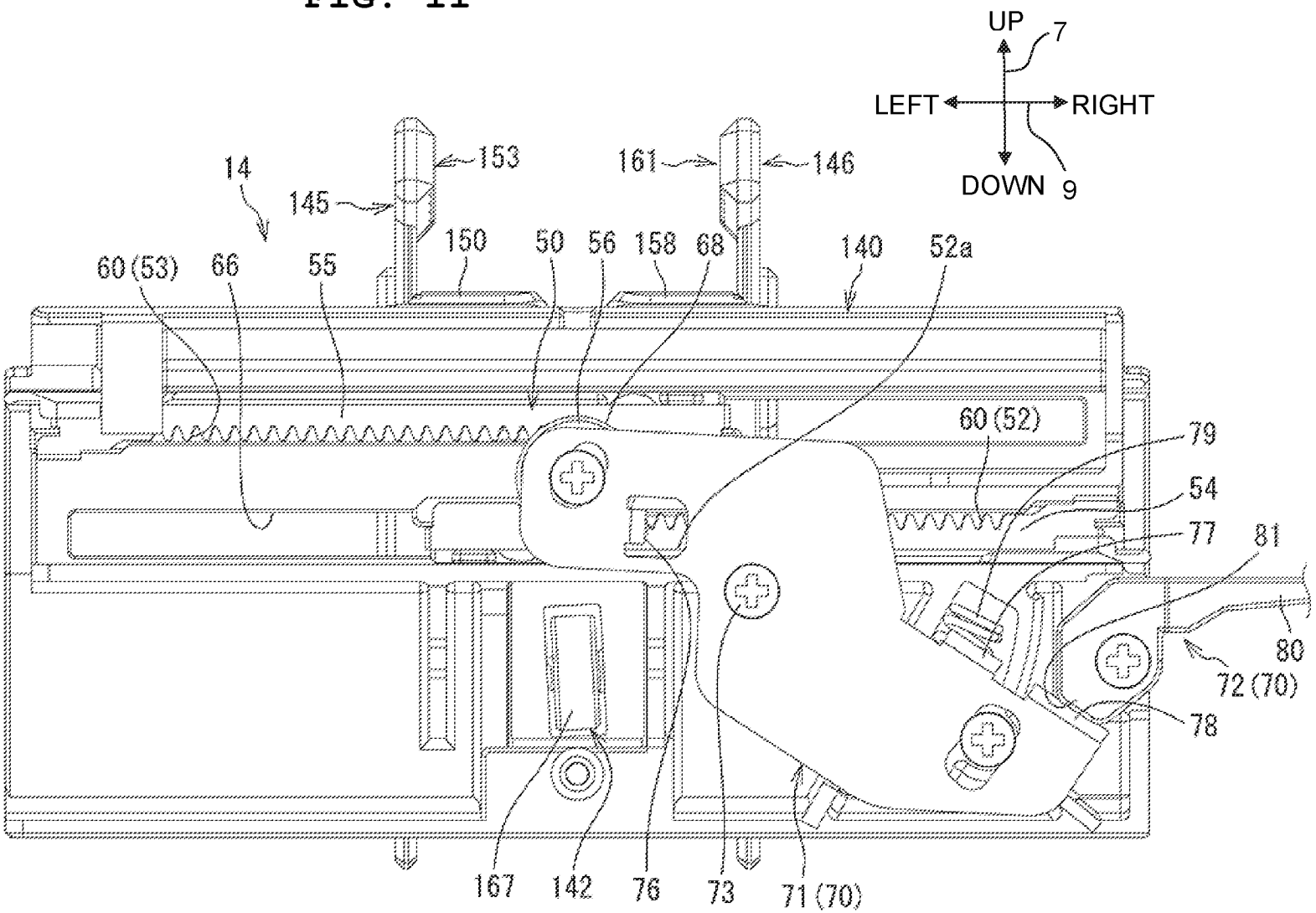
FIG. 11 is a diagram depicting a rotating member in a separate position.

When the lever 72 is in the lock position, the handle 80 extends downward in the up-down direction 7 from the center of rotation, and the convex portion 81 protrudes to the left with respect to the center in the left-right direction 9 of rotation of the lever 72. At this time, the convex portion 81 is separated from the second bending piece 78. On the other hand, when the lever 72 is in the unlock position, the handle 80 extends from the center of rotation to the right in the left-right direction 9, and the convex portion 81 protrudes downward from the center of rotation in the up-down direction 7. As depicted in FIG. 11, when the lever 72 is operated to the unlock position, the convex portion 81 contacts the second bending piece 78. At this time, the rotating member 71 rotates clockwise in FIG. 5 against the urging force of the spring member 79, and the contact piece 76 is separated from the first left rack gear 52. When the contact piece 76 is separated from the first left rack gear 52, the interlock mechanism 50 is unlocked. When the lever 72 is operated to the lock position, the convex portion 81 is separated from the second bent piece 78. At this time, the rotating member 71 rotates counterclockwise in FIG. 5 by the urging force of the spring member 79, and the contact piece 76 contacts the first left rack gear 52. When the contact piece 76 contacts the first left rack gear 52, the movement of the first left rack gear 52 in the left-right direction 9 is prevented and the interlock mechanism 50 is locked.

When the movement of the interlock mechanism 50 is locked by the lock mechanism 70, the first side guide 145 does not move outward when subjected to outward external force. The first side guide 145 also does not move when subjected to inward external force. Specifically, when the first side guide 145 is locked by the lock mechanism 70, a lower end extending piece **52*a* is prevented from moving in the left-right direction 9 by the contact piece 76**.

Therefore, even if the first side guide 145 is pushed outward due to the sheet S being skewed, the first side guide 145 will not rattle. In addition, the first side guide 145 is accurately positioned outward in the left-right direction 9 to match the width of the sheet S.

When the sub guide 146 is subjected to an outward external force while the lower end extending piece **52*a* being prevented from moving in the left-right direction 9 by the contact piece 76, the second right rack gear 55 moves from the second position to the first position with respect to the first right rack gear 53 against the urging force of the coil spring 58. When the sub guide 146 is subjected to an inward external force while the lower end extending piece 52***a* being prevented from moving in the left-right direction 9 by the contact piece 76, the second right rack gear 55 moves from the second position to the first position with respect to the first right rack gear 53 against the urging force of the coil spring 58. In other words, the second side guide 146 is configured to move slightly in the left-right direction 9.

[First Roller 142]

Figure 12:
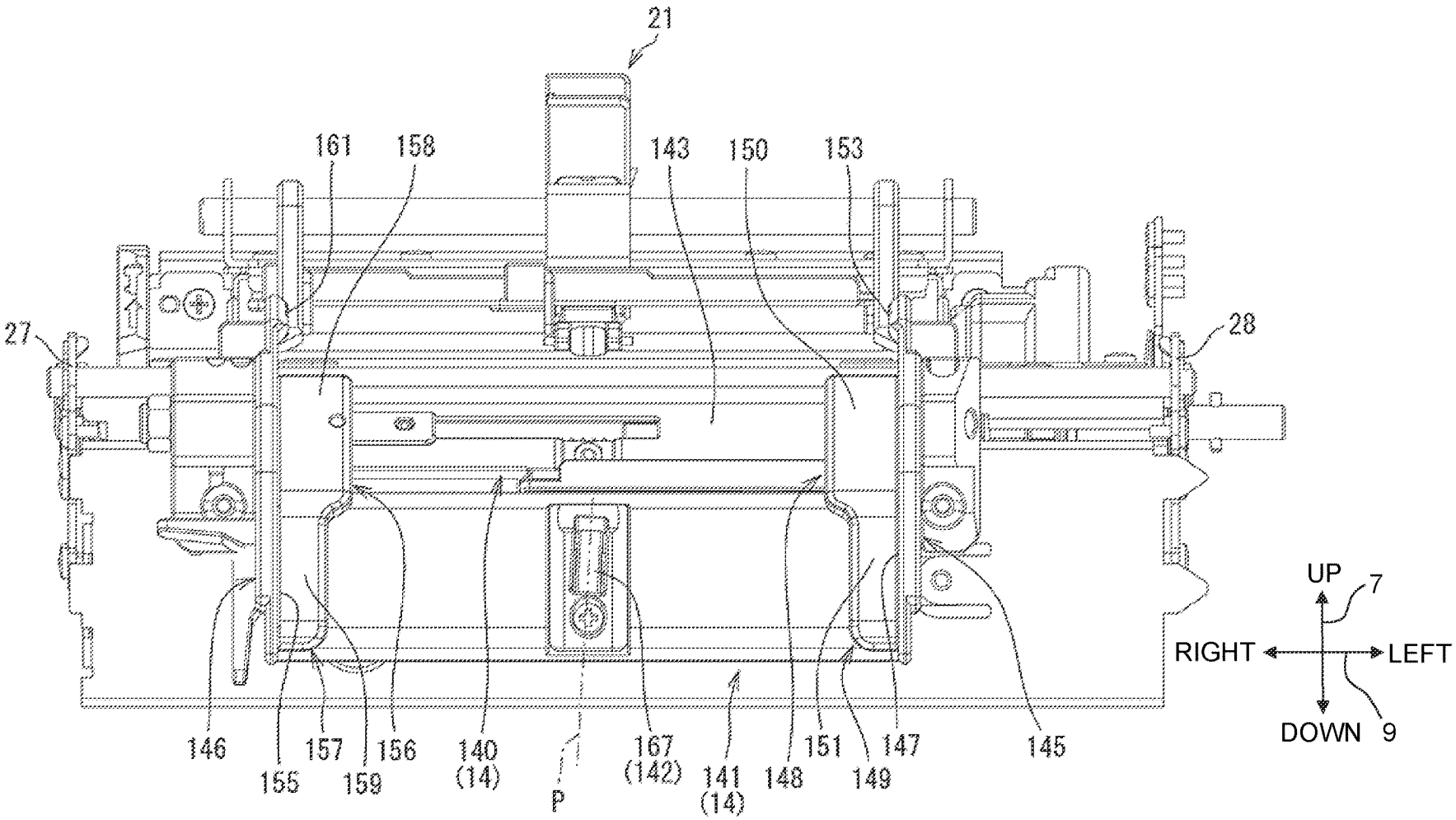
FIG. 12 is a rear view of a first roller.

The first roller 142 contacts and follows the sheet S being conveyed along the conveyance path 10. As depicted in FIGS. 3 and 12, the first roller 142 is located at the center of the flat member 141 in the left-right direction 9. The first roller 142 rotates around an axis inclined in the up-down direction 7 relative to the left-right direction 9. A virtual plane P orthogonal to the axis of the first roller 142 intersects with the conveyance orientation G such that the plane P approaches the first guide surface 147 toward downstream in the conveyance orientation G. The sheet S being conveyed through the flat member 141 is guided by the first roller 142 to approach the first guide surface 147. An area occupied in the left-right direction 9 by the first roller 142 includes the center of the sheet holder 13 in the left-right direction 9 (see FIG. 8). More specifically, the central position between the right and left ends of the first roller 142 coincides with the central position of the flat member 141 in the left-right direction 9.

As depicted in FIGS. 2 and 3, the rear side guides 15 are similar in configuration to the first side guide 145 and sub guide 146 attached to the tensioner 14, except for a position in the housing 11, so a detailed description is omitted.

The conveyance roller pair 16 is located in front of the rear side guides 15. The conveyance roller pair 16 has a conveyance roller 45 (an example of the conveying unit) and a pinch roller 46. The conveyance roller 45 and the pinch roller 46 rotate respectively around axes along the left-right direction 9. The conveyance roller 45 and the pinch roller 46 have roller surfaces in contact with each other in the up-down direction 7. The sheet S is nipped between the roller surfaces of the conveyance roller 45 and the pinch roller 46. The conveyance roller 45 is powered by a conveyance motor (see FIG. 24) 120 to rotate. The conveyance motor 120 can rotate forward or reverse upon receiving a signal from the controller 130. Pinch roller 46 rotates in accordance with the conveyance roller 45. As a result, the conveyance roller pair 16 conveys the sheet S ejected from the rolled body in a forward direction (an example of conveyance direction).

The front side guide 21 are located in front of the conveyance roller pair 16. The front side guide 21 has a pair of side guides 32 and a lower guide 17. An upper surface of the lower guide 17 is flat surface along the front-rear direction 8 and the left-right direction 9 and supports the sheet S. Each of the pair of side guides 32 spreads in the up-down direction 7 and the front-rear direction 8. The pair of side guides 32 face each other in the left-right direction 9. Detailed configurations of the front side guide 21 are described below.

The belt conveyance mechanism 19 is located in front of the lower guide 17. The belt conveyance mechanism 19 consists of a rear pulley 191A, a front pulley 191B, and an endless belt 192 rolled around the rear pulley 191A and the front pulley 191B. The rear pulley 191A and the front pulley 191B are separated in the front-rear direction 8 and have axes in the left-right direction 9. The front pulley 191B is powered by an undepicted motor driven based on a command from the controller 130, causing the front pulley 191B to rotate clockwise in FIG. 2, thereby rotating the endless belt 192. The sheet S supported by the endless belt 192 is conveyed forward by the rotation of the endless belt 192.

The recording head 20 is located above the belt conveyance mechanism 19. In a nozzle surface 201, which is a lower surface of the recording head 20, a plurality of nozzles 202 are arranged in front, rear, left, and right. The recording head 20 ejects ink supplied from the tank 12 through the nozzles 202. The ink ejected from the nozzles 202 adheres to the sheet S, thereby recording an image on the sheet S.

The discharge roller pair 23 is located in front of the belt conveyance mechanism 19. The discharge roller pair 23 has a drive roller 47 and a pinch roller 48. The drive roller 47 and pinch roller 48 rotate respectively around axes along the left-right direction 9. The drive roller 47 and the pinch roller 48 have roller surfaces in contact with each other in the up-down direction 7. The sheet S is nipped between the roller surfaces of the drive roller 47 and the pinch roller 48. The drive roller 47 is powered by the conveyance motor 120 and rotates. The pinch roller 48 rotates in accordance with the conveyance roller 45. As a result, the discharge roller pair 23 conveys the image-recorded sheet S forward.

The cutter 26 is located in front of the discharge roller pair 23. The cutter 26 cuts the sheet S being conveyed through the conveying path 10 under a control of the controller 130. The cutter 26 cuts the sheet S along the left-right direction 9. The cut sheet S is discharged from the discharge port 111 to the outside of the housing 11.

[Front Side Guide 21]

The detailed configurations of the front side guide 21 are described below.

As depicted in FIGS. 13 through 19, the front side guide 21 has a guide part 30, a frame 31, a pair of side guides 32, a shaft 33, a lever 34, a coil spring 35 (an example of the elastic member), and a roller 36.

The guide part 30 has a box shape which is long in the left-right direction 9. The guide part 30 accommodates an interlock mechanism 250 (see FIG. 20) in an interior space thereof. The left and right ends of the guide part 30 are connected to the frames 31 located apart in the left-right direction 9. The frames 31 are supported by undepicted side frames located apart in the left-right direction 9 in the interior space of the housing 11. The side frames support, for example, the tensioner 14, the conveyance roller pair 16, the belt conveyance mechanism 19, and the discharge roller pair 23. The guide part 30 and the frames 31 are an example of the frame.

At both ends in the front-rear direction 8 of an upper surface 30A of the guide part 30, guide surfaces 270 extending in the left-right direction 9 are located respectively. The guide surfaces 270 are surfaces on which the pair of side guides 32 slide.

Figure 13:
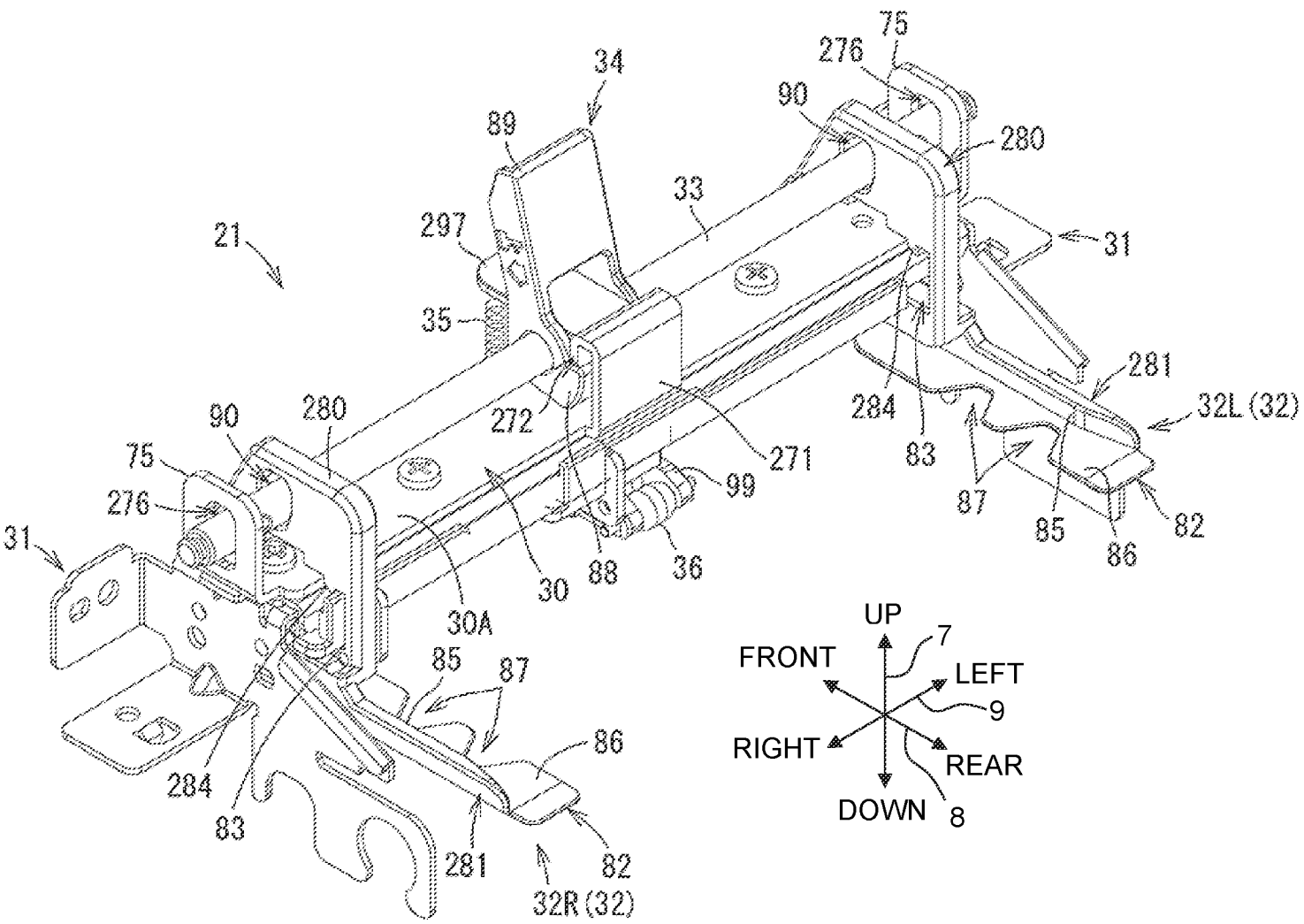
FIG. 13 is a perspective view of a front side guide viewed obliquely from behind.
Figure 14:
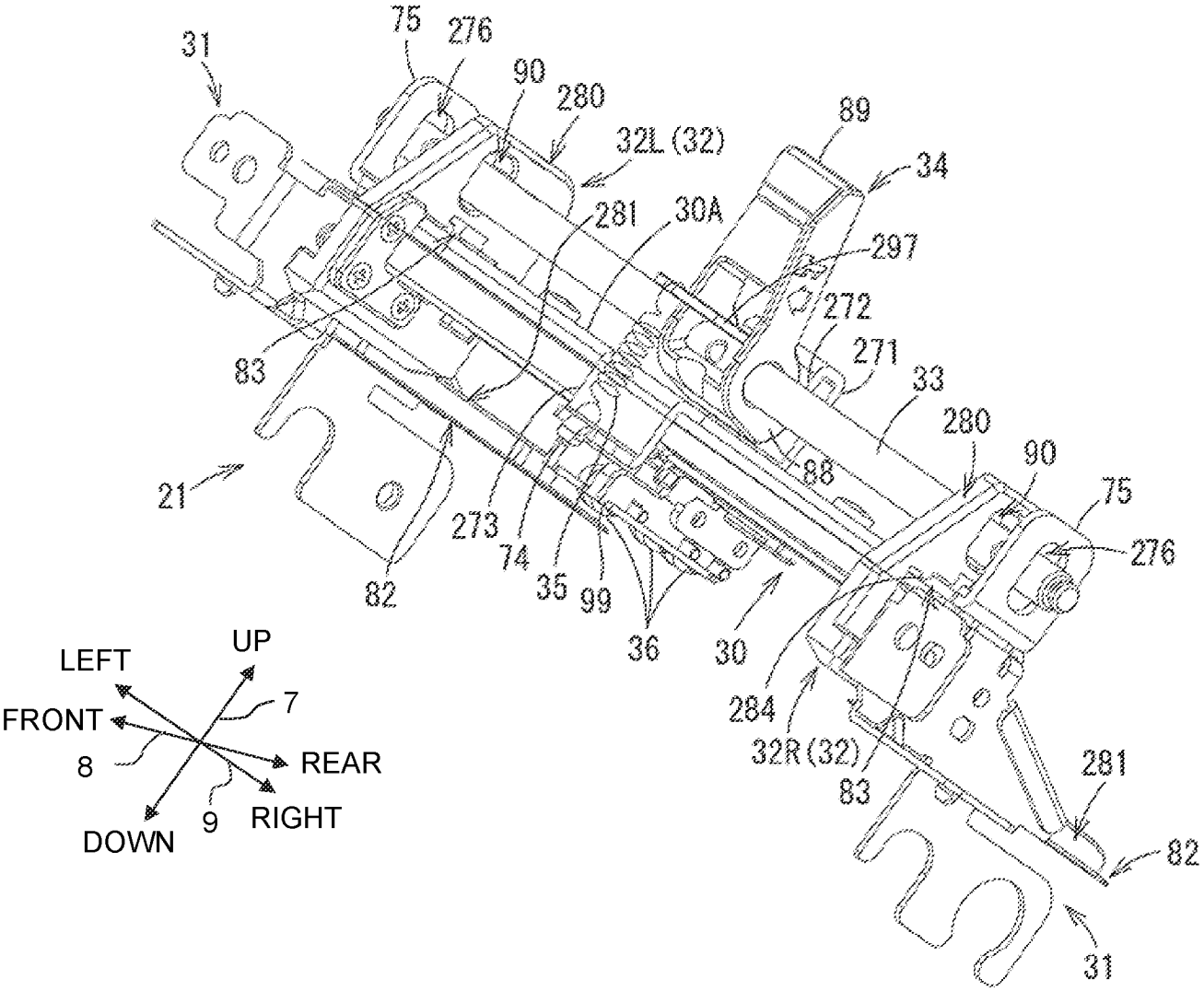
FIG. 14 is a perspective view of the front side guide viewed obliquely from front.
Figure 17:
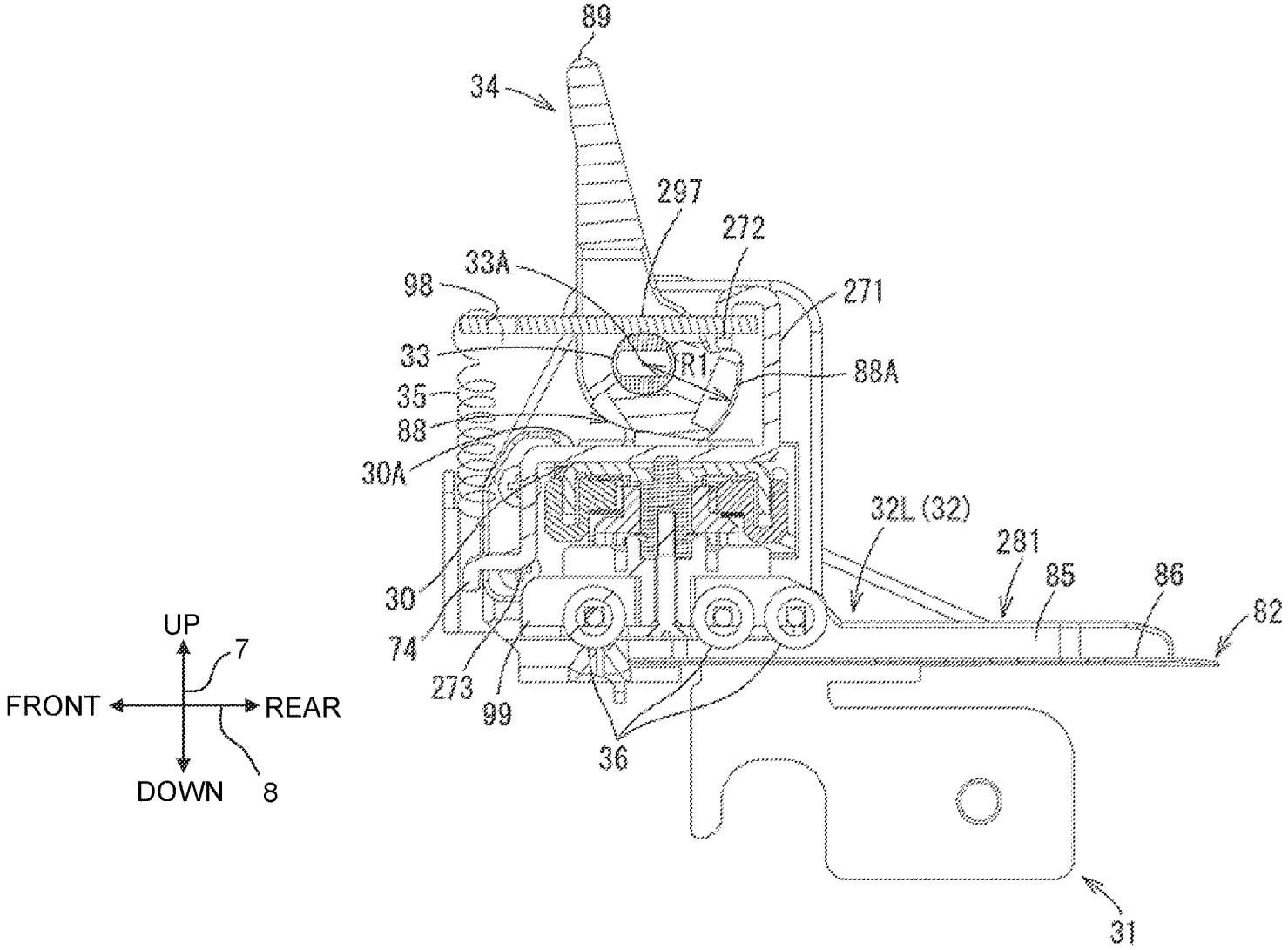
FIG. 17 is a cross-sectional view along a line XVII-XVII in FIG. 15 when the lever is in the first rotational position.

As depicted in FIGS. 13, 14, and 17, an engaging piece 271 extends upward from near the center in the left-right direction 9 at the rear end of the upper surface 30A of the guide part 30. The engaging piece 271 is curved so as to fold upwardly and then downwardly in a forward-facing U-shape. A through hole 272 is formed at a tip of the engaging piece 271 extending downward. The through hole 272 is formed to penetrate the engaging piece 271 in the front-rear direction 8.

As depicted in FIGS. 14 and 17, an extending piece 273 extends downward from near the center in the left-right direction 9 at the front end of the upper surface 30A of the guide part 30. The extending piece 273 extends downward and then is folded forward in a L-shape. A hook 74 is formed at the tip of the extending piece 273. The hook 74 engages one end of the coil spring 35.

The frames 31 are located apart in the left-right direction 9. The frames 31 are generally symmetrical in shapes with respect to the center of the left-right direction 9. The frames 31 have upwardly extending support parts 75 respectively. Each of the support parts 75 is formed by a sheet metal configuring one of the frames 31 being bent upward. The support parts 75 are located on both sides of the conveyance path 10. The support parts 75 have long holes 276 (an example of the first long hole) which penetrate the support parts 75 in the left-right direction 9, respectively. Each of the long holes 276 is longer in the up-down direction 7 than in the front-rear direction 8. A shaft 33 is inserted into the long holes 276. The shaft 33 is movable in the up-down direction 7 while being inserted into the long holes 276.

The pair of side guides 32 are located between the support parts 75 of the frames 31 in the left-right direction 9. The pair of side guides 32 comprises a right side guide 32R located on the right side in the left-right direction 9 and a left side guide 32L located on the left side in the left-right direction 9. The shapes of the right side guide 32R and the left side guide 32L are generally symmetrical with respect to the center of the left-right direction 9. In the following, each of the right side guide 32R and the left side guide 32L will be referred to as the side guide 32 and their detailed configurations will be described.

The side guide 32 has a slide part 280, a guide part 281, and a support part 82. The slide part 280 is a flat plate shape spreading in the up-down direction 7 and the front-rear direction 8. The slide part 280 has a through hole 83 penetrating through the slide part 280 in the left-right direction 9. The through hole 83 is long in the front-rear direction 8, and the guide part 30 is inserted into the through hole 83. On an upper surface demarcating the through hole 83, a pair of contact surfaces 284 are located apart in the front-rear direction 8. The location of the pair of contact surfaces 284 corresponds to the upper surface 30A of the guide part 30. When the contact surfaces 284 contact the upper surface 30A of the guide part 30, the guide part 281 is positioned with respect to a downward orientation in the up-down direction 7. When the side guide 32 is slid in the left-right direction 9, the contact surface 284 slides on the upper surface 30A.

In the slide part 280, above the through hole 83, a long hole 90 (an example of the second long hole) is formed through the slide part 280 in the left-right direction 9. The long hole 90 is longer in the up-down direction 7 than in the front-rear direction 8. The shaft 33 is inserted into the long hole 90. The shaft 33 is movable in the up-down direction 7 while being inserted into the long hole 276.

Figure 16:
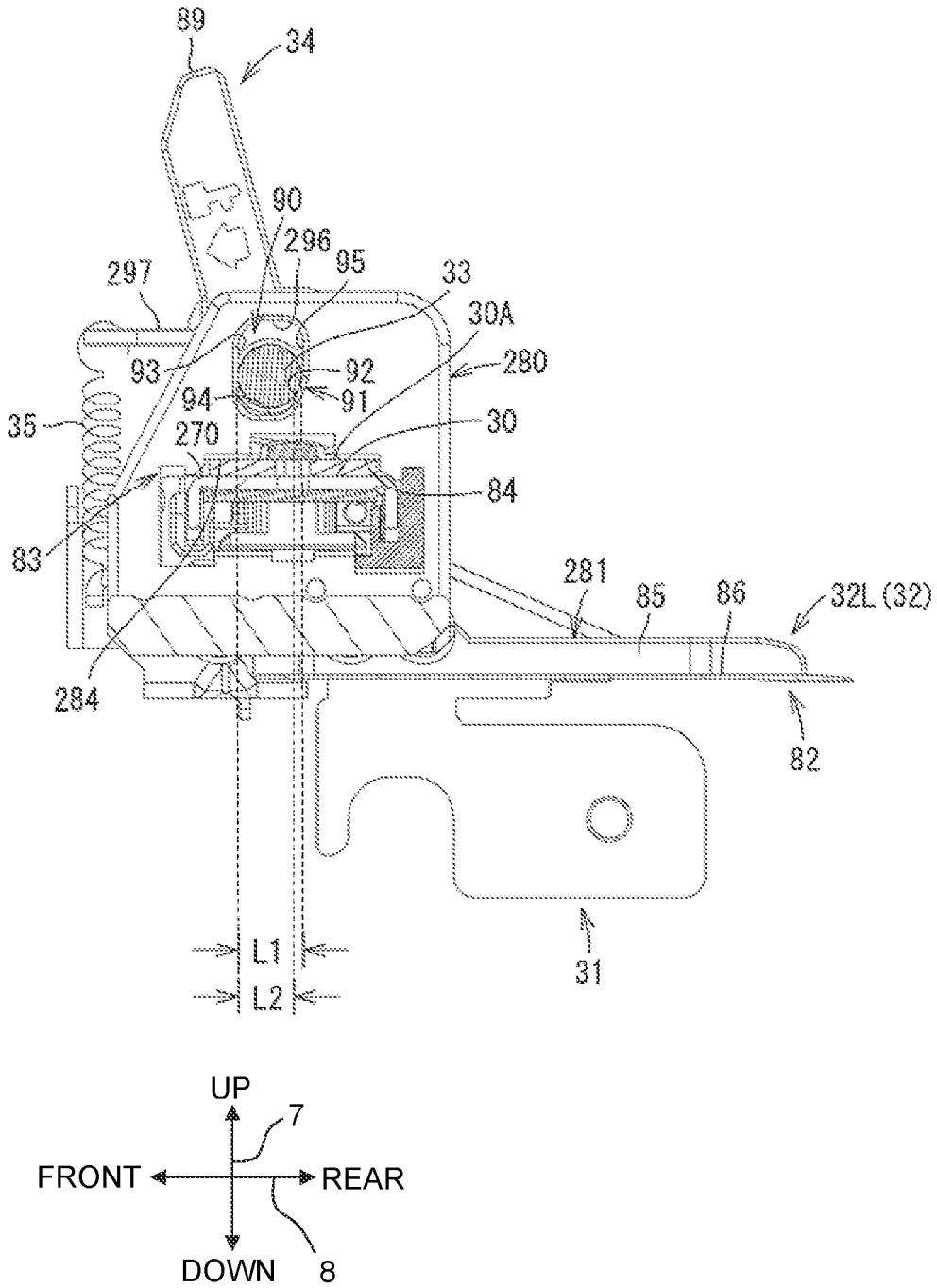
FIG. 16 is a cross-sectional view along a line XVI-XVI in FIG. 15 when a lever is in a first rotational position.

As depicted in FIG. 16, a lower portion of the long hole 90 is a tapered portion 91. In the long hole 90 of the left side guide 32L, the tapered portion 91 is defined by a tapered surface 92 (an example of the second surface), a front surface 93 (an example of the first surface), and a lower surface 94. The tapered surface 92 is along the left-right direction 9 and is inclined forward as it goes downward. The front surface 93 is along the up-down direction 7 and the left-right direction 9. The lower surface 94 is along the front-rear direction 8 and the left-right direction 9. A virtual plane along the tapered surface 92 intersects with a virtual plane along the front surface 93.

A dimension L1 along the front-rear direction 8 between the tapered surface 92 and the front surface 93 at an upper end of the tapered surface 92 is larger than a dimension L2 along the front-rear direction 8 between the tapered surface 92 and the front surface 93 at a lower end of the tapered surface 92 (L1>L2). In other words, in the tapered portion 91, the dimension along the front-rear direction 8 is gradually decreasing as it goes downward. The dimension L1 is larger than an outer diameter of shaft 33. The dimension L2 is smaller than the outer diameter of shaft 33. Accordingly, as the shaft 33 is moved downward in the tapered portion 91, an outer circumference of the shaft 33 contacts the tapered surface 92 and the front surface 93.

An upper portion of the long hole 90 is defined by a rear surface 95, the front surface 93, and an upper surface 296. The rear surface 95 extends upward from the upper end of the tapered surface 92. The rear surface 95 is along the up-down direction 7 and the left-right direction 9. The upper surface 296 is along the front-rear direction 8 and the left-right direction 9. Dimensions of the rear surface 95 and the front surface 93 along the front-rear direction 8 are constant and equal to the dimension L1.

The guide part 281 extends downward from the slide part 280. In the guide part 281, a guide surface 85 is a surface facing inward in the left-right direction 9. The guide surface 85 of the right side guide 32R faces leftward. The guide surface 85 of the left side guide 32L faces rightward. The guide surface 85 is a flat surface spreading in the up-down direction 7 and the front-rear direction 8. The sheet S is positioned in the left-right direction 9 when both ends of the sheet S in the left-right direction 9 contact the guide surfaces 85, which are located apart in the left-right direction 9, respectively.

The support part 82 extends inward in the left-right direction 9 from a lower end of the guide part 281. The support part 82 of the right side guide 32R extends leftward from the lower end of the guide part 281. The support part 82 of the left side guide 32L extends rightward from the lower end of the guide part 281. An upper surface of the support part 82 is a support surface 86. The support surface 86 is a flat surface spreading along the front-rear direction 8 and the left-right direction 9. Vicinities of both ends of the sheet S in the left-right direction 9 are supported from below by the support surface 86.

Notches 87 are formed at two locations of the support part 82 in the front-rear direction 8. In the support portion 82 of the right side guide 32R, each of the notches 87 extends rightward from a left end of the support part 82. In the support part 82 of the left side guide 32L, each of the notches 87 extends leftward from a right end of the support part 82. The notches 87 cause an inner end in the left-right direction 9 of the support surface 86 to bulge outwardly.

As depicted in FIG. 2, optical sensors 24 and 25 are located below the front side guide 21, aligned in the front-rear direction 8. The optical sensor 24 has a light-emitting part that emits light upward and a light-receiving part that is located above the light-emitting part and receives light. The optical sensor 25 has a light-emitting part that emits light upward and a light-receiving part that receives reflected light proceeding downward. The optical sensor 24 outputs a signal for the controller to determine whether or not the sheet S is positioned in the conveyance path 10. The optical sensor 25 outputs a signal for the controller to determine whether or not there is a mark pre-marked on a lower surface (a side opposite to the side on which the image is recorded) of the sheet S.

The optical sensors 24 and 25 are located near both ends of the sheet S that is the smallest width of the sheet S to be conveyed along the conveyance path 10. Among the two notches 87 separated in the front-rear direction 8, a position of one notch 87 corresponds to a position of the optical sensor 24, and a position of the other notch 87 corresponds to a position of the optical sensor 25. When the side guide 32 is moved to the position corresponding to the sheet S of the smallest width, the pair of side guides 32 are at their closest proximity in the left-right direction 9. In that state, although the support part 82 is positioned above the optical sensors 24, 25, the notch 87 allows the light emitted from the optical sensor 24 to reach the sheet S without being blocked by the support part 82.

The shaft 33 is a cylindrical rod and extends along the left-right direction 9. The outer diameter of shaft 33 is constant in the left-right direction 9. A lever 34 is fixed to the center of the shaft 33 in the left-right direction 9. When the lever 34 is rotated, the shaft 33 is rotated.

The lever 34 has a cam portion 88 and an actuator portion 89. As depicted in FIG. 17, the cam portion 88 is fixed to shaft 33 and projects radially from shaft 33. An outer surface of the cam portion 88 in the radial direction is a cam surface 88A. The cam surface 88A is a circumferential surface with an axis 33A of the shaft 33 being the center. The cam face 88A has a constant distance R1 from the axis 33A. The outer circumferential surface in the cam portion 88 other than the cam surface 88A has a distance from the axis 33A that is less than the distance R1.

The actuator portion 89 is a tapered flat plate shape extending from the shaft 33 in an orientation different from that in which the cam portion 88 bulges (orientation toward the cam surface 88A) and extends generally upward from the shaft 33. A distance between an extended end of the actuator portion 89 and the axis 33A is greater than the distance R1.

An urging plate 297 is located above the shaft 33. A rear end of the urging plate 297 is inserted into the through hole 272 of the engaging piece 271. A front end of the urging plate 297 has a through hole 98 that penetrates through the urging plate 297 in the up-down direction 7. The through hole 98 engages the other end of the coil spring 35. A tensile force of the coil spring 35 urges the front end of the urging plate 297 downward with the rear end as the fulcrum.

Figure 18:
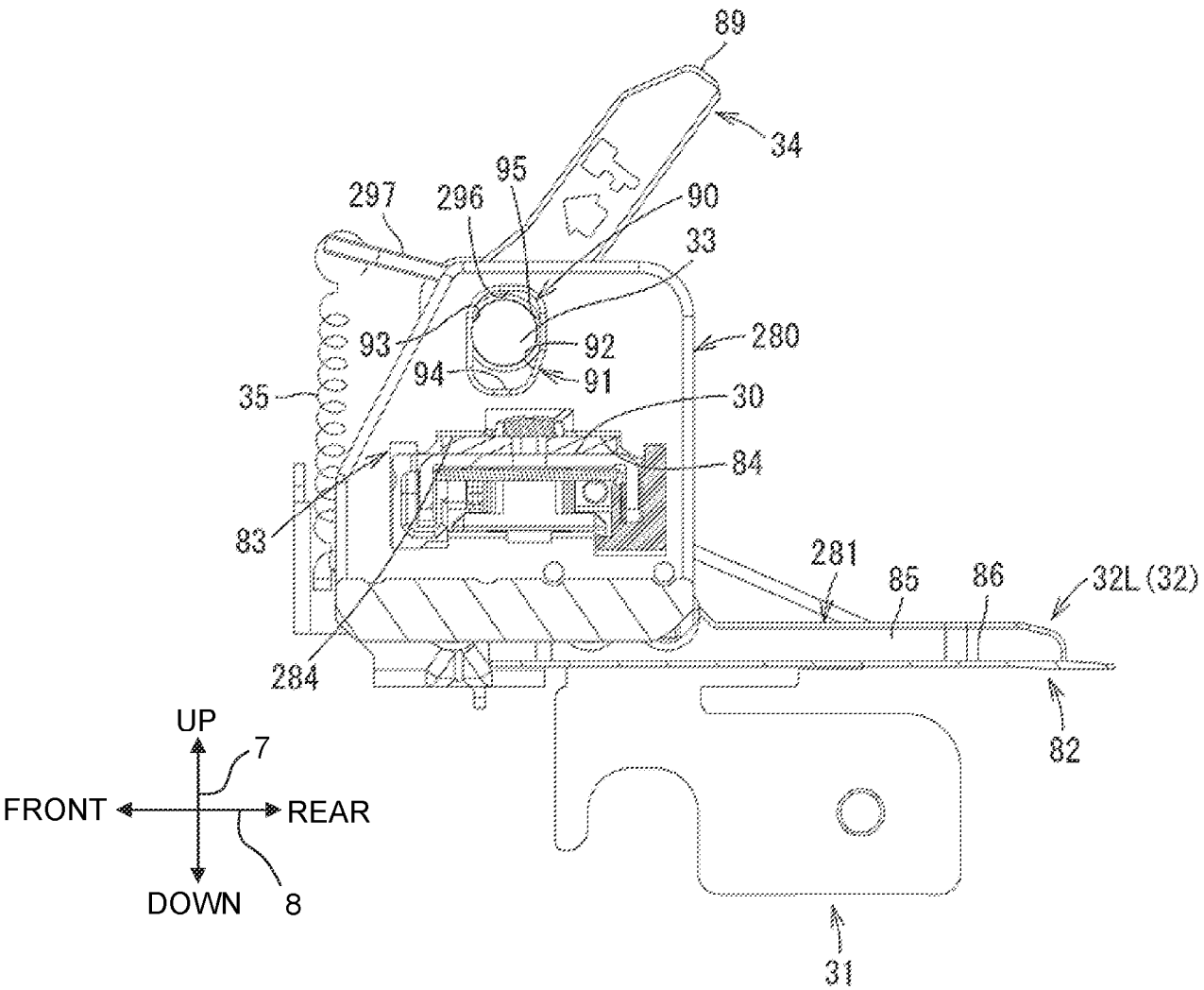
FIG. 18 is a cross-sectional view along the line XVI-XVI in FIG. 15 when the lever is in a second rotational position.
Figure 19:
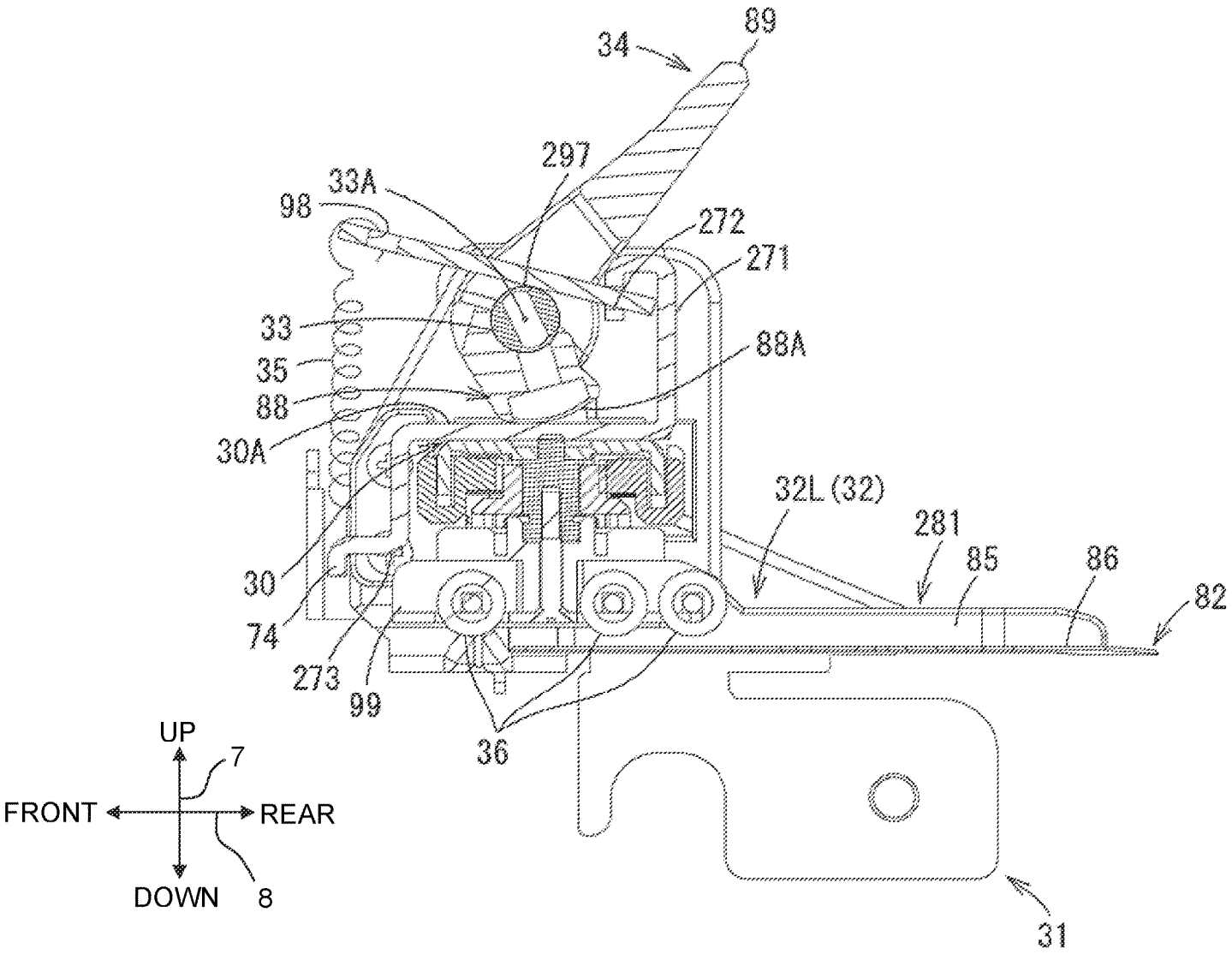
FIG. 19 is a cross-sectional view along the line XVII-XVII in FIG. 15 when the lever is in the second rotational position.

The lever 34 is rotatable to a first rotational position depicted in FIGS. 16 and 17 and a second rotational position depicted in FIGS. 18 and 19. In the first rotational position, the cam surface 88A is positioned approximately rearward from the axis 33A and away from the upper surface 30A of the guide part 30. In the first rotational position, the tensile force (urging force) of the coil spring 35 acts on the shaft 33 via the urging plate 297 to urge the shaft 33 downward. As a result, the shaft 33 moves downward through the long hole 90 of the side guide 32. As depicted in FIG. 16, the shaft 33, having moved downwardly through the long hole 90, enters the tapered portion 91 and contacts the tapered surface 92 and the front surface 93. With the shaft 33 contacting the tapered surface 92 and front surface 93, the cam portion 88 does not contact the upper surface 30A of the guide part 30, and the urging force of the coil spring 35 acts on the shaft 33 downwardly. As the shaft 33 contacts and presses the tapered surface 92, the shaft 33 is pressed against the tapered portion 91 with a force greater than the downward urging force of the coil spring 35. As the shaft 33 presses against the tapered portion 91, the contact surface 284 of the slide portion 280 presses the upper surface 30A of the guide part 30, and the position of the side guide 32 in the left-right direction 9 is fixed.

In the second rotational position, the cam surface 88A contacts the upper surface 30A of guide part 30. As a result, the shaft 33 moves upward and the front end of the urging plate 297 moves upward against the tensile force of the coil spring 35, as depicted in FIG. 19. The upward movement of shaft 33 causes shaft 33 to disengage from the tapered portion 91 in the long hole 90, as depicted in FIG. 18. Force to rotate the lever 34 from the first rotational position to the second rotational position is large enough to resist the tensile force of the coil spring 35.

Figure 15:
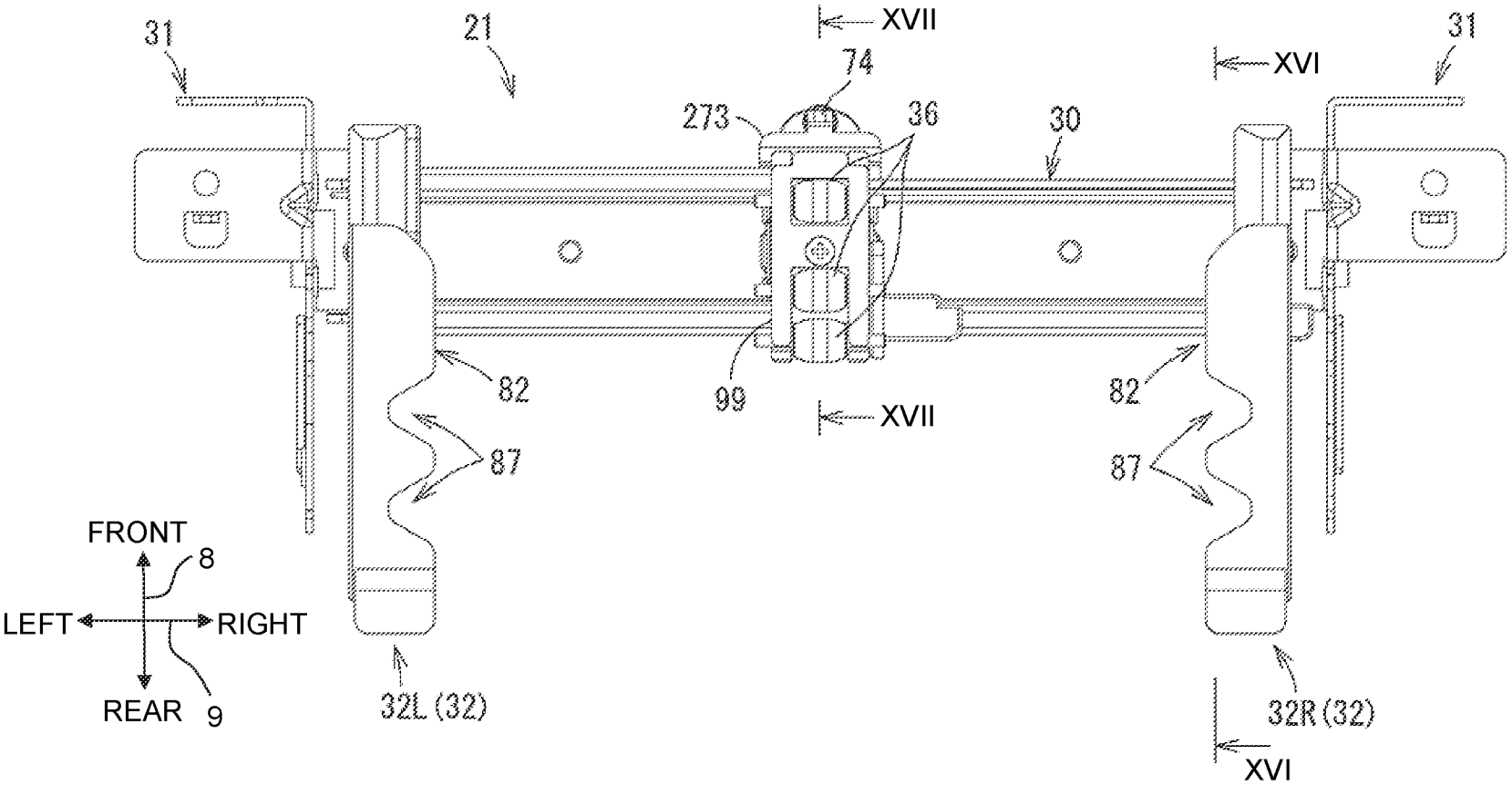
FIG. 15 is a bottom view of the front side guide.

As depicted in FIGS. 13 to 15, a roller receiving member 99 is connected to the center in the left-right direction 9 of the lower surface of the guide part 30. The roller receiving member 99 supports three rollers 36 aligned in the front-rear direction 8, with axes in the left-right direction 9. As depicted in FIG. 17, the lowest position of the rollers 36 is above the support surface 86 of the side guide 32.

[Interlock Mechanism 250]

Figure 20:
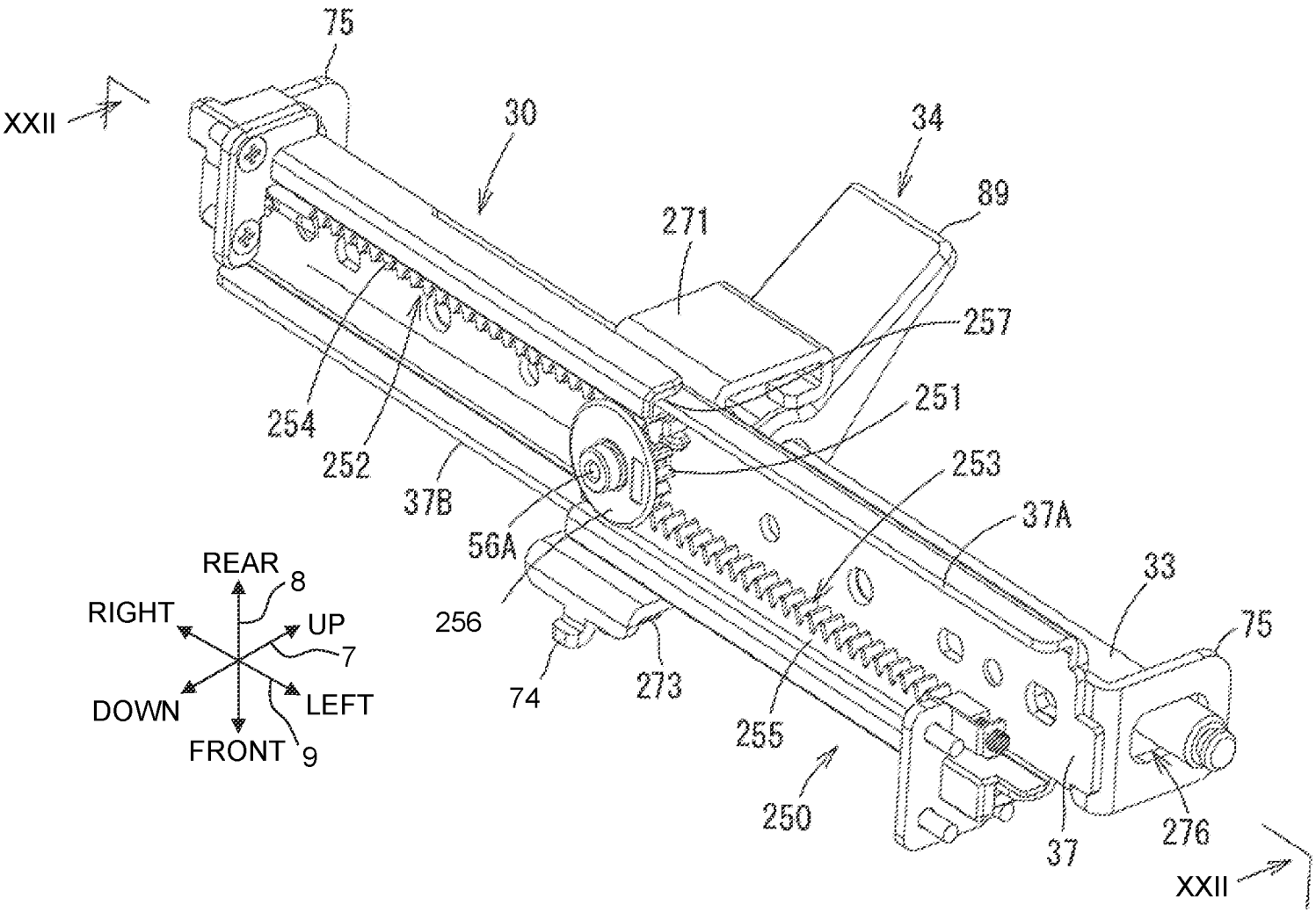
FIG. 20 is a perspective view of the interlock mechanism.

As depicted in FIG. 20, the interlock mechanism 250 is accommodated in the interior space of the guide part 30. The interlock mechanism 250 interlocks the movement of the pair of side guides 32 in the left-right direction 9. The interlock mechanism 250 is a rack and pinion mechanism and has a pinion gear 251, a first right rack gear 252, a first left rack gear 253, a second right rack gear 254, a second left rack gear 255, and a flange 256.

The pinion gear 251 is rotatably fitted to a support shaft 56A along the up-down direction 7 at the center of the internal space of the guide part 30 in the left-right direction 9. The flange 256 is connected to the support shaft 56A below the pinion gear 251 and supports the pinion gear 251 from below. The first right rack gear 252 has a row of forward-facing teeth along the left-right direction 9, and is connected to the slide part 280 of the right side guide 32R at the right end. The first right rack gear 252 is meshed with the pinion gear 251. The first right rack gear 252 has a guide groove 257 extending in the left-right direction 9. A rear end 37A of the upper guide member 37 having the upper surface 30A of the guide portion 30 enters and fits into the guide groove 257. The rear end 37A extends along the left-right direction 9. Using the rear end 37A as a guide, the first right rack gear 252 can move the upper guide member 37 in the left-right direction 9. As the first right rack gear 252 moves in the left-right direction 9, the pinion gear 251 rotates around the support shaft 56A.

The first left rack gear 253 has a row of rearward-facing teeth along the left-right direction 9, and is connected to the slide part 280 of the left side guide 32L at the left end. The first left rack gear 253 is meshed with the pinion gear 251. Similar to the guide groove 257 of the first right rack gear 252, the first left rack gear 253 has a guide groove 257 (see FIG. 22) extending in the left-right direction 9, and a front end 37B of the upper guide member 37 enters and fits into the guide groove 257. The front end 37B extends along the left-right direction 9. Using the front end 37B as a guide, the first left rack gear 253 can move the upper guide member 37 in the left-right direction 9. As the first left rack gear 253 moves in the left-right direction 9, the pinion gear 251 rotates around the support shaft 56A.

The second right rack gear 254 is engaged to the first right rack gear 252 below the first right rack gear 252. The second right rack gear 254 is located between the first right rack gear 252 and the flange 256 in the up-down direction 7 and is supported from below by the flange 256. A dimension of the second right rack gear 254 along the up-down direction 7 is smaller than a dimension of the first right rack gear 252 along the up-down direction 7. The second right rack gear 254 has a row of forward facing teeth along the left-right direction 9. The first right rack gear 252 and the second right rack gear 254 are the same in the size of each of the teeth (i.e., the module) and the number of the teeth.

Figure 21:
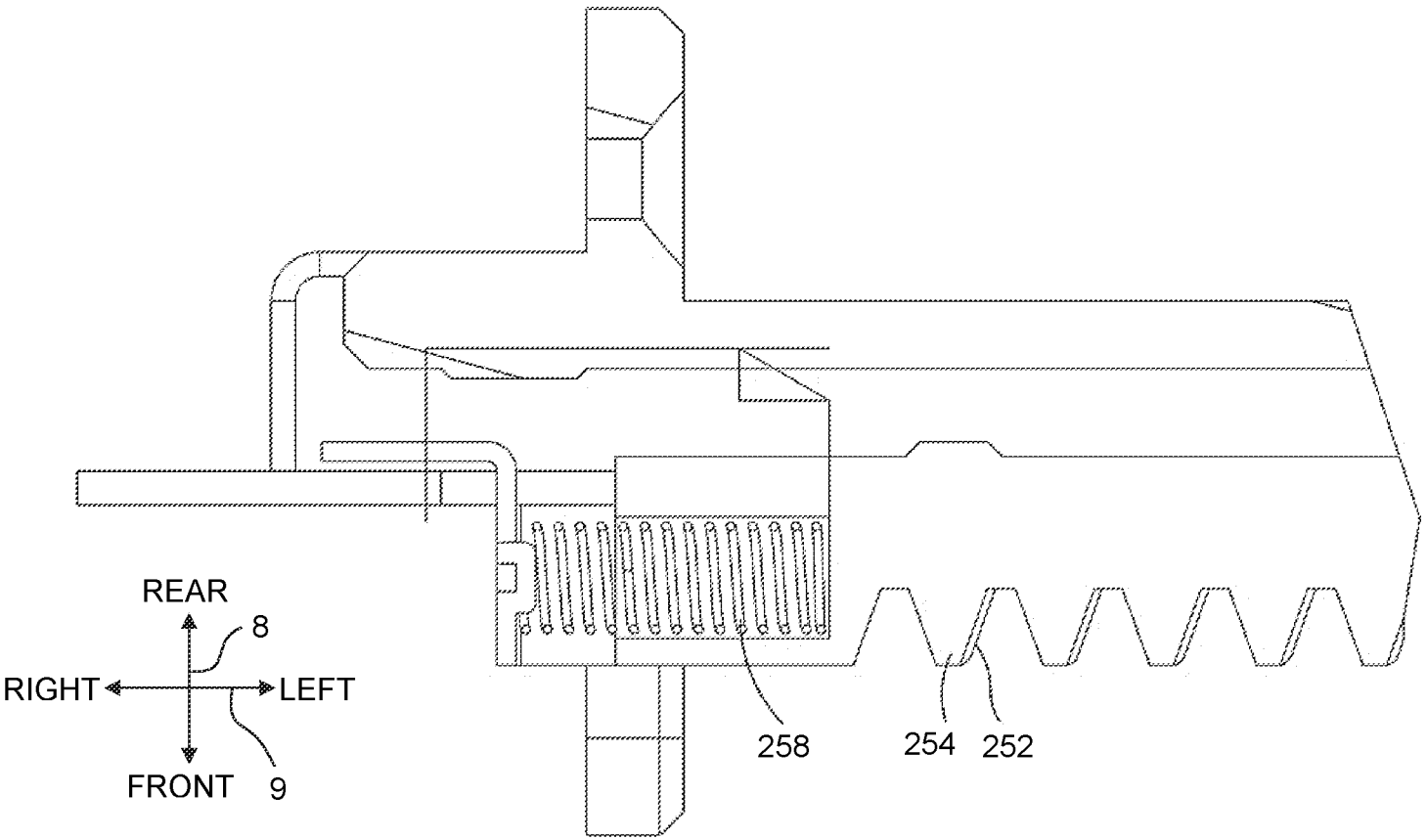
FIG. 21 is an enlarged cross-sectional view around right ends of the first right rack gear and a second right rack gear.
Figure 23:
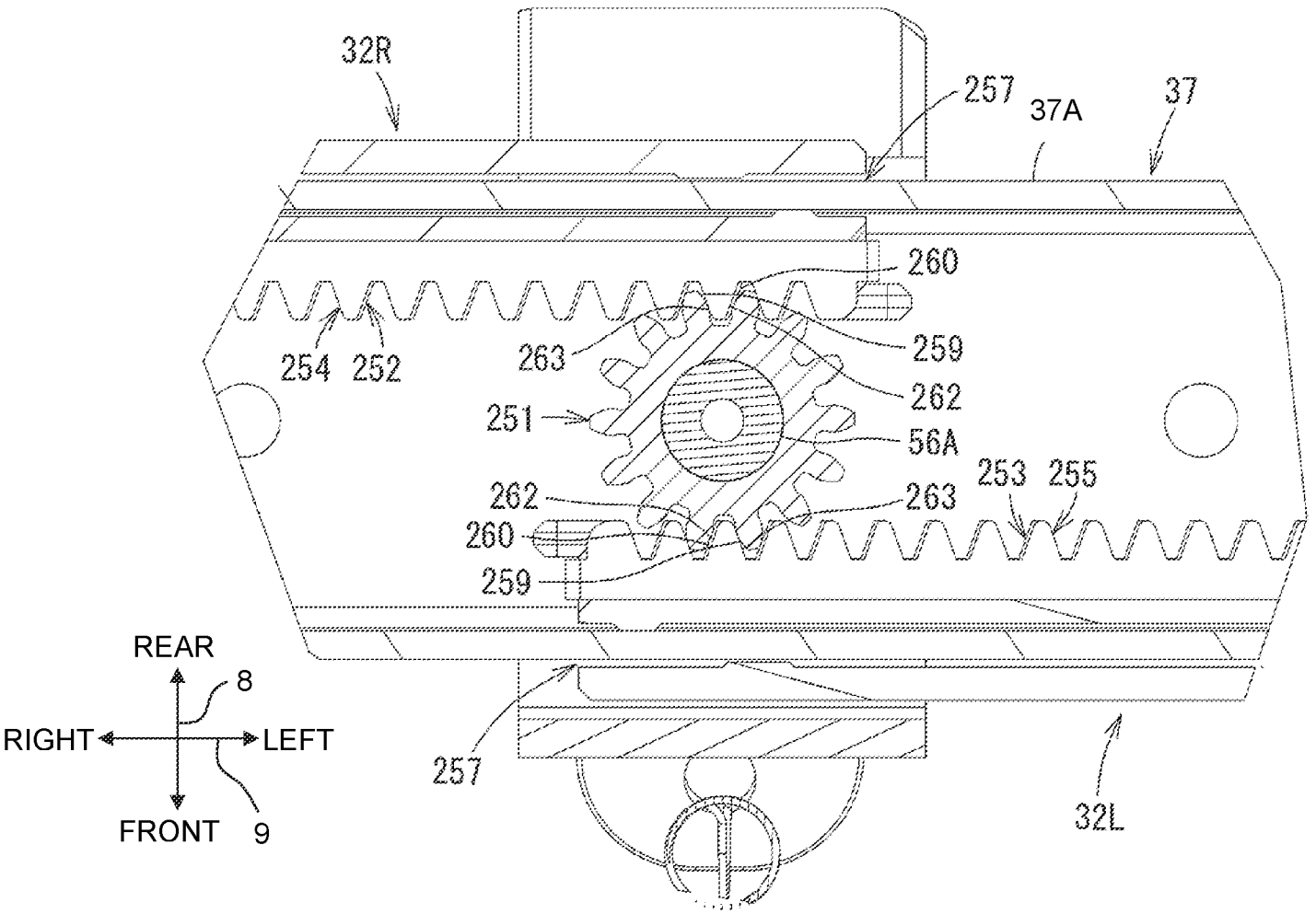
FIG. 23 is an enlarged cross-sectional view along the line XXII-XXII in FIG. 20.

The left and right ends of the second right rack gear 254 are engaged to the first right rack gear 252, such that the second right rack gear 254 is supported by the first right rack gear 252 to be movable in the left-right direction 9. As depicted in FIG. 21, at the right end of the second right rack gear 254, a coil spring 258 is compressed and deformed between the second right rack gear 254 and the first right rack gear 252. Due to an urging force of the coil spring 258, the second right rack gear 254 is urged rightward (outward) with respect to the first right rack gear 252. As depicted in FIG. 23, the urging force of the coil spring 258 causes the teeth of the first right rack gear 252 and the teeth of the second right rack gear 254 to be slightly out of phase in the left-right direction 9. The position of the second right rack gear 254 with the teeth being out of phase with the teeth of the first right rack gear 252 is an example of the second position. The position of the second right rack gear 254 with the teeth being in phase with teeth of the first right rack gear 252 is an example of the first position.

As depicted in FIG. 20, the second left rack gear 255 is engaged to the first left rack gear 253 below the first left rack gear 253. The second left rack gear 255 is located between the first left rack gear 253 and the flange 256 in the up-down direction 7, and is supported from below by the flange 256. A dimension of the second left rack gear 255 along the up-down direction 7 is smaller than a dimension of the first left rack gear 253 along the up-down direction 7. The second left rack gear 255 has a row of rearward-facing teeth along the left-right direction 9. The first left rack gear 253 and the second left rack gear 255 are the same in the size of each of the teeth (i.e., the module) and the number of the teeth.

The left and right ends of the second left rack gear 255 are engaged to the first left rack gear 253. The second left rack gear 255 is supported by the first left rack gear 253 to be movable in the left-right direction 9. Although not depicted in the figures, similar to FIG. 21, a coil spring 258 is compressed and deformed between the second left rack gear 255 and the first left rack gear 253 at the left end of the second left rack gear 255. Due to the urging force of the coil spring 258, the second left rack gear 255 is urged leftward (outward) with respect to the first left rack gear 253. As depicted in FIG. 23, the urging force of the coil spring 258 causes the teeth of the first left rack gear 253 and the teeth of the second left rack gear 255 to be slightly out of phase in the left-right direction 9. The position of the second left rack gear 255 with the teeth being out of phase with the teeth of the first left rack gear 253 is an example of the second position. The position of the second left rack gear 255 with the teeth being in phase with the teeth of the first left rack gear 253 is an example of the first position.

When one of the pair of side guides 32 is moved in the left-right direction 9 by the interlock mechanism 250, the other of the pair of side guides 32 also moves in the left-right direction 9. The pair of side guides 32 are linked to move in approaching (inward) orientations and separating (outward) orientations.

Figure 22:
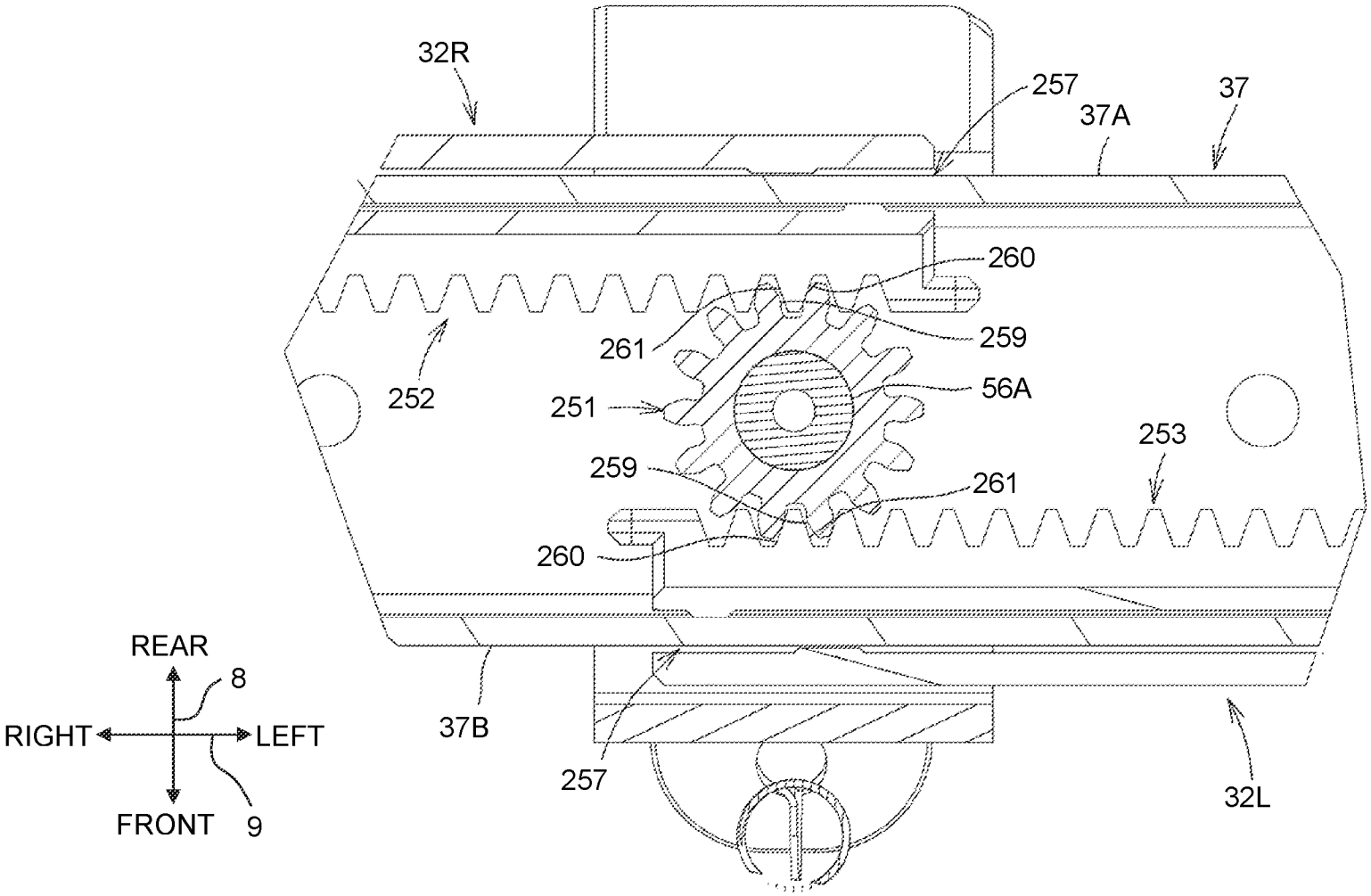
FIG. 22 is an enlarged cross-sectional view along a line XXII-XXII in FIG. 20, excluding the second right rack gear and the second left rack gear.

As depicted in FIG. 22, when the pair of side guides 32 are moved in the approaching orientations, i.e., inward in the left-right direction 9, with respect to the mutually meshing teeth, inward teeth surfaces 260 of the first right rack gear 252 contact the teeth surfaces 259 of the pinion gear 251, and outward teeth surfaces 261 of the first right rack gear 252 do not contact the teeth surfaces 259 of pinion gear 251. The gaps between the teeth surfaces 259 and the teeth surfaces 261 are the so-called backlash. When the pinion gear 251 is not rotated, the first right rack gear 252 can move to the right (outward) by the backlash. In other words, the first right rack gear 252 rattles. Similarly, in the first left rack gear 253, the inward teeth surfaces 260 contact the teeth surfaces 259 of the pinion gear 251, and the outward teeth surfaces 261 do not contact the teeth surfaces 259 of the pinion gear 251.

As depicted in FIG. 23, with respect to the teeth of the first right rack gear 252 and the teeth of the second right rack gear 254 being in phase in the first position, the leftward (inward) teeth surfaces 260 of the first right rack gear 252 are shifted leftward (inward) than the leftward (inward) teeth surfaces 262 of the second right rack gear 254 in the second position. Similarly, with respect to the teeth of the first left rack gear 253 and the teeth of the second left rack gear 255 being in phase in the first position, the rightward (inward) teeth surfaces 260 of the first left rack gear 253 are shifted rightward (inward) than the rightward (inward) teeth surfaces 262 of the second left rack gear 255 in the second position.

With respect to the teeth of the pinion gear 251 and the teeth of the second right rack gear 254 to be meshed with each other, the inward teeth surfaces 262 of the second right rack gear 254 do not contact the teeth surfaces 259 of the pinion gear 251, and the outward teeth surfaces 263 contact the teeth surfaces 259. Similarly, in the second left rack gear 255, the inward teeth surfaces 262 do not contact the teeth surfaces 259 of the pinion gear 251, and the outward teeth surfaces 263 contact the teeth surfaces 259.

When the pair of side guides 32 are moved in the separating orientations (i.e., outward) in the left-right direction 9 from the state depicted in FIG. 23, the coil spring 258 is compressed and deformed to move the second right rack gear 254 and the second left rack gear 255 from the second position to the first position. As a result, the teeth of the first right rack gear 252 and the teeth of the second right rack gear 254 are in phase, and the teeth of the first left rack gear 253 and the teeth of the second left rack gear 255 are in phase. The outward teeth surfaces 261 of the first right rack gear 252 and the outward teeth surfaces 263 of the second right rack gear 254 simultaneously contact the teeth surfaces 259 of the pinion gear 251. Similarly, the outward teeth surfaces 261 of the first left rack gear 253 and the outward teeth surfaces 263 of the second left rack gear 255 simultaneously contact the teeth surfaces 259 of the pinion gear 251. This causes the pair of side guides 32 to move outward in the left-right direction 9.

When the pair of side guides 32 are moved in the approaching orientations (i.e., inward) in the left-right direction 9 from the state depicted in FIG. 23, the coil spring 258 is not compressed and deformed, and the second right rack gear 254 and the second left rack gear 255 in the second position are moved while being remained in the second position. As a result, the pair of side guides 32 move inward in the left-right direction 9 in conjunction with each other, with the inward teeth surfaces 260 of the first right rack gear 252 and the inward teeth surfaces 260 of the first left rack gear 253 being in contact with the teeth surfaces 259 of the pinion gear 251.

[Controller 130]

The controller 130 includes a CPU (Central Processing Unit) 131, a ROM (Read Only Memory) 132, a RAM (Random Access Memory) 133, an EEPROM 134 (EEPROM is a registered trademark of Renesas Electronics Corporation), and an ASIC (Application Specific Integrated Circuit) 135, which are connected by an internal bus 137, as depicted in FIG. 24. The ROM 132 stores programs and the like for the CPU 131 to control various operations. The RAM 133 is used as a storage area to temporarily record data, signals, etc. used when the CPU 131 executes the above programs, or as a work area for data processing. The EEPROM 134 stores settings, flags, and the like to be retained even after the power is turned off.

The holder driving motor 41 and the conveyance motor 120, etc. are connected to the ASIC 135. The ASIC 135 generates drive signals to rotate each motor and controls each motor based on these drive signals. Each motor rotates forward or reverse in accordance with the drive signals from the ASIC 135.

The controller 130 drives the holder driving motor 41, such that a holder ejection speed Va at which the sheet S is ejected upward from the sheet holder 13 and a roller conveyance speed Vb at which the conveyance roller 45 conveys the sheet S forward direction are different from each other.

Figure 25B:
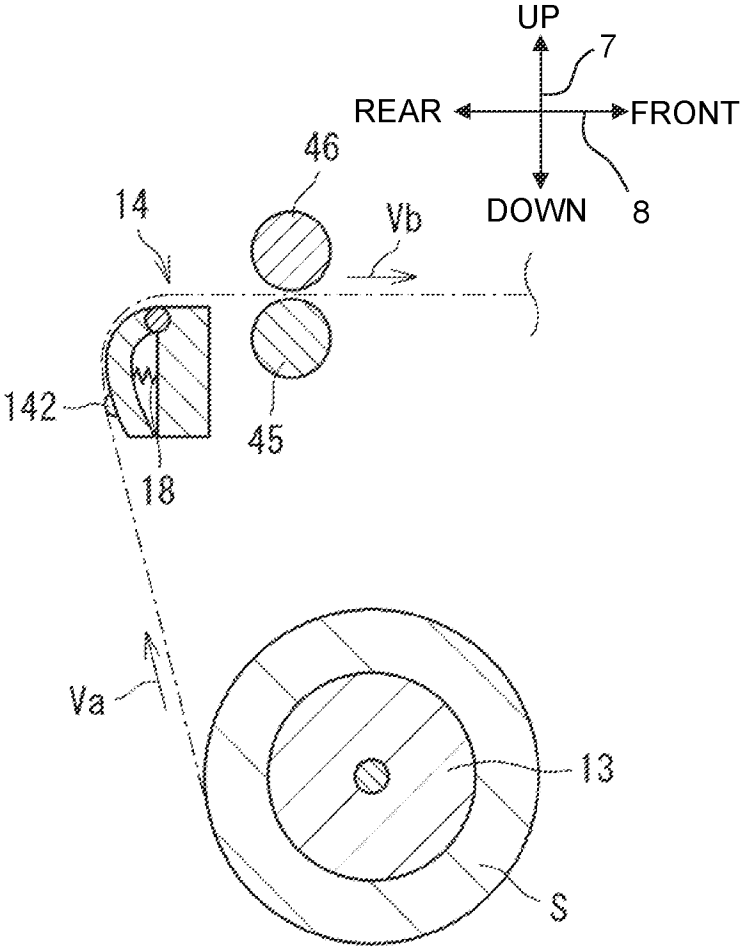
FIG. 25B is a schematic diagram depicting the tensioner after the diameter of the rolled body is smaller than in FIG. 25A.
Figure 25A:
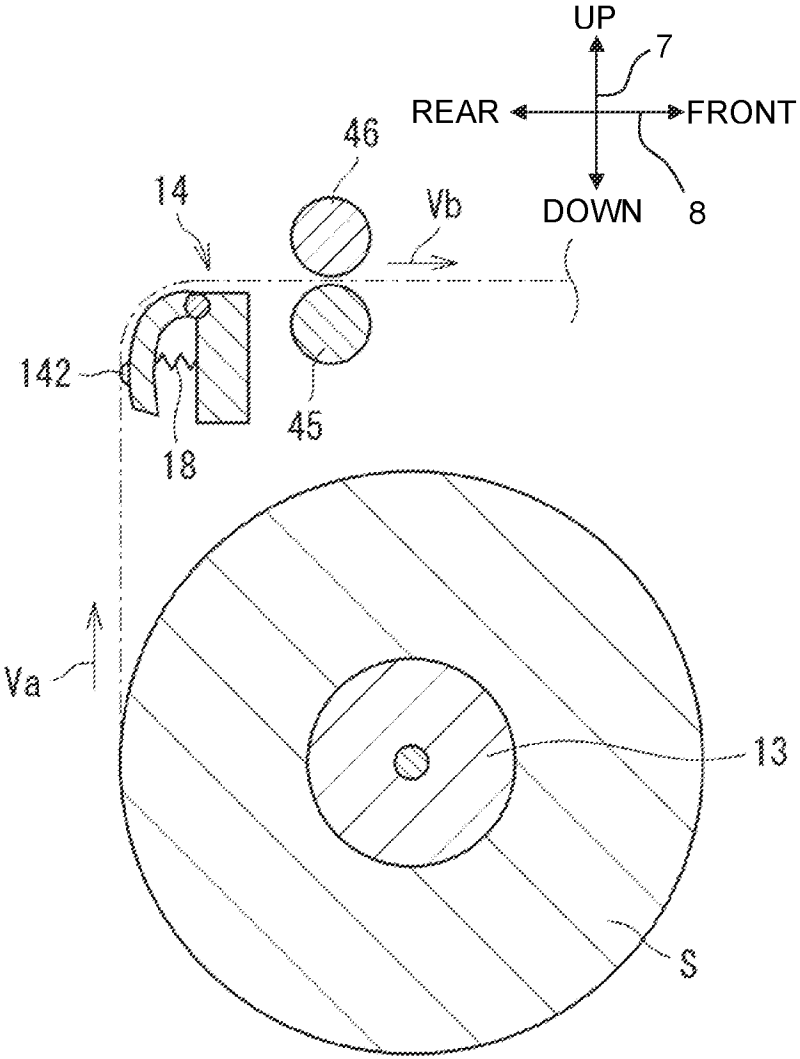
FIG. 25A is a diagram depicting the tensioner before diameter of a rolled body is reduced.

Specifically, the controller 130 rotates the conveyance motor 120 forward at a predetermined rotation speed Vm. When the conveyance motor 120 rotates forward, the conveyance roller 45 rotates clockwise in FIG. 25A to convey the sheet S forward. The controller 130 rotates the holder driving motor 41 forward at a predetermined rotation speed Vh. When the holder driving motor 41 rotates forward, the sheet holder 13 rotates clockwise in FIG. 25A and the sheet S is ejected upward from the sheet holder 13. As depicted in FIG. 25A, the holder ejection speed Va is less than the roller conveyance speed Vb. Therefore, the sheet S is pulled linearly between the sheet holder 13 and the conveyance roller 45. This pulling of the sheet S causes the arc member 140 and the flat member 141 of the tensioner 14 to move the inward orientation R against the urging force of the urging member 18 to be positioned in the first urging position. As a result, the sheet S is tensioned while being curved by the tensioner 14.

As the sheet S is ejected from the sheet holder 13, the holder ejection speed Va decreases because the diameter of the rolled body becomes smaller. Then, since a difference between the holder ejection speed Va and the roller conveyance speed Vb increases, the sheet S is pulled more strongly between the sheet holder 13 and the conveyance roller 45. As a result, as depicted in FIG. 25B, the arc member 140 and the flat member 141 of the tensioner 14 move further in the inward orientation R than the first urging position to the second urging position.

To prevent the holder ejection speed Va from being much slower than the roller conveyance speed Vb as a volume of the sheet S rewound by the sheet holder 13 decreases, the controller 130, for example, sets the rotation speed Vh of the holder driving motor 41 (see FIG. 24) for the forward rotation to Vh1, Vh2 or Vh3 in three steps. The rotation speeds Vh1, Vh2, and Vh3 satisfy Vh1<Vh2<Vh3.

Figure 26A:
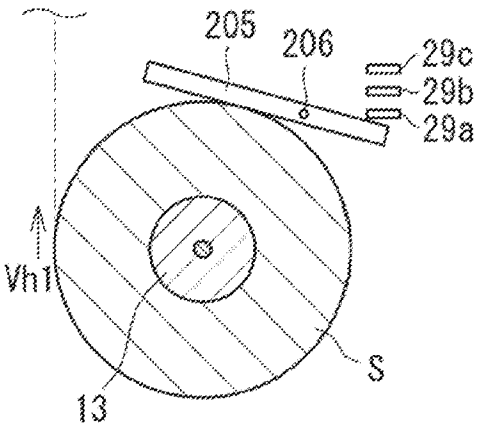
FIGS. 26A-26D are schematic diagrams depicting configurations for detecting remaining amount of sheets in the sheet holder.

As depicted in FIG. 26A, when the rolled body with the sheet S being wound up to the maximum amount by the sheet holder 13 (hereinafter also referred to as the maximum amount) is replenished in the image recording apparatus 1, an arm 205, which rotates around a support shaft 206 along the left-right direction 9, contacts an outer circumferential surface of the rolled body. The first, second, and third sensors 29*a*, 29*b*, and 29*c* output first, second, and third signals, respectively, according to the remaining amount of the sheet S wound onto the sheet holder 13. Each of the sensors 29*a*, 29*b*, 29*c* has a light emitting element and a light receiving element. When the arm 205 passes between the light emitting element and the light receiving element in each of the sensors 29*a*, 29*b*, 29*c*, an on signal is output to the controller 130 indicating that each light receiving element has detected the arm 205. Specifically, when the remaining amount of the sheet S is two-thirds of the maximum amount, the arm 205 blocks the light path of the first sensor 29*a* and outputs the first signal. When the remaining amount of the sheet S is one-third of the maximum amount, the arm 205 blocks the light path of the second sensor 29*b* and outputs the second signal. When there is no more sheet S remaining, the arm 205 blocks the light path of the third sensor 29*c* and outputs the third signal.

Figure 27:
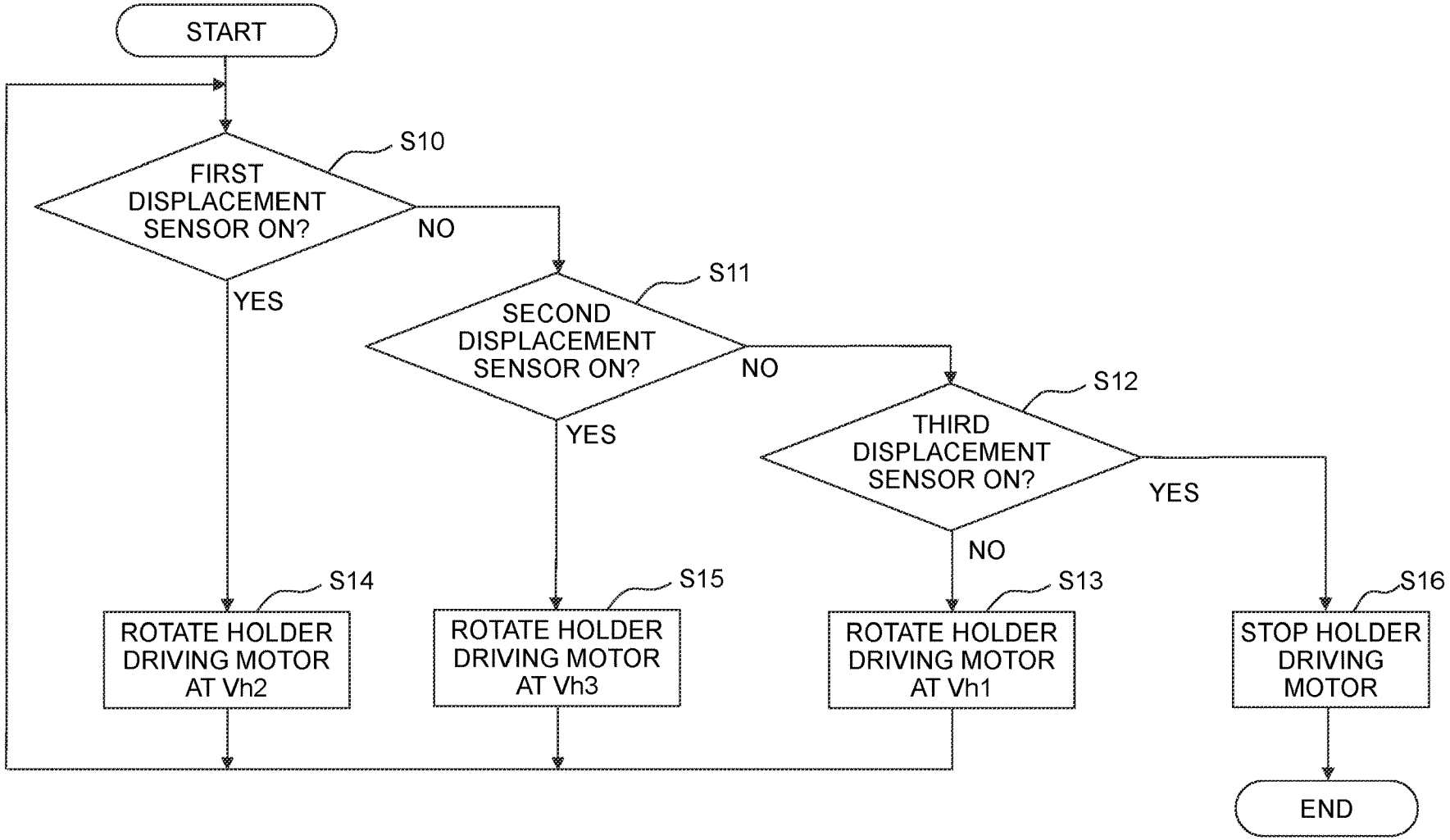
FIG. 27 is a flowchart illustrating a relationship between remaining amount of the sheet in the rolled body and a rotation speed of a holder driving motor.

The detection of a remaining amount of the sheet S in the sheet holder 13 and the driving of the holder driving motor 41 by the controller 130 are explained below with reference to FIG. 27. The controller 130 determines whether the first signal is received from the first sensor 29*a* (S10). If the controller 130 does not receive the first signal from the first sensor 29*a* (S10: No), the controller 130 determines whether the second signal is received from the second sensor 29*b* (S11). If the controller 130 does not receive the second signal from the second sensor 29*b* (S11: No), the controller 130 determines whether the third signal is received from the third sensor 29*c* (S12). If the controller 130 does not receive the third signal from the third sensor 29*c* (S12: No), the controller 130 drives the holder driving motor 41 at the rotation speed Vh1, as depicted in FIG. 26A. At this time, the remaining amount of sheet S is not less than two-thirds of the maximum amount.

Figure 26B:
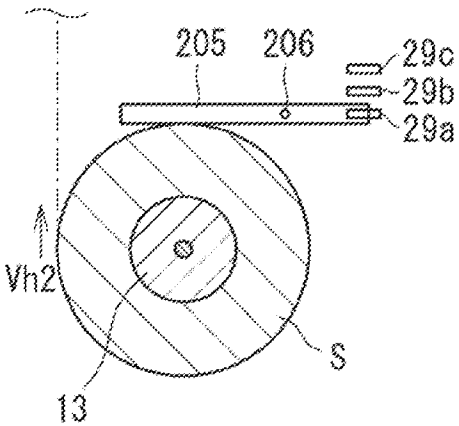

If the controller 130 receives the first signal from the first sensor 29*a* in step S10 (S10: Yes), the controller 130 drives the holder driving motor 41 at the rotation speed Vh2, as depicted in FIG. 26B. At this time, the remaining amount of sheet S is less than two-thirds of the maximum amount and not less than one-third of the maximum amount.

Figure 26C:
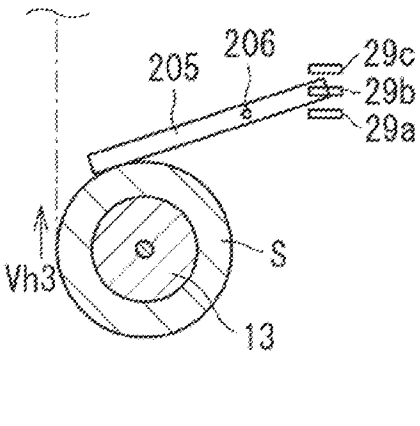

If the controller 130 receives the second signal from the second sensor 29*b* in step S11 (S11: Yes), the controller 130 drives the holder driving motor 41 at the rotation speed Vh3, as depicted in FIG. 26C. At this time, the remaining amount of sheet S is less than one-third of the maximum amount. After driving the holder driving motor 41 in each of the steps S13, S14, and S15, the controller 130 again determines whether the first signal is received from the first sensor 29*a* (S10).

Figure 26D:
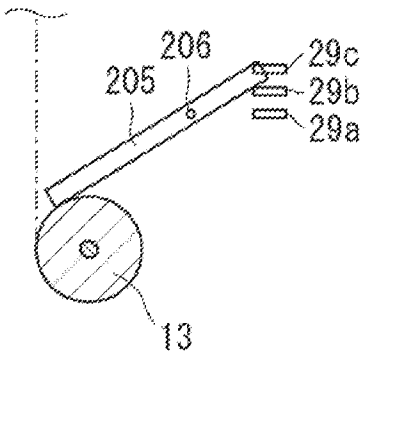

If the controller 130 receives the third signal from the third sensor 29*c* in step S12 (S12: Yes), the controller 130 stops driving the holder driving motor 41 (S16), as depicted in FIG. 26D. At this time, there is no more sheet S remaining.

When the controller 130 switches the rotation speed Vh from Vh1 to Vh2 and from Vh2 to Vh3, the speed difference between the roller conveyance speed Vb and the holder ejection speed Va becomes smaller. Therefore, the tension applied to the tensioner 14 by the sheet S is weakened, and the arc member 140 and the flat member 141 are urged by the urging member 18 to move in the outward orientation Q.

As described above, the controller 130 increases the rotation speed Vh of the holder driving motor 41 as the amount of sheet S wound by the sheet holder 13 decreases, such that the holder ejection speed Va does not become much smaller than the roller conveyance speed Vb.

When the sheet S is conveyed in the reverse orientation of the conveyance orientation G in the image recording, the controller 130 rotates the conveyance motor 120 and the holder driving motor 41 in reverse. By rotating the conveyance motor 120 and the holder driving motor 41 in reverse, the sheet S is conveyed in the reverse orientation of the conveyance orientation G. At this time, the controller 130 drives the holder driving motor 41 and the conveyance motor 120, such that the holder winding speed Vc at which the sheet S is wound by the sheet holder 13 and the reverse conveyance speed Vd at which the conveyance roller 45 conveys the sheet S rearward are different from each other.

Figure 28:
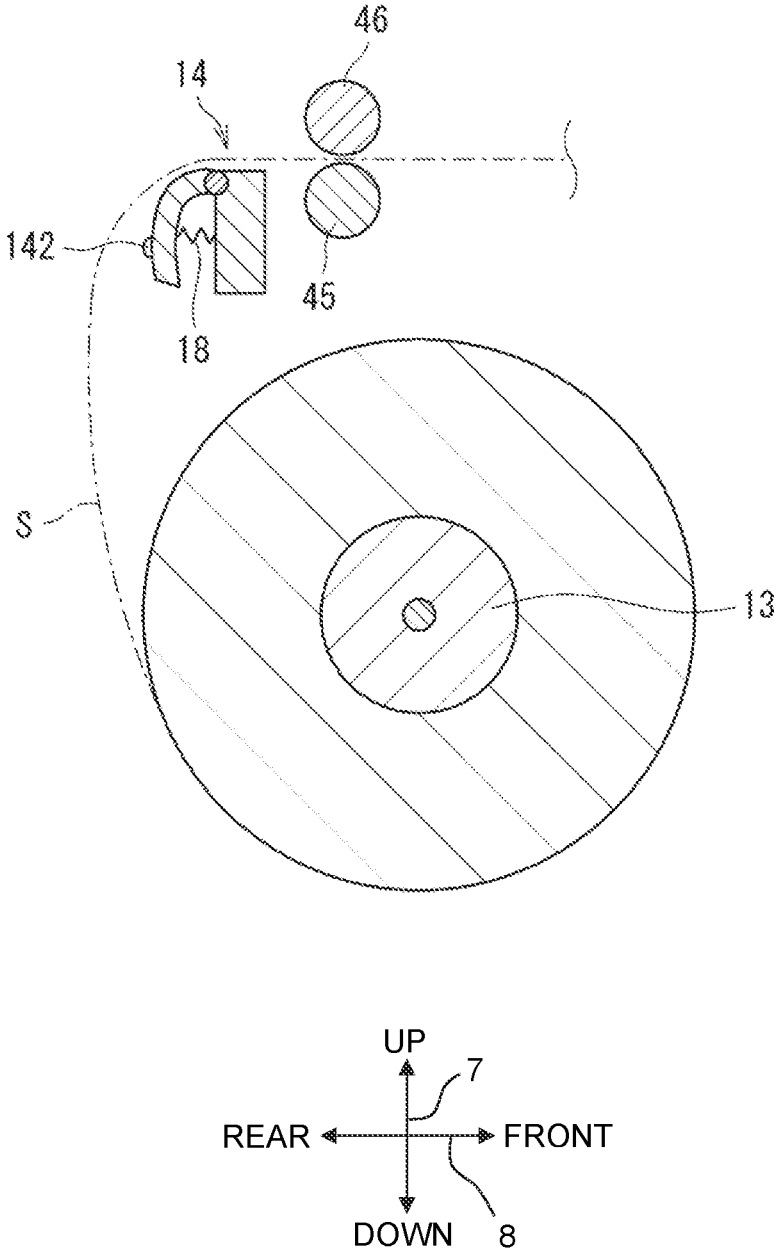
FIG. 28 is a schematic diagram of the tensioner when the sheet is conveyed rearward.

Specifically, as depicted in FIG. 28, the controller 130 rotates the conveyance motor 120 in reverse at a predetermined rotation speed. When the conveyance motor 120 rotates in reverse, the conveyance roller 45 rotates counterclockwise in FIG. 2 to convey the sheet S rearward at the reverse conveyance speed Vd. The controller 130 causes the holder driving motor 41 to rotate in reverse at a predetermined rotation speed. When the holder driving motor 41 rotates in reverse, the sheet holder 13 rotates counterclockwise in FIG. 2 and the sheet S is wound onto the sheet holder 13 at the holder winding speed Vc. At this time, the controller 130 drives the conveyance motor 120 and the holder driving motor 41, such that the holder winding speed Vc becomes smaller than the reverse conveyance speed Vd. This causes the sheet S to flex between the sheet holder 13 and the conveyance roller 45, and the sheet S is separated from the first roller 142. Therefore, the sheet S being conveyed in the reverse orientation of the conveyance orientation G is conveyed without contacting the first roller 142, and without being guided by the first roller 142 in an orientation separating away from the first guide surface 147.

Effects of the Embodiment

According to the embodiment, the sheet S is conveyed in the conveyance orientation G while being guided by the first roller 142 to the first guide surface 14, in a state of being positioned with respect to the left-right direction 9 by the first guide surface 147. Since the sheet S is curved by the tension applied from the tensioner 14, the stiffness of the sheet S is increased at a position where the sheet S contacts the first guide surface 147, making it difficult for the sheet S to buckle.

Even if the width sizes of the sheets S conveyed between the first side guide 145 and the sub guide 146 are different, the first roller 142 contacts the center of each of the sheets S in the width direction. Therefore, the load on the sheet S due to contact with the first roller 142 is not uneven in the left-right direction 9. As a result, the sheet S can be conveyed stably.

As the first side guide 145 is moved in the left-right direction 9, the interlock mechanism 50 allows the sub guide 146 to move in the opposite direction to the first side guide 145 in the left-right direction 9. Therefore, the first side guide 145 and the sub guide 146 can sandwich the sheets S of various sizes and widths. This decreases meandering and the skew of the sheet S.

The tensioner 14 urges the curved sheet S in the outward orientation Q, such that the sheet S can be conveyed without bending.

When the left edge of the sheet S skewed to the left at the first downstream edge 152 of the first guide surface 147 protrudes beyond the first guide surface 147 and the sheet S moves upward along the first guide surface 147, the left end portion of the sheet S contacts the first guard surface 154. This prevents the sheet S from going over the first guide surface 147.

The sheet S, which is tensioned by the tensioner 14, curves along the curved surface. Since the first extending piece 148 extends from the first guide surface 147, the sheet S is always located on the second curved surface 150 and is difficult to enter between the first side guide 145 and the tensioner 14.

When sheet S is conveyed on conveyance path 10 in the reverse orientation of the conveyance orientation G, the sheet S is guided by the front side guide 21. Therefore, the skew of the sheet S can be decreased.

When the sheet S is conveyed in the reverse orientation of the conveyance orientation G in the conveyance path 10, the winding speed Vc of the sheet holder is smaller than the reverse conveyance speed Vd of the conveyance roller 45. Therefore, the sheet S bends between the sheet holder 13 and the conveyance roller 45 and does not contact the first roller 142. This prevents the sheet S from being separated from the first side guide 145 by the first roller 142. This makes it difficult for the sheet S to separate from the first side guide 145, when the sheet S is conveyed in the conveyance orientation G after being conveyed in the reverse orientation of the conveyance orientation G.

Even if the sheet S is skewed downstream from the conveyance roller 45 in the conveyance orientation G, the skew of the sheet S can be eliminated by conveying the sheet S in the reverse orientation of the conveyance orientation G, and then conveying the sheet S in the conveyance orientation G while causing the sheet S to contact the first side guide 145 again.

According to this embodiment, the sheet S is sandwiched between the first side guide 145, which enable accurate and smooth positioning, and the second side guide 146, which is linked to the first side guide 145, in the left-right direction 9. This prevents the sheet S from meandering or skewing due to the rattles of the first side guide 145 and the second side guide 146, while being adaptable to various sheet widths. In addition, since the seat S is curved while being applied the tension from the tensioner 14, the stiffness of the seat S increases between the first guide surface 147 and the second guide surface 155 and it is difficult for the seat S to buckle.

Even if the sheet S contacts the first guide surface 147 or the second guide surface 155 by the first roller 142, the skew of the sheet S can be decreased assuredly without rattling by fixing the first side guide 145 and the second side guide 146.

The movement of the first side guide 145 and the second side guide 146 can be regulated by stopping the movement of the first left rack gear 52 and the first right rack gear 53 in the left-right direction 9.

The third side guide 21A and the fourth side guide 21B are installed downstream from the conveyance roller 45 in the conveyance orientation. Therefore, the sheet S can be conveyed stably at the downstream from the conveyance roller 45.

According to this embodiment, the urging force of the coil spring 35 presses the shaft 33 against the tapered portion 91 of the long hole 90, and the shaft 33 is pressed against the tapered surface 92 at the tapered portion 91. The shaft 33 is pressed against the tapered portion 91 with a force greater than the urging force in the up-down direction 7. This fixes the position of the pair of side guides 32 in the left-right direction 9. Since the force required to rotate the lever 34 from the first rotational position to the second rotational position is large enough to resist the urging force of the coil spring 35, the lever 34 can be rotated relatively easily.

The notches 87 in the support part 82 of each of the side guides 32 allow the light of the optical sensors 24, 25 to pass in the up-down direction 7. This allows the optical sensors 24, 25 to function even when the side guides 32 move to their closest position in the left-right direction 9.

The sheet S moves smoothly because the interlock mechanism 250 has a roller 36.

The rear side guide 15 and front side guide 21 are provided upstream and downstream, respectively, from the conveyance roller pair 16 in the conveyance orientation. Therefore, the sheet S is precisely positioned in the left-right direction 9 and misalignment or skew of the sheet S is difficult to occur.

According to the embodiment, the movement in the left-right directions 9 of the first right rack gear 252 and the first left rack gear 253, which are connected to the pair of side guides 32 respectively, are linked via mesh with the pinion gear 251. Since the second right rack gear 254 and the second left rack gear 255 are urged toward the second position, the first right rack gear 252 and the second right rack gear 254 contact the opposing teeth surfaces 259 of the pinion gear 251 respectively, in the teeth grooves of the pinion gear 251. The first left rack gear 253 and the second left rack gear 255 contact the opposing teeth surfaces 259 of the pinion gear 251, respectively. This reduces rattling of the first right rack gear 252 and the first left rack gear 253 due to the backlash between the first right rack gear 252 and the first left rack gear 253 and the pinion gear 251. As a result, the pair of side guides 32 can be positioned accurately while moving smoothly in the left-right direction 9.

When the pair of side guides 32 are moved to approach each other, the first right rack gear 252 and the first left rack gear 253 contact the pinion gear 251. When the pair of side guides 32 are moved away from each other, the second right rack gear 254 and the second left rack gear 255 contact the pinion gear 251. Therefore, after the side guides 32 are moved to approach each other, the side guides 32 are prevented from moving by the urging force acting on the second right rack gear 254 and the second left rack gear 255.

The dimension of the second right rack gear 254 along the up-down direction 7 is smaller than the dimension of the first right rack gear 252 along the up-down direction 7. The dimension of the second left rack gear 255 along the up-down direction 7 is smaller than the dimension of the first left rack gear 253 along the up-down direction 7. The second right rack gear 254 is located between the first right rack gear 252 and the flange 256 in the up-down direction 7. The second left rack gear 255 is located between the first left rack gear 253 and the flange 256 in the up-down direction 7. This makes it difficult for the second right rack gear 254 and the second left rack gear 255 to deform. In addition, since the second right rack gear 254 and the second left rack gear 255 are thin, the size of the interlock mechanism 250 in the up-down direction 7 can be reduced.

Modification 1

Figure 29:
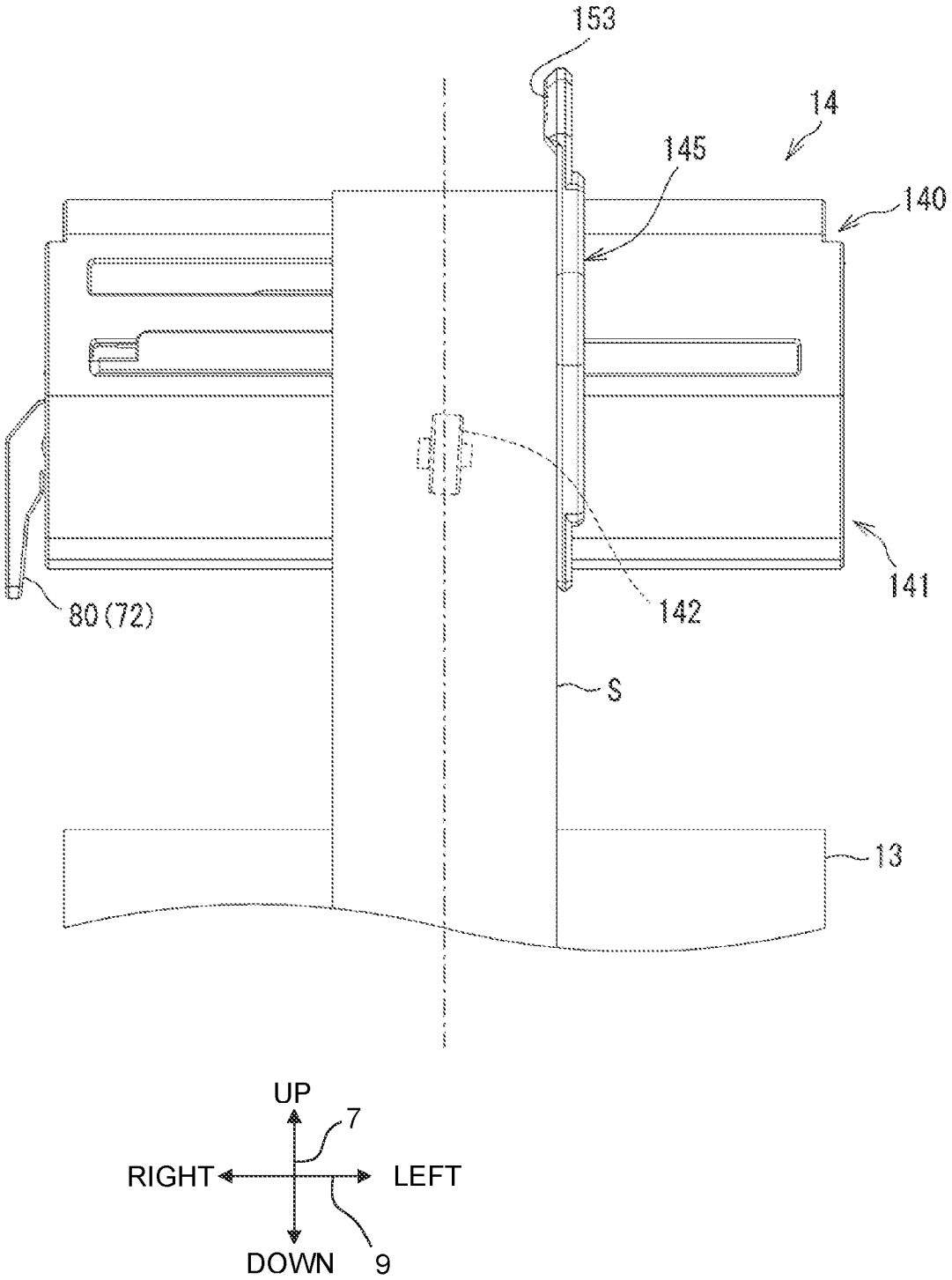
FIG. 29 is a schematic rear view of the tensioner of the image recording apparatus according to modification 1.

In the embodiment described above, the first side guide 145 and the sub guide 146 are attached to the tensioner 14. However, as depicted in FIG. 29, the tensioner 14 may have only the first side guide 145 without the sub guide 146.

The first roller 142 may be positioned at the center of the flat member 141 in the left-right direction 9 or at the center of the arc member 140 in the left-right direction 9. The position of the first roller 142 may be changed appropriately as long as the sheet S is conveyed to approach the first side guide 145.

Modification 2

Figure 30:
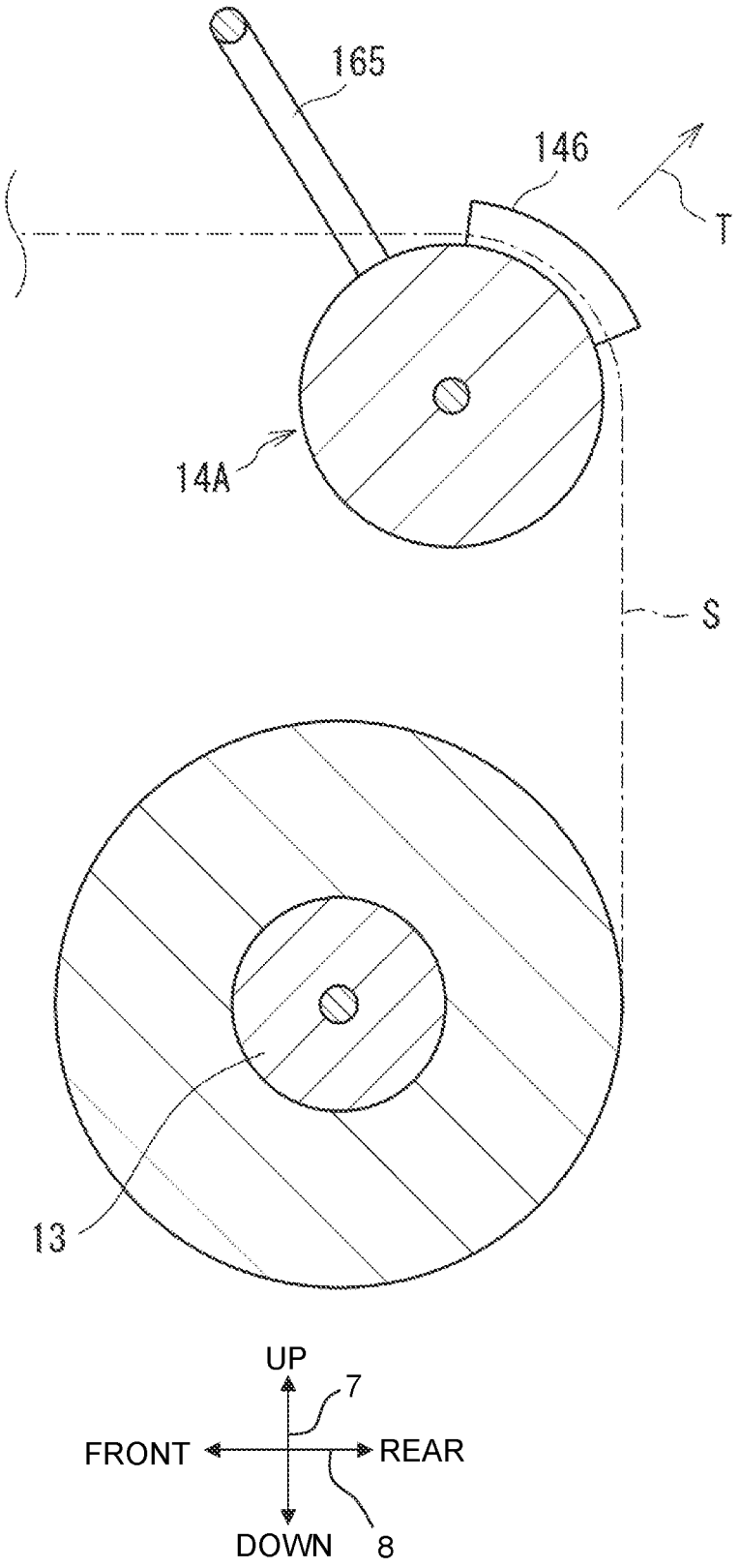
FIG. 30 is a schematic view of the tensioner of the image recording apparatus according to modification 2, viewed from the left.

In the embodiment described above, the arc member 140 is supported on the shaft 42 by the connecting members 44A, 44B, and the flat member 141 is urged rearward by the urging member 18. However, the tensioner 14A may be urged by an urging member (not depicted) in an outward orientation T of a direction intersecting with a surface of the curved seat S. For example, as depicted in FIG. 30, a cylindrical tensioner 14A extending in the left-right direction 9 may be fixed to the end of the arm 165, which is supported rotatably around an axis along the left-right direction 9.

Modification 3

Figure 31B:
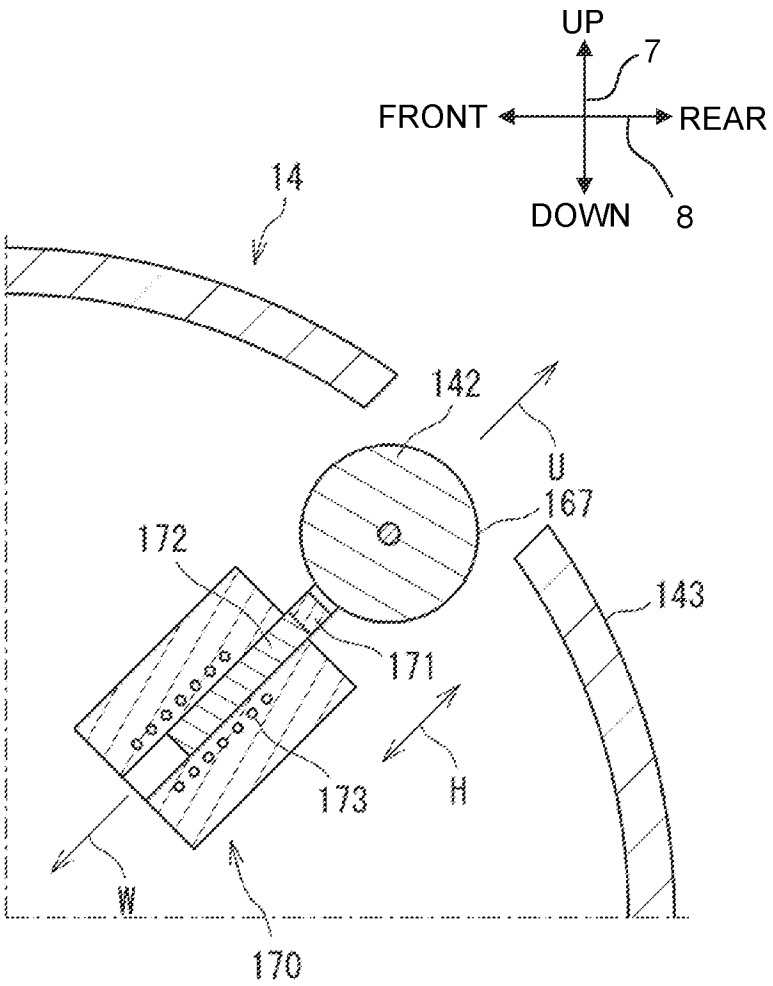
FIG. 31B is a schematic diagram depicting the movement mechanism in a separate position of the image recording apparatus according to modification 3.
Figure 31A:
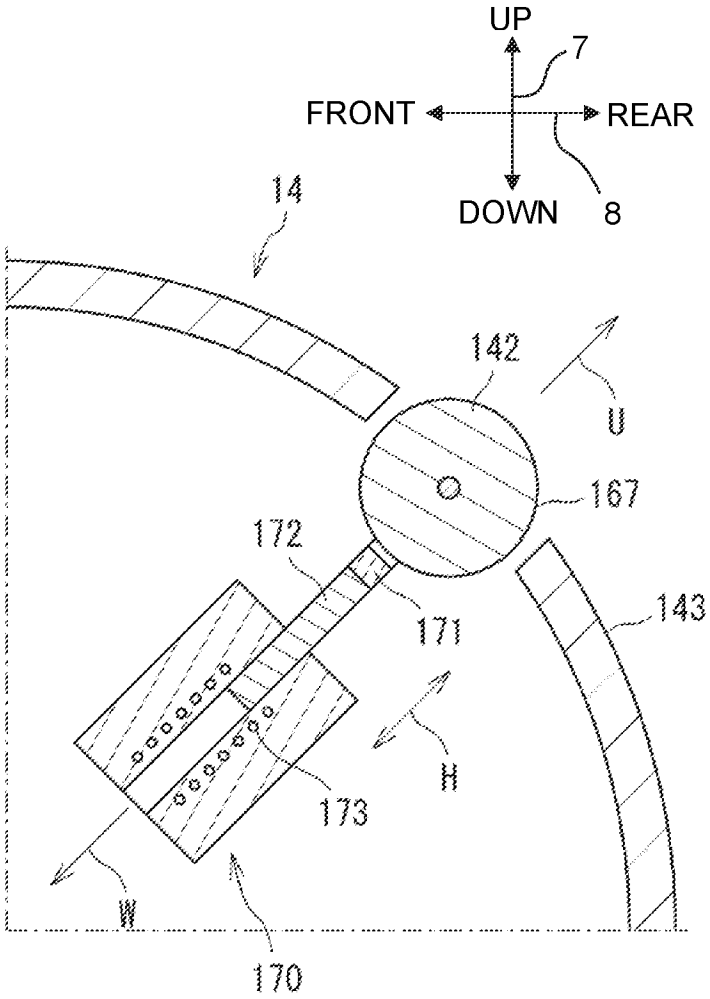
FIG. 31A is a schematic diagram depicting a movement mechanism in a contact position of the image recording apparatus according to modification 3.

In the embodiment described above, a control in which the holder winding speed Vc is less than the reverse conveyance speed Vd when the sheet S is conveyed rearward. However, as depicted in FIGS. 31A and 31B, a portion of the outer surface 167 of the first roller 142 may be arranged to protrude from the first curved surface 143 of the arc member 140. Further, the first roller 142 may be retractable from the second curved surface 150 by a movement mechanism 170 so that the first roller 142 can be separated from the sheet S. The holder winding speed Vc may be greater than the reverse conveyance speed Vd.

Specifically, the controller 130 rotates the conveyance motor 120 in reverse at a predetermined rotation speed. When the conveyance motor 120 rotates in reverse, the sheet S is conveyed rearward by the conveyance roller 45. The controller 130 also causes the holder driving motor 41 to rotate in reverse at a predetermined rotation speed. When the holder driving motor 41 rotates in reverse, the sheet S is wound onto the sheet holder 13. Since the holder winding speed Vc is greater than the reverse conveyance speed Vd, the sheet S is pulled linearly between the sheet holder 13 and the conveyance roller 45.

The first roller 142 is movable by the movement mechanism 170 to a contact position and a separate position. At the contact position, a portion of the outer circumferential surface 167 of the first roller 142 protrudes from the second curved surface 150 in an outward orientation U to contact the sheet S. At the separate position, the first roller 142 is retracted from the second curved surface 150 in an inward orientation W to separate from the sheet S.

The movement mechanism 170 is a solenoid that moves the support member 171 by moving the plunger 172 in the stroke direction H (see FIGS. 31A and 31B). The first roller 142 is rotatably supported by the support member 171. The plunger 172 can move the first roller 142 to the contact position (FIG. 31A) by protruding from the solenoid coil 173 so as to contact the support member 171. The plunger 172 can also move the first roller 142 to the above-mentioned separate position (FIG. 31B) by retracting into the solenoid coil 173 so as to be away from the support member 171.

When conveying the sheet S rearward, the controller 130 turns off the energizing to the solenoid coil 173 while driving the sheet holder 13 and the holder driving motor 41 in reverse rotation. When the power to the solenoid coil 173 is turned off, the plunger 172 protruding from the solenoid coil 173 is retracted and the first roller 142 is moved to the separate position by the support member 171. When the controller 130 does not energize the solenoid coil 173, the plunger 172 drives the support member 171 to move the first roller 142 to the separate position. When the sheet S is conveyed forward, the controller 130 turns on the energizing of the solenoid coil 173 while driving the sheet holder 13 and the holder driving motor 41 in forward rotation. When the solenoid coil 173 is energized, a plunger 172 protrudes from the solenoid coil 173 and pushes the support member 171 to cause the first roller 142 to move to the contact position.

When the sheet S is conveyed rearward in the conveyance path 10, if the sheet S is conveyed rearward with the first roller 142 in contact with the sheet S, the sheet S moving rearward is guided by the first roller 142 to the right in the left-right direction 9 and is away from the first side guide 145. In this case, the sheet S can be kept from leaving the first side guide 145 by moving the first roller 142 from the contact position to the separate position by the movement mechanism 170 so that the sheet S does not contact the first roller 142.

Modification 4

Figure 32:
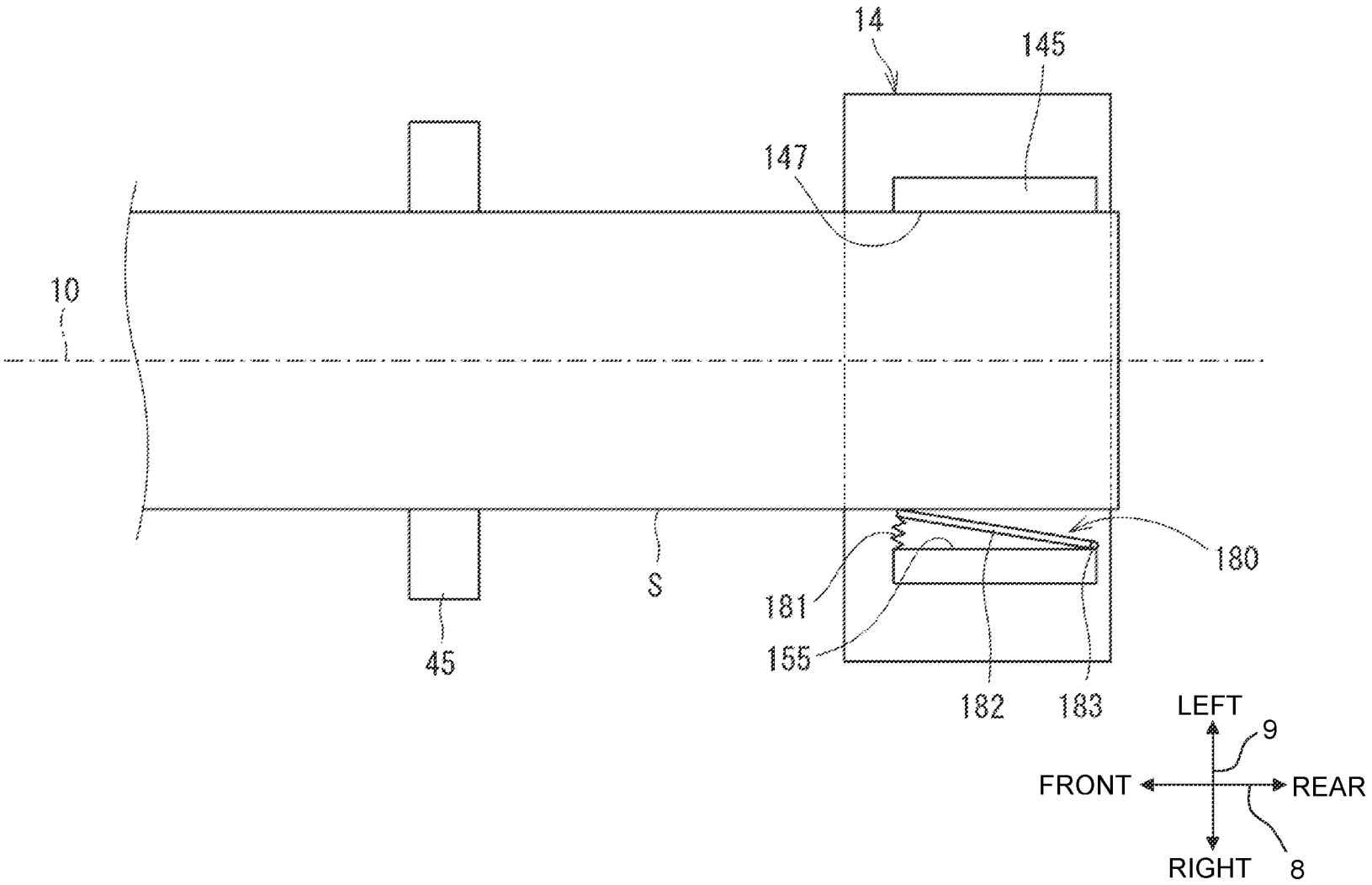
FIG. 32 is a schematic view of the tensioner of the image recording apparatus according to modification 4, viewed from above.

In the embodiment described above, the virtual plane P orthogonal to the axis of the first roller 142 intersects with the conveyance orientation G so that the virtual plane P approaches the first guide surface 147 as it goes downstream in the conveyance orientation G. In other words, the tensioner 14 has the first roller 142 positioned so that the sheet S being conveyed in the conveyance path 10 approaches the first side guide 145. However, a configuration other than the first roller 142 may be provided to bring the conveyed sheet S closer to the first side guide 145. For example, as depicted in FIG. 32, the image recording apparatus 1 may further have a mechanism for bringing the sheet S conveyed through the conveyance path 10 closer to the first guide surface 147.

Specifically, the sub guide 146 may have a movable member 180 and an urging member 181. The movable member 180 can move the sheet S conveyed in the conveyance path 10 from the sub guide surface 155 toward the first guide surface 147. The urging member 181 urges the movable member 180 toward the first guide surface 147.

The movable member 180 has a plate 182 and a support member 183. The plate 182 is a rectangular flat plate spreading in the up-down direction 7. One end of the plate 182 is connected to the support member 183, and the other end of the plate 182 is free to swing. The support member 183 is cylindrical in shape with an axis along the up-down direction 7. The support member 183 is supported rotatably around the axis at an upstream end in the conveyance orientation G of the sub guide surface 155.

The urging member 181 is an elastic member such as a coil spring. One end of the urging member 181 is connected to the sub guide surface 155, and the other end of the urging member 181 is connected to a surface of the plate 182 facing the sub guide surface 155.

The other end of the plate 182 contacts the edge of the sheet S being conveyed in the conveyance path 10 by being urged by the urging member 181 from the sub guide surface 155 to the first guide surface 147.

The sheet S can be brought closer to the first side guide 145 by causing the plate 182 of the movable member 180 to contact, from the right, the sheet S being conveyed between the first guide surface 147 and the sub guide surface 155. Since the movable member 180 in addition to the first roller 142 brings the sheet S closer to the first side guide 145, meandering and skew of the sheet S can be more reliably reduced.

The support member 183 may be rotatably supported around the axis at the downstream end in the conveyance orientation G of the sub guide surface 155, and the plate 182 may extend from the support member 183 to upstream in the conveyance orientation G. In this case, when the sheet S is conveyed in the reverse orientation of the conveyance orientation G, the sheet S is less likely to be caught on the tip of the plate 182.

Modification 5

Figure 34:
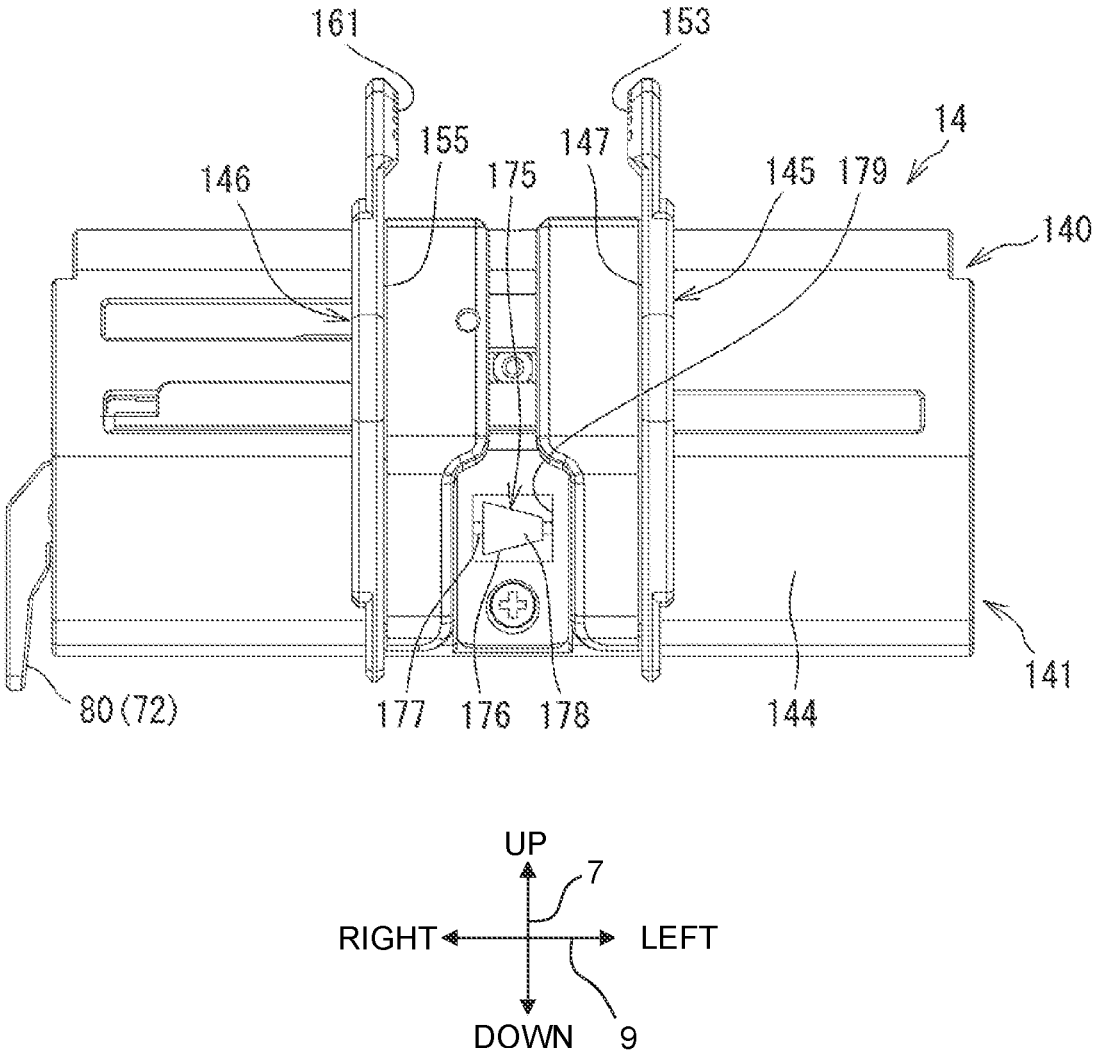
FIG. 34 is a diagram depicting a second roller of the image recording apparatus according to modification 5.

In the embodiment described above, the tensioner 14 has the first roller 142, and the first roller 142 rotates around the axis inclined in the up-down direction 7 relative to the left-right direction 9. However, the first roller 142 may be a second roller 175 rotating around an axis along the left-right direction 9, as depicted in FIG. 34.

The second roller 175 contacts and follows the sheet S being conveyed in the conveyance path 10. The second roller 175 is located at the center of the flat member 141 in the left-right direction 9. The second roller 175 has a main body 176 and a support member 177.

The main body 176 has a conical trapezoidal shape that shrinks in diameter as it goes leftward. The main body 176 has an outer circumferential surface 178 which contacts the sheet S being conveyed in the conveyance path 10. A portion in the outer circumferential surface 178 of the main body 176 protrudes from the first flat surface 144. A support member 177 has a rod shape extending along the left-right direction 9. The support member 177 is supported in a recess 179 located at a central position of the flat member 141. The support member 177 is rotatably supported by the flat member 141.

The second roller 175 can be mounted within the recess 179 of the flat member 141 without inclining the support member 177 with respect to the left-right direction 9. In addition, since the main body 176 is shaped to shrink in diameter as it goes toward the first guide surface 147, the sheet S being conveyed in the conveyance path 10 can be guided to approach the first guide surface 147.

Modification 6

Figure 36:
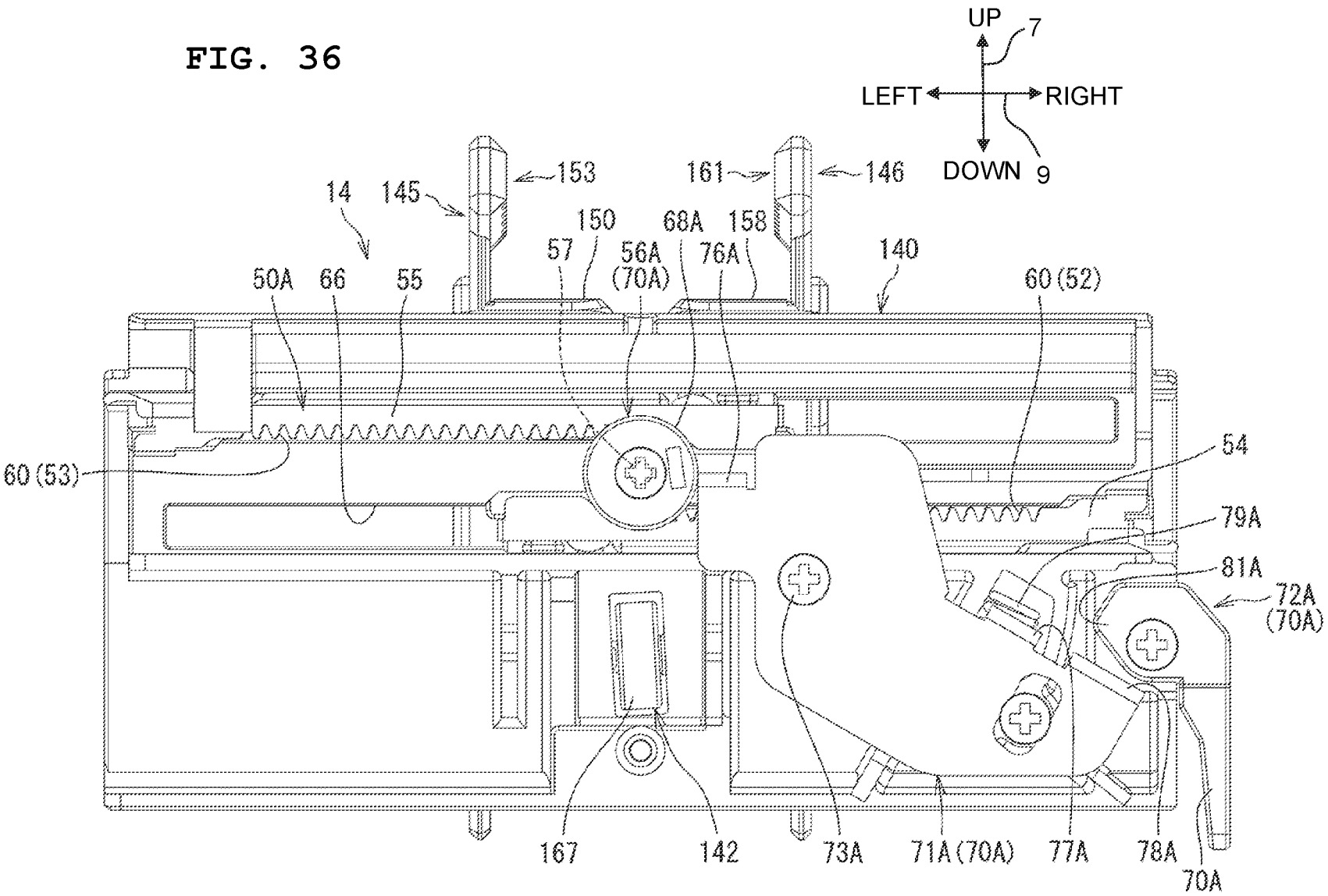
FIG. 36 is a diagram depicting a lock mechanism according to modification 6, with a rotating member in the contact position.

In the embodiment described above, the contact piece 76 of the lock mechanism 70 contacts the first left rack gear 52 to lock or unlock the movement of the interlock mechanism 50. However, as depicted in FIG. 36, the lock mechanism 70A may lock the rotation of the pinion gear 51 of the interlock mechanism 50A. Specifically, the lock mechanism 70A may have a flange 56A, a rotation member 71A, and a lever 72A.

The flange 56A is fitted to the front end of the support shaft 57. The flange 56A has an outer circumferential surface 68A with an axis extending in the front-rear direction 8 as a center. The rotation member 71A is a flat plate shape spreading in the up-down direction 7 and the left-right direction 9 and is located to the right of the flange 56A. The rotation member 71A is connected by a screw 73A near the upper end of the flat member 141 and at a position closer to the right than the center in the left-right direction 9. The rotation member 71A is supported by the flat member 141 in a rotatable manner. The rotation member 71A has a contact part 76A, a first bending piece 77A, and a second bending piece 78A.

The contact part 76A extends rearward at the left end of the upper edge of the rotation member 71A. The contact part 76A contacts the outer circumferential surface 68A of the flange 56A from the right when the rotation member 71A is rotated counterclockwise in FIG. 36. The first bending piece 77A, the second bending piece 78A, and the lever 72A have the same configurations as the first and second bending pieces 77 and 78 and the lever 72 described above, so these configurations will not be described.

Figure 37:
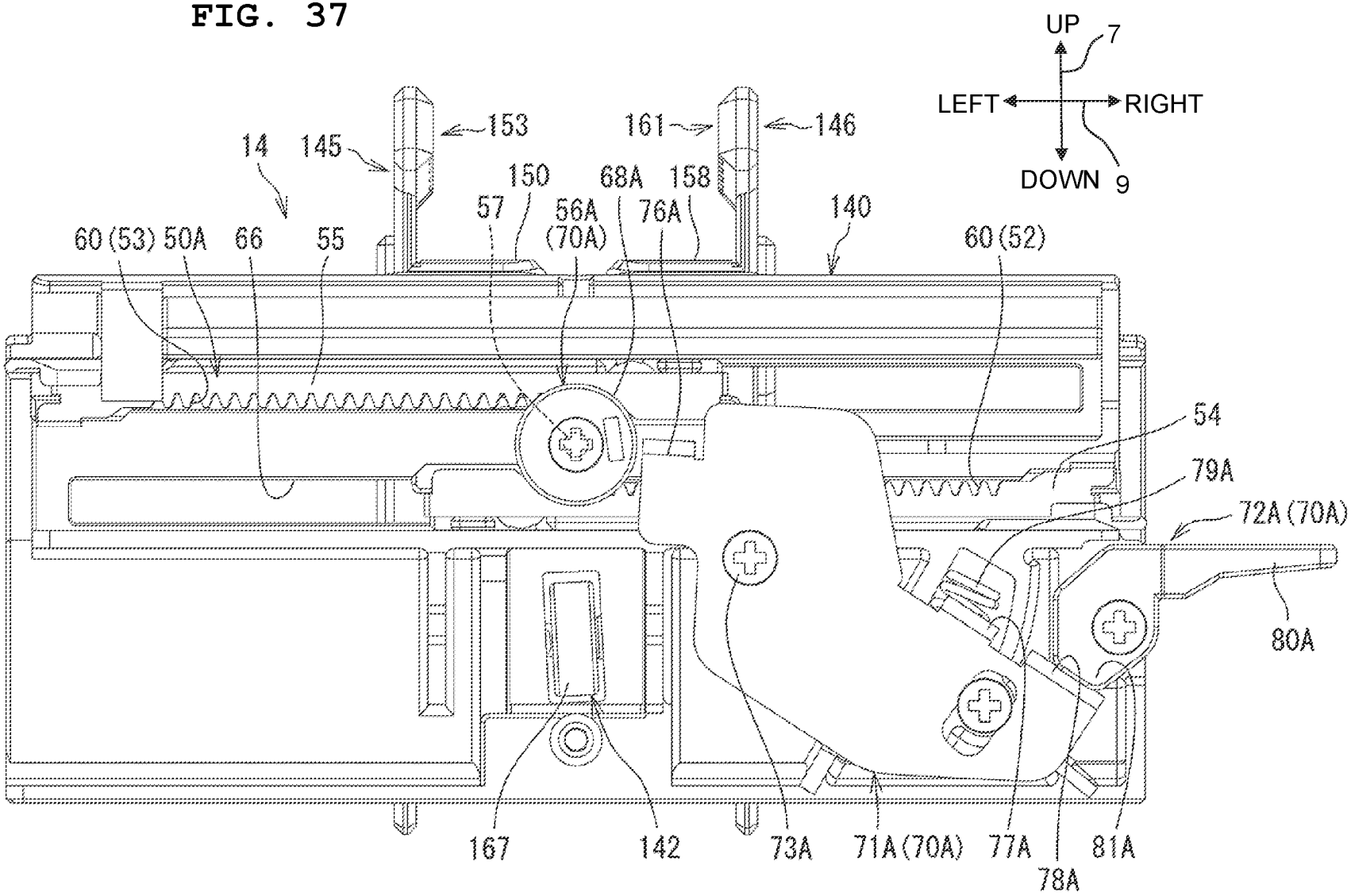
FIG. 37 is a diagram depicting the lock mechanism according to modification 6, with the rotating member in the separate position.

As depicted in FIG. 36, when the lever 72A is operated to the locked position, the rotation member 71A rotates counterclockwise in FIG. 36 according to the urging force of the spring member 79A, and the contact part 76A contacts the outer circumferential surface 68A. When the contact part 76A contacts the outer circumferential surface 68A, the interlock mechanism 50A is locked. On the other hand, as depicted in FIG. 37, when the lever 72A is operated to the separate position, the rotation member 71A rotates clockwise in FIG. 37 against the urging force of the spring member 79A, and the contact part 76A is separated from the outer circumferential surface 68A. When the contact part 76A is separated from the outer circumferential surface 68A, the interlock mechanism 50A is unlocked.

When the movement of the interlock mechanism 50A is locked by the lock mechanism 70A, the first side guide 145 and the second side guide 146 do not move away from each other when subjected to outward external force. However, the first side guide 145 and the second side guide 146 move slightly when subjected to inward external force. Specifically, when the flange 56A is locked by the contact part 76A, the rotation of the flange 56A is prevented. In this state, when the first side guide 145 and the second side guide 146 are subjected to the outward external force, similar to FIG. 8 of the above embodiment, the outward teeth surfaces 60 of the first left rack gear 52 and the outward teeth surfaces 60 of the first right rack gear 53 contact the teeth surfaces of the pinion gear (not depicted). Thus, the first side guide 145 and the second side guide 146 do not move in the direction away from each other.

When the flange 56A is locked by the contact part 76A and the first side guide 145 and the second side guide 146 are subjected to inward external force, the second left rack gear 54 is movable from the second position to the first position with respect to first left rack gear 52. The second right rack gear 55 is also movable from the second position to the first position with respect to the first right rack gear 53. Therefore, when subjected to the inward external force, the first side guide 145 and the second side guide 146 move slightly toward each other against the urging force of the coil spring.

Even if the first side guide 145 and the second side guide 146 are pushed outward due to the sheet S being skewed, the first side guide 145 and the second side guide 146 will not rattle. The first side guide 145 and the second side guide 146 are accurately positioned outwardly in the left-right direction 9 to match the width of the sheet S.

When the contact part 76A contacts the outer circumferential surface 68A, the rotation of the pinion gear 51 is stopped and the movement of the first side guide 145 and the second side guide 146 can be prevented. This is not limited to cases where the contact part 76A and the outer circumferential surface 68A simply contact each other. Gears may be formed on the respective contact surfaces so that the contact part 76A and the outer circumferential surface 68A mesh with each other, or the contact surfaces of the flange 56A and the contact part 76A may be rough surfaces so that the rotation of the flange 56A is easily stopped by contact with the contact part 76A.

Modification 7

Figure 38:
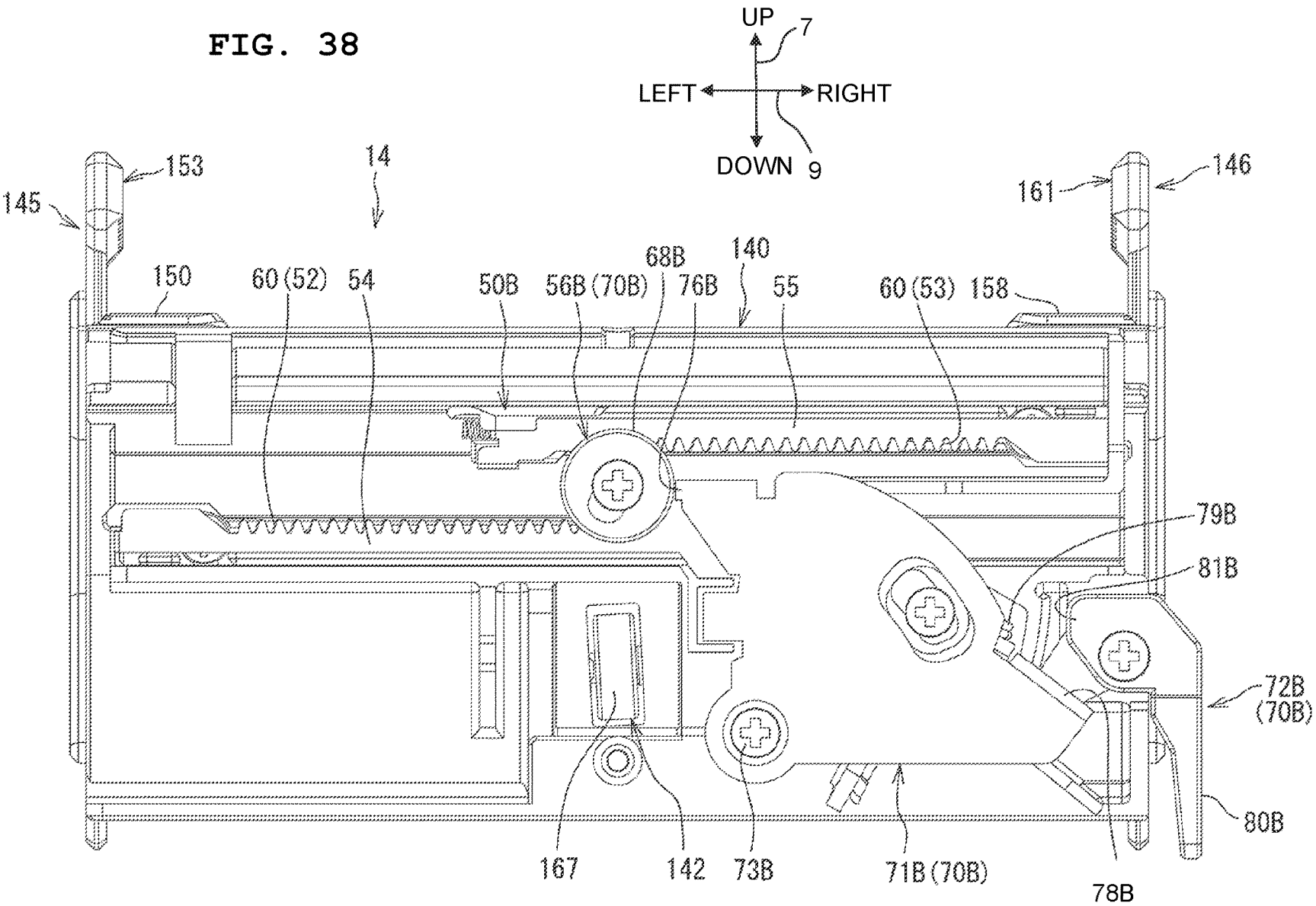
FIG. 38 is a diagram depicting the lock mechanism according to modification 7, with the rotating member in the contact position.
Figure 39:
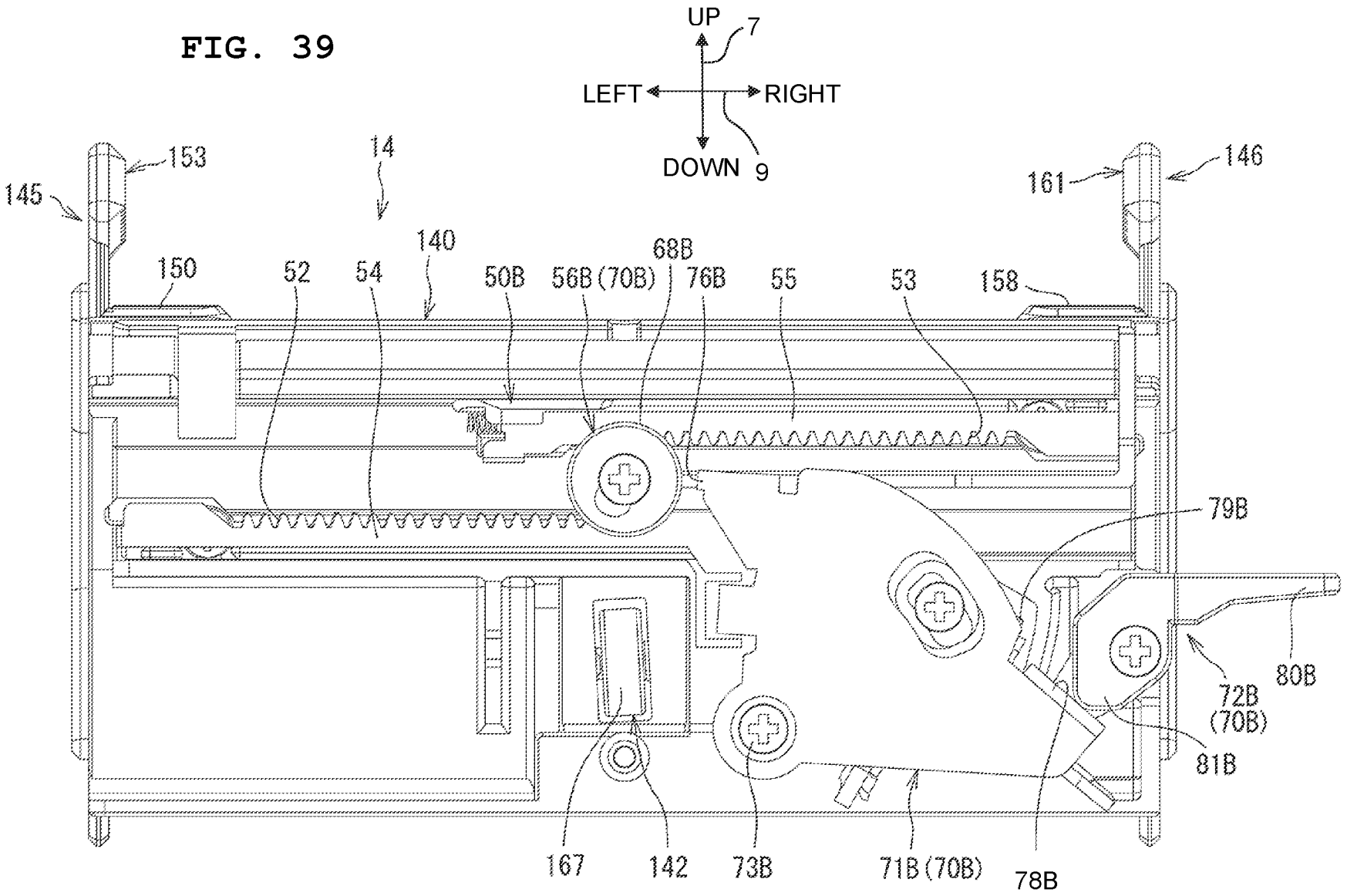
FIG. 39 is a diagram depicting the lock mechanism according to modification 7, with the rotating member in the separate position.

As a configuration other than the modification 6, for example, as depicted in FIGS. 38 and 39, the lock mechanism 70B of the interlock mechanism 50B may have a flange 56B, a rotation member 71B, and a lever 72B.

The flange 56B is similar to the flange 56A and is fitted to the front end of the support shaft 57. The flange 56B has an outer circumferential surface 68B with an axis extending in the front-rear direction 8 as a center. The rotation member 71B is a flat plate shape spreading in the up-down direction 7 and the left-right direction 9 and is located to the right of the flange 56B. The rotation member 71B is connected to the flat member 141 by a screw 73B near the lower end of the flat member 141 and at a position closer to the right than the center in the left-right direction 9. The rotation member 71B is supported by the flat member 141 in a rotatable manner. The rotation member 71B has a contact part 76B, a first bending piece (not depicted), and a second bending piece 78B.

The contact part 76B is located at the left end of the upper edge of the rotation member 71B. The contact part 76B contacts the outer circumferential surface 68B of the flange 56B from the right when the rotation member 71B is rotated counterclockwise in FIG. 38. The first bending piece, the second bending piece 78B, and the lever 72B are configured the same as the first bending piece 77, the second bending piece 78, and the lever 72, so the description is omitted.

When the lever 72B is operated to the lock position, the rotation member 71B rotates counterclockwise in FIG. 38 according to the urging force of the spring member 79B, and the contact part 76B contacts the outer circumferential surface 68B. When the contact part 76B contacts the outer circumferential surface 68B, the interlock mechanism 50B is locked. On the other hand, when the lever 72B is operated to the unlock position, the rotation member 71B rotates clockwise in FIG. 39 against the urging force of the spring member 79B, and the contact part 76B is separated from the outer circumferential surface 68B. When the contact part 76B is separated from the outer circumferential surface 68B, the interlock mechanism 50B is unlocked.

Similar to the modification 6, when the movement of the interlock mechanism 50B of the image recording apparatus 1 according to the modification 7 is locked by the lock mechanism 70B, the first side guide 145 and the second side guide 146 do not move in the direction away from each other even when subjected to the outward external force.

Modification 8

Figure 40:
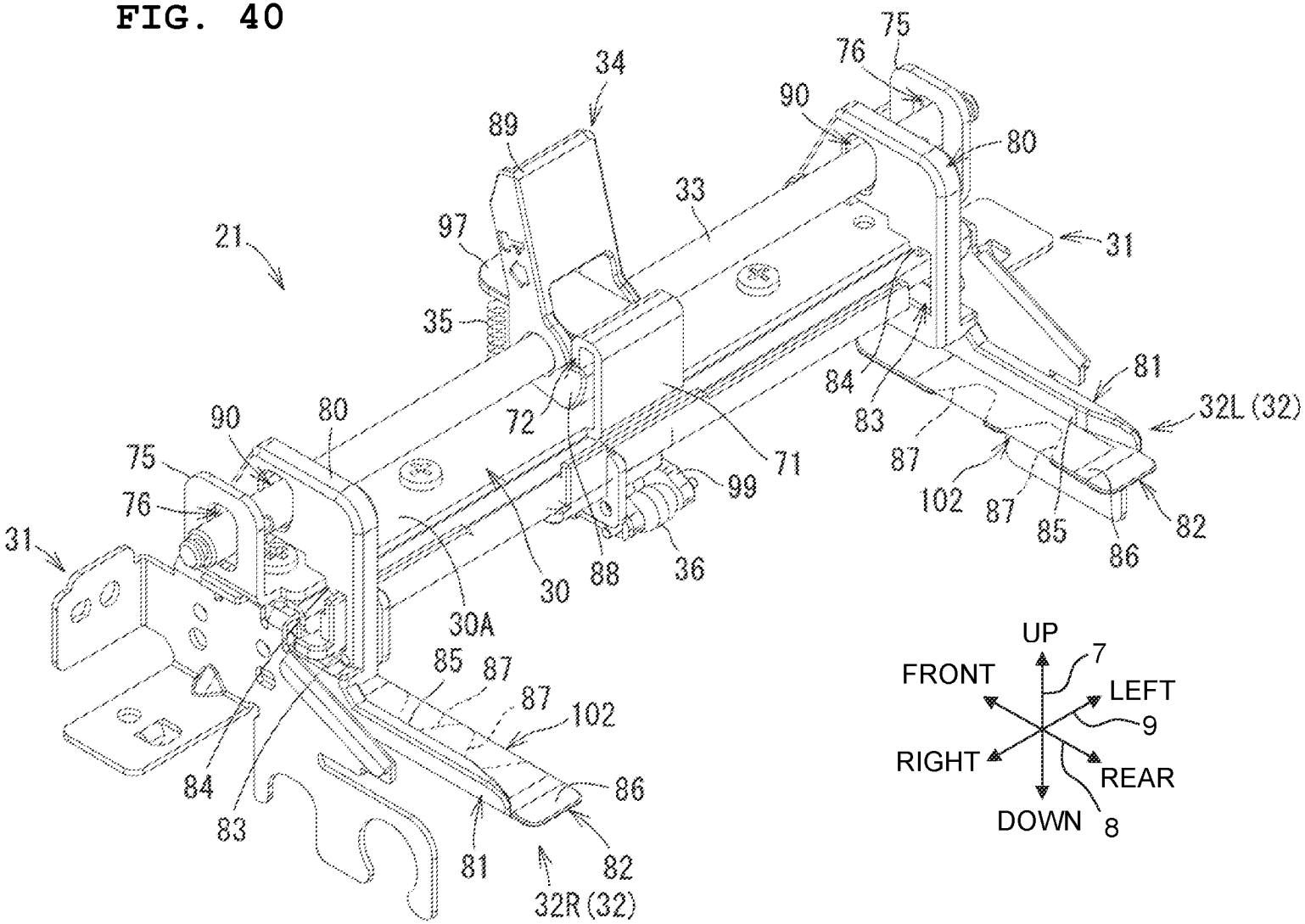
FIG. 40 is a diagram depicting a support member according to modification 8.

In the embodiment described above, the support part 82 has notches 87 in two locations in the front-rear direction 8. Further, as depicted in FIG. 40, the support part 82 may have a film 102. The film 102 is a thin film, through which light emitted from the light emitting portions of the optical sensors 24, 25 and reflected light from the sheet S is transmitted in the up-down direction 7. The film 102 is rectangular and long in the front-rear direction 8 as viewed from up and down. The film 102 is attached to the support surface 86. The film 102 closes the notches 87 from above in the up-down direction 7. The film 102 prevents the tip of the sheet S moving above the support surface 86 from entering the notches 87. The film 102 may cover the entire support surface 86 or a portion of the support surface 86 including the two notches 87. The film 102 may be attached to the lower surface of the support part 82 (a surface opposite the support surface 86 in the up-down direction 7) to close the notches 87 from below.

Other Modifications

In the embodiment described above, the tensioner 14 has the arc member 140, the flat member 141, the support shaft 42 supported by the pair of frames 27, 28, the support plate 43 located below the support shaft 42, and the urging members 18 urging the arc member 140 and the flat member 141, which are supported by the support shaft 42 swingably, rearward. However, tension applying means 40A, 40B, 40C, 40D other than the configuration described above may be used to apply the tension to the sheet S. For example, as depicted in FIGS. 33A to 33D, the tension applying means 40A may consist of a tensioner 14 fixed to housing 11 and a configuration other than the tensioner 14 to apply tension to sheet S.

Figure 33A:
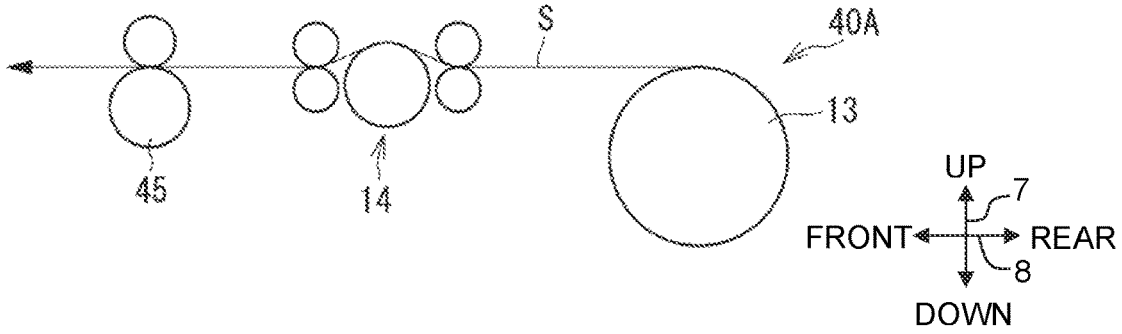
FIGS. 33A-33D are diagrams depicting other modifications in which tension is applied to the sheet by the tensioner fixed to a frame.

As depicted in FIG. 33A, for example, the tension applying means 40A may have tensioner 14 fixed to a pair of frames (not depicted), and the holder ejection speed Va of the sheet holder 13 may be smaller than the roller conveyance speed Vb by the conveyance roller 45. The difference in speed between the holder ejection speed Va and the roller conveyance speed Vb provides tension to the sheet S at the tensioner 14, which is fixed in position.

Figure 33B:
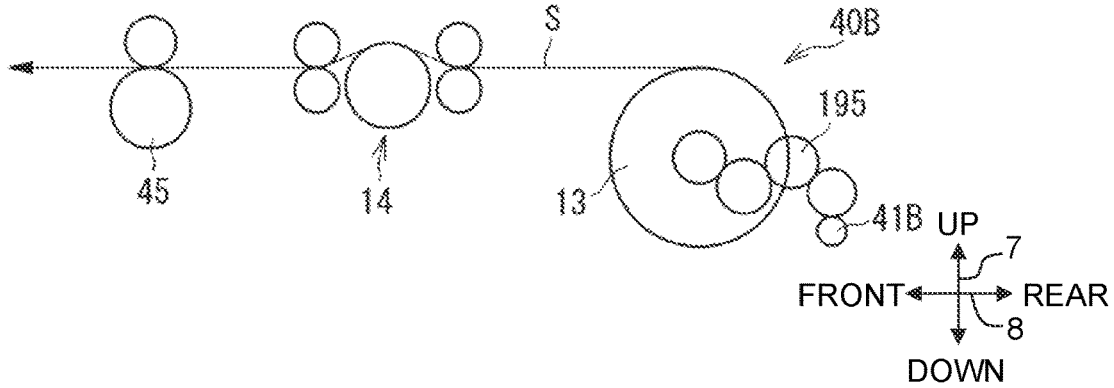
Figure 33C:
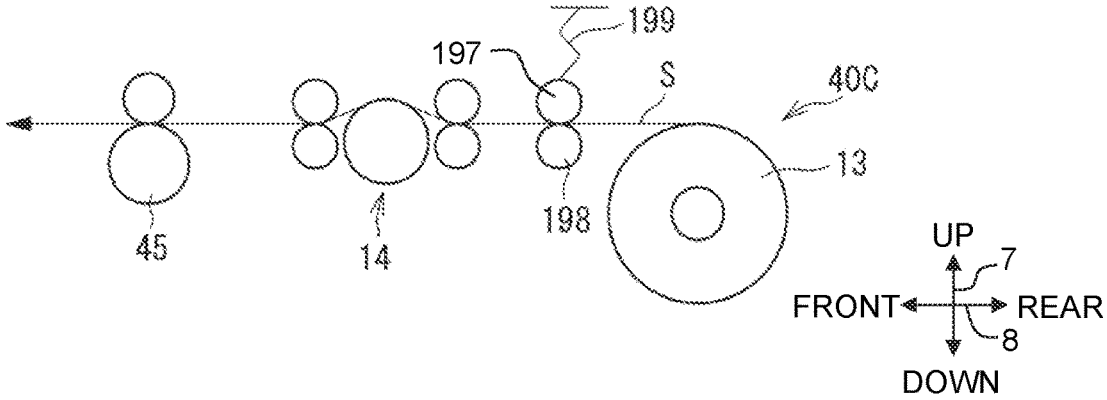
Figure 33D:
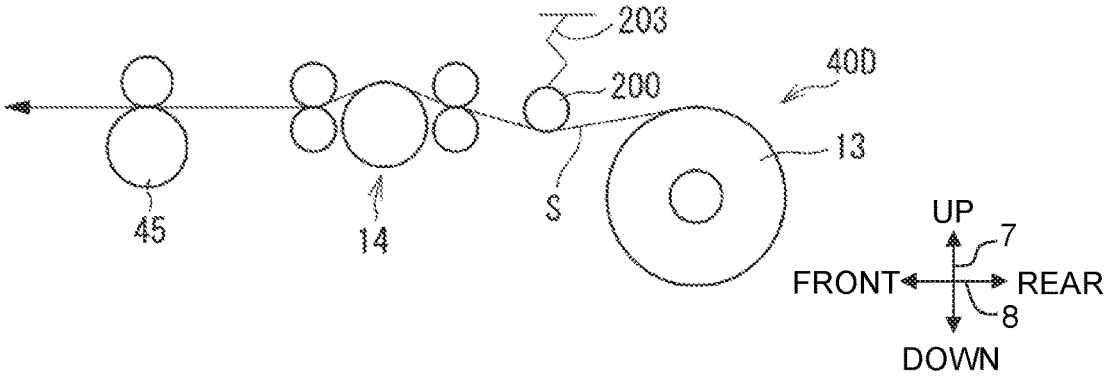

As depicted in FIG. 33B, the tension applying means 40B may be configured such that the power of the holder driving motor 41B is transmitted to the sheet holder 13 via a torque limiter 195 and a plurality of gears, in a state that the tensioner 14 is fixed to the pair of frames (not depicted). In this case, the holder ejection speed Va may be smaller than the roller conveyance speed Vb. The difference in speed between the holder ejection speed Va and the roller conveyance speed Vb provides tension to the sheet S in the tensioner 14, which is fixed in position.

The tension applying means 40C may include a tensioner 14 fixed to the pair of frames (not depicted), a pinch roller 197 rotating around an axis extending in the left-right direction 9 between the sheet holder 13 and the tensioner 14, and a driven roller 198 having a torque limiter and driven by the pinch roller 197. The pinch roller 197 is urged by an urging member 199 downward toward the driven roller 198. The sheet S being conveyed between the pinch roller 197 and the driven roller 198 is back tensioned by the torque limiter of the driven roller 198, and tension is applied to the sheet S in the tensioner 14.

The tension applying means 40D may be provided with a tensioner 14 fixed to the pair of frames (not depicted) and an urging roller 200 rotating around an axis extending in the left-right direction 9 between the sheet holder 13 and tensioner 14. The urging roller 200 is located above the conveyance path 10. The urging roller 200 is urged downward by an urging member 203 and applies tension to the sheet S from above between the sheet holder 13 and the tensioner 14. The tension is applied to the sheet S in the tensioner 14 by applying tension to the sheet S from the urging roller 200.

In the embodiment described above, the tensioner 14 is configured such that the flat member 141 is located at the lower end of the arc member 140. However, the tensioner 14 may have only the arc member 140, without the flat member 141. In this case, the first roller 142 may be located on the arc member 140 and a portion of the outer circumferential surface 167 may protrude from the second curved surface 150 in the outward orientation Q.

In the embodiment described above, the controller 130 drives the rotational speed Vh of the holder driving motor 41 for the forward rotation in three steps, Vh1, Vh2, or Vh3. However, the controller 130 may drive the rotational speed Vh of the holder driving motor 41 for the forward rotation in two steps, in four or more steps, or in stepless speed changes.

In the embodiment described above, the first sensor 29*a*, the second sensor 29*b*, and the third sensor 29*c* detect the rotation of the arm 205 to determine the remaining amount of sheet S. However, for example, the controller 130 may calculate the remaining amount of sheet S based on the length of sheet S ejected from the rolled body in the initial state. The thickness of the sheet S in a state of being wound onto the sheet holder 13 may be detected by a sensor based on a laser, ultrasonic wave, or the like.

Figure 35:
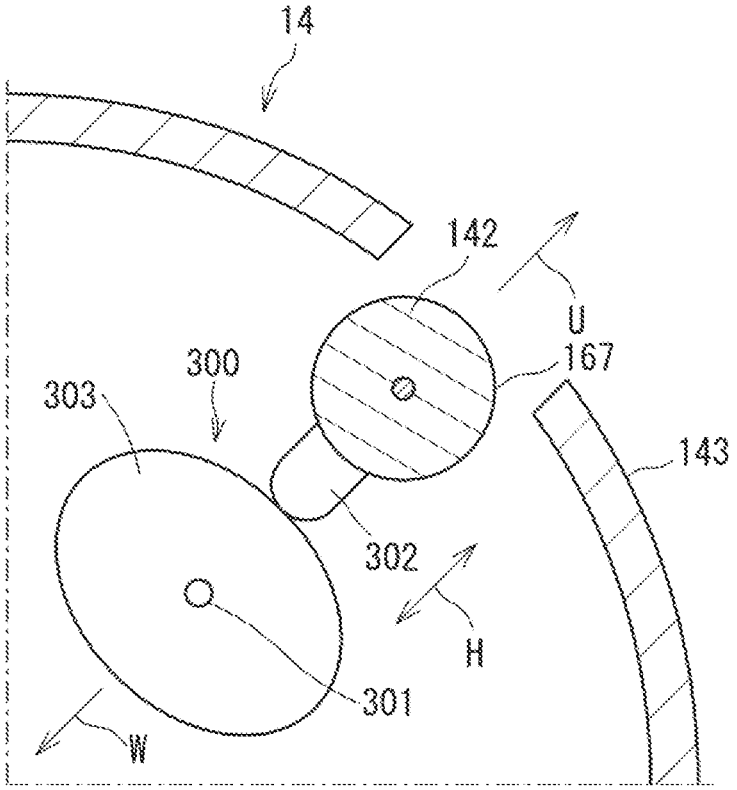
FIG. 35 is a diagram depicting an example of the movement mechanism movable between a contact position and a separate position.
Figure 35:
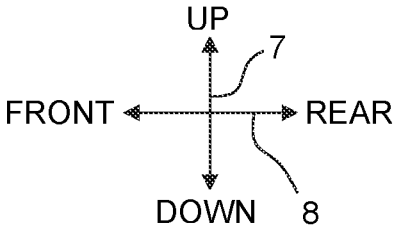

In the embodiment described above, the holder winding speed Vc is smaller than the reverse conveyance speed Vd when the sheet S is conveyed rearward. However, as depicted in FIG. 35, the outer circumferential surface 167 of the first roller 142 may be arranged so that a portion of the outer circumferential surface 167 protrudes from the first curved surface 143 of the arc member 140. The outer circumferential surface 167 of the first roller 142 may be retractable from the second curved surface 150 by a movement mechanism 300 such that the outer circumferential surface 167 of the first roller 142 can be separated from the sheet S.

The movement mechanism 300 may be a cam mechanism to move the support member 302 by moving the cam 303 in the stroke direction H. The first roller 142 is rotatably supported by the support member 302. The cam 303 is supported by a support member 301 extending in the left-right direction 9 and is rotated by a motor (not depicted). As the cam 303 rotates around the support member 301, the first roller 142 is moved in the outward orientation U or in the inward orientation W. At this time, the first roller 142 can protrude from the first curved surface 143 and move to the contact position, or the first roller 142 can retract into the arc member 140 and move to the separate position.

When the sheet S is conveyed rearward, the controller 130 drives the motor to move the first roller 142 to the separate position while driving the sheet holder 13 and the holder driving motor 41 in reverse rotation. When the sheet S is conveyed forward, the controller 130 drives the motor to move the first roller 142 to the contact position while driving the sheet holder 13 and the holder driving motor 41 in the forward rotation.

In the aforementioned embodiment, the front side guide 21 has the interlock mechanism 250, but the interlock mechanism 250 may not be provided. The rear side guide 15 or the front side guide 21 may be provided only one of upstream and downstream from the conveyance roller pair 16.

The image recording method in the image recording apparatus 1 is not limited to the inkjet method, and may be an electrophotographic method or a thermal transfer method.

What is claimed is:

1. A conveying apparatus, comprising:

a conveying unit configured to convey a sheet in a conveyance direction along a conveyance path;

a sheet holder arranged upstream in the conveyance direction from the conveying unit to rotate around an axis, the axis extending in a first direction intersecting with the conveyance direction;

a tensioner arranged between the sheet holder and the conveying unit in the conveyance path and configured to apply tension to the sheet with the sheet being curved; and a first side guide attached to the tensioner and having a first guide surface, the first guide surface spreading along the conveyance direction and a second direction intersecting with the first direction, wherein the tensioner includes an oblique roller configured to guide the sheet to the first guide surface.

2. The conveying apparatus according to claim 1, wherein the oblique roller is a first roller configured to contact the sheet while rotating around a rotation axis, and the rotation axis of the oblique roller is inclined with respect to the conveyance direction such that a virtual plane orthogonal to the rotation axis approaches the first guide surface toward downstream of the conveyance direction.

3. The conveying apparatus according to claim 1, wherein the oblique roller is a second roller configured to contact the sheet while rotating around a rotation axis, and the second roller includes:

a body having a conical trapezoidal shape with reduced diameter toward the first guide surface; and a support member extending in a direction intersecting with the conveyance direction and configured to support the body.

4. The conveying apparatus according to claim 2, wherein an area in the first direction occupied by the first roller includes a center of the sheet holder in the first direction.

5. The conveying apparatus according to claim 1, further comprising:

a sub guide attached to the tensioner and having a sub guide surface, the sub guide surface facing the first guide surface in the first direction; and an interlock mechanism configured to interlock movement of the first side guide in the first direction and movement of the sub guide in the first direction, wherein the interlock mechanism includes:

a pair of rack gears, one of the rack gears being connected to the first side guide and extending from the first side guide toward the sub guide in the first direction, the other of the rack gears being connected to the sub guide and extending from the sub guide toward the first side guide in the first direction; and a pinion gear configured to mesh with the rack gears.

6. The conveying apparatus according to claim 5, wherein a distance in the first direction between the first side guide and a center of the sheet holder in the first direction is the same as a distance in the first direction between the sub guide and the center of the sheet holder in the first direction.

7. The conveying apparatus according to claim 1, wherein the tensioner is configured to move in a direction intersecting with a surface of the sheet being curved, and the tensioner is configured to be urged toward outside of a curve of the sheet.

8. The conveying apparatus according to claim 1, wherein a downstream end edge in the conveyance direction of the first guide surface departs from the tensioner toward downstream in the conveyance direction, and the first side guide includes a guard surface continuous from the downstream end edge and spreading in the first direction.

9. The conveying apparatus according to claim 2, wherein the first side guide includes an extending piece extending from the first guide surface in the first direction, the extending piece having a curved surface being curved along the conveyance direction, and a part of an outer circumferential surface of the first roller projects from the curved surface toward the second surface.

10. The conveying apparatus according to claim 1, further comprising:

a holder driving motor configured to apply driving force to the sheet holder to rotate the sheet holder;

a conveyance motor configured to apply driving force to the conveying unit to rotate a roller of the conveying unit; and a controller configured to drive the holder driving motor and the conveyance motor, such that speed at which the sheet in the sheet holder is ejected in the conveyance direction and speed at which the sheet is conveyed by the conveying unit in the conveyance direction are different from each other.

11. The conveying apparatus according to claim 1, further comprising a pair of second side guides arranged downstream in the conveyance direction from the conveying unit, wherein the second side guides have second guide surfaces facing each other in the first direction, each of the second guide surfaces spreading along the conveyance direction and the second direction.

12. The conveying apparatus according to claim 1, further comprising:

a holder driving motor configured to apply driving force to the sheet holder to rotate the sheet holder;

a conveyance motor configured to apply driving force to the conveying unit to rotate a roller of the conveying unit; and a controller configured to drive the holder driving motor and the conveyance motor, such that speed at which the sheet is rewound in the sheet holder in a reverse direction opposite to the conveyance direction is smaller than speed at which the sheet is conveyed by the conveying unit in the reverse direction.

13. The conveying apparatus according to claim 2, further comprising:

a holder driving motor configured to apply driving force to the sheet holder to rotate the sheet holder;

a conveyance motor configured to apply driving force to the conveying unit to rotate a roller of the conveying unit;

a movement mechanism configured to move the first roller between a contact position where the first roller contacts the sheet and a separate position where the first roller is apart from the sheet, and a controller configured to control the movement mechanism to move the first roller to the separate position while driving the holder driving motor and the conveyance motor such that the sheet is conveyed in a reverse direction opposite to the conveyance direction.

14. The conveying apparatus according to claim 13, wherein the movement mechanism is a solenoid configured to move a support member by movement of a plunger in a stroke direction, the support member being configured to support the first roller to be rotatable, and the controller is configured to turn off a power to the solenoid to move the first roller to the separate position while driving the holder driving motor and the conveyance motor such that the sheet is conveyed in the reverse direction.

15. The conveying apparatus according to claim 1, further comprising:

a holder driving motor configured to apply driving force to the sheet holder to rotate the sheet holder;

a conveyance motor configured to apply driving force to the conveying unit to rotate a roller of the conveying unit; and a controller configured to drive the holder driving motor and the conveyance motor such that the sheet is conveyed by the conveying unit in the conveyance direction at least once, after driving the holder driving motor and the conveyance motor to convey the sheet in a reverse direction opposite to the conveying direction.

16. The conveying apparatus according to claim 1, further comprising:

a housing; and a tension applying means configured to apply tension to the sheet in the tensioner, wherein the tensioner is fixed to the housing.

17. The conveying apparatus according to claim 16, further comprising:

a holder driving motor configured to apply driving force to the sheet holder to rotate the sheet holder;

a conveyance motor configured to apply driving force to the conveying unit to rotate a roller of the conveying unit; and a controller configured to drive the holder driving motor and the conveyance motor, such that speed at which the sheet in the sheet holder is ejected in the conveyance direction and speed at which the sheet is conveyed by the conveying unit in the conveyance direction are different from each other.

18. A conveying apparatus, comprising:

a conveyance roller configured to convey a sheet in a conveyance direction along a conveyance path;

a frame including:

a guide member extending in a first direction intersecting with the conveyance direction; and support members arranged at both end sides in the first direction of the conveyance path and having first long holes respectively, each of the first long holes being extended in a second direction intersecting with the conveyance direction and the first direction;

side guides arranged between the support members and having second long holes being extended in the second direction respectively, the side guides being movable in the first direction along the guide member;

a shaft inserted into the first long holes and the second long holes;

a lever fixed to the shaft; and an elastic member configured to urge the shaft toward the guide member, wherein each of the second long holes has a tapered portion, a dimension in the conveyance direction of the tapered portion decreases toward the guide member as compared with a dimension in the conveyance direction of the shaft, and the lever is configured to rotate between a first rotational position to apply urging force of the elastic member to the shaft and a second rotational position to retain the shaft at a position away from the tapered portion against the urging force of the elastic member.

19. The conveying apparatus according to claim 18, wherein the lever has a cam surface, in a state that the lever is in the first rotational position, the cam surface is separated away from the guide member, and in a state that the lever is in the second rotational position, the cam surface contacts the guide member.

20. The conveying apparatus according to claim 18, wherein the tapered portion includes: a first surface spreading along the first direction and the second direction; and a second surface facing the first surface in the conveyance direction and spreading along the first direction and a direction intersecting with the first surface.

21. The conveying apparatus according to claim 20, wherein the side guides have support surfaces to support the sheet and guide surfaces being extended from the support surfaces along the second direction respectively, at positions in the second direction opposite to the shaft with respect to the guide member.

22. The conveying apparatus according to claim 21, wherein one of the support surfaces has an inner end and an outer end farther in the first direction from the other of the support surfaces than the inner end, and a part of the inner end bulges toward the outer end.

23. The conveying apparatus according to claim 22, further comprising a roller arranged between the guide member and the support surfaces in the second direction.

24. The conveying apparatus according to claim 18, further comprising:

a second frame;

second side guides;

a second shaft;

a second lever; and a second elastic member, wherein the frame, the side guides, the shaft, the lever and the elastic member are arranged downstream in the conveyance direction from the conveyance roller, and the second frame, the second side guides, the second shaft, the second lever and the second elastic member are arranged upstream in the conveyance direction from the conveyance roller.

25. A conveying apparatus, comprising:

a conveyance roller configured to convey a sheet in a conveyance direction along a conveyance path;

a guide member extending in a first direction intersecting with the conveyance direction;

side guides arranged to be apart from each other in the first direction, the side guides being movable in the first direction along the guide member; and an interlock mechanism configured to interlock movement of the side guides in the first direction, wherein the interlock mechanism includes:

first rack gears connected to the side guides respectively and extending from the side guides inwardly in the first direction;

second rack gears overlapped with the first rack gears respectively in a second direction intersecting with the conveyance direction and the first direction, the second rack gears being movable in the first direction between a first position and a second position, the second rack gears being in phase with the first rack gears in the first position, the second rack gears being out of phase with the first rack gears in the second position;

a pinion gear configured to mesh with the first rack gears and the second rack gears; and an elastic member configured to urge the second rack gears toward the second position with respect to the first rack gears.

26. The conveying apparatus according to claim 25, wherein the first rack gears have inward teeth surfaces facing inwardly in the first direction and the second rack gears have inward teeth surfaces facing inwardly in the first direction, in a state of the second rack gears being in the first position, the inward teeth surfaces of the second rack gears overlap with the inward teeth surfaces of the first rack gears respectively in the second direction, in a state of the second rack gears being in the second position, the inward teeth surfaces of the first rack gears are shifted inwardly in the first direction with respect to the inward teeth surfaces of the second rack gears, and the elastic member is configured to urge the second rack gears outwardly in the first direction with respect to the first rack gears.

27. The conveying apparatus according to claim 25, wherein the first rack gears are guided in the first direction while being fitted in the guide member.

28. The conveying apparatus according to claim 25, wherein a dimension in the second direction of each of the first rack gears is greater than a dimension in the second direction of each of the second rack gears.

29. The conveying apparatus according to claim 28, further comprising a flange configured to support the pinion gear, wherein the second rack gears are positioned between the first rack gears and the flange in the second direction.

30. The conveying apparatus according to claim 25, wherein the second rack gears are supported by the first rack gears to be movable.

31. The conveying apparatus according to claim 25, further comprising:

a sheet holder arranged upstream in the conveyance direction from the conveyance roller to rotate around an axis extending in the first direction; and a tensioner arranged between the sheet holder and the conveyance roller in the conveyance path and configured to apply tension to the sheet with the sheet being curved;

wherein the side guides include:

a first side guide attached to the tensioner and having a first guide surface, the first guide surface spreading along the conveyance direction and the second direction; and a second side guide attached to the tensioner and having a second guide surface, the second guide surface facing the first guide surface in the first direction, one of the first rack gears is connected to the first side guide and extends from the first side guide toward the second side guide in the first direction, and the other of the first rack gears is connected to the second side guide and extends from the second side guide toward the first side guide in the first direction.

32. The conveying apparatus according to claim 31, wherein the interlock mechanism includes a lock mechanism configured to prevent the first side guide and the second side guide from moving in the first direction, the tensioner includes a first roller configured to contact the sheet while rotating around a rotation axis, and the rotation axis is inclined with respect to the conveyance direction such that a virtual plane orthogonal to the rotation axis approaches one of the first guide surface and the second guide surface toward downstream of the conveyance direction.

33. The conveying apparatus according to claim 32, wherein the lock mechanism includes:

a disk configured to rotate around a shaft of the pinion gear in synchronization with rotation of the pinion gear; and a lock member having a contact part configured to contact an outer circumferential surface of the disk, the lock member is configured to move between a contact position where the contact part contacts the outer circumferential surface and a separate position where the contact part is apart from the outer circumferential surface.

34. The conveying apparatus according to claim 32, wherein the lock mechanism includes a lock member having a contact piece configured to move in a third direction intersecting with the first direction and the second direction, and the lock member is configured to move between a contact position where the contact piece contacts any one of the first rack gears and a separate position where the contact piece is apart from the first rack gears.

35. The conveying apparatus according to claim 31, further comprising a third side guide and a fourth side guide arranged downstream in the conveyance direction from the conveyance roller, wherein the third side guide has a third guide surface spreading along the conveyance direction and the second direction, and the fourth side guide has a fourth guide surface spreading along the conveyance direction and the second direction and facing the third guide surface in the first direction.

36. A printing apparatus, comprising:

the conveying apparatus as defined in claim 31; and a recording head configured to record an image on the sheet conveyed by the conveyance roller.

* * * * *